US009436107B2

(12) United States Patent
Murakami et al.

(10) Patent No.: US 9,436,107 B2
(45) Date of Patent: Sep. 6, 2016

(54) METHOD OF PRODUCING ELECTROPHOTOGRAPHIC PHOTOSENSITIVE MEMBER, AND EMULSION FOR A CHARGE TRANSPORTING LAYER

(71) Applicant: CANON KABUSHIKI KAISHA, Tokyo (JP)

(72) Inventors: Takeshi Murakami, Numazu (JP); Akihiro Maruyama, Mishima (JP); Hiroki Uematsu, Mishima (JP); Harunobu Ogaki, Suntou-gun (JP); Atsushi Okuda, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 34 days.

(21) Appl. No.: 14/374,044

(22) PCT Filed: Mar. 6, 2013

(86) PCT No.: PCT/JP2013/056877
§ 371 (c)(1),
(2) Date: Jul. 23, 2014

(87) PCT Pub. No.: WO2013/137282
PCT Pub. Date: Sep. 19, 2013

(65) Prior Publication Data

US 2015/0056547 A1 Feb. 26, 2015

(30) Foreign Application Priority Data

Mar. 15, 2012 (JP) ..... 2012-058904
Feb. 28, 2013 (JP) ..... 2013-039646

(51) Int. Cl.
*G03G 5/00* (2006.01)
*G03G 5/07* (2006.01)
*G03G 5/05* (2006.01)

(52) U.S. Cl.
CPC ..... *G03G 5/078* (2013.01); *G03G 5/05* (2013.01); *G03G 5/051* (2013.01); *G03G 5/0514* (2013.01);
(Continued)

(58) Field of Classification Search
CPC ..... G03G 5/051; G03G 5/0525
USPC ..... 430/130
See application file for complete search history.

(56) References Cited

U.S. PATENT DOCUMENTS 3,563,736 A 2/1971 Koehler, Jr. et al.
3,649,263 A 3/1972 Tubuko et al.
(Continued)

FOREIGN PATENT DOCUMENTS

JP 2002-31900 A 1/2002
JP 2002-268241 A 9/2002
(Continued)

OTHER PUBLICATIONS

European Search Report dated Oct. 5, 2015 in European Application No. 13760583.8.
(Continued)

*Primary Examiner* — Mark A Chapman
(74) *Attorney, Agent, or Firm* — Fitzpatrick, Cella, Harper & Scinto

(57) ABSTRACT

A method of producing an electrophotographic photosensitive member includes: preparing a solution including a charge transporting substance, and at least one compound selected from the group consisting of a fluorine-atom-containing polyacrylate, a fluorine-atom-containing polymethacrylate, a polycarbonate having a siloxane bond, a polyester having a siloxane bond, a polystyrene having a siloxane bond, a silicone oil, a polyolefin, an aliphatic acid, an aliphatic acid amide and an aliphatic acid ester; preparing an emulsion by using the solution and water; forming a coat of the emulsion on a support; and heating the coat to form a charge transporting layer.

13 Claims, 2 Drawing Sheets

(52) U.S. Cl.
CPC ..... *G03G 5/0525* (2013.01); *G03G 5/0535* (2013.01); *G03G 5/0539* (2013.01); *G03G 5/0546* (2013.01); *G03G 5/0564* (2013.01); *G03G 5/0578* (2013.01); *G03G 5/0589* (2013.01)

(56) References Cited

U.S. PATENT DOCUMENTS

| | | | | |
|---|---|---|---|---|
| 6,521,387 | B2 | 2/2003 | Kawasaki | |
| 7,186,489 | B2 | 3/2007 | Uematsu et al. | |
| 7,226,711 | B2 | 6/2007 | Amamiya et al. | |
| 7,534,534 | B2 | 5/2009 | Nakata et al. | |
| 7,622,238 | B2 | 11/2009 | Uematsu et al. | |
| 7,629,102 | B2 | 12/2009 | Ochi et al. | |
| 8,841,052 | B2 | 9/2014 | Watariguchi et al. | |
| 2002/0094487 | A1* | 7/2002 | Kawasaki | G03G 5/047 430/58.05 |
| 2012/0263494 | A1 | 10/2012 | Okuda et al. | |
| 2014/0315124 | A1 | 10/2014 | Okuda et al. | |
| 2014/0322434 | A1 | 10/2014 | Yamagishi et al. | |
| 2014/0342285 | A1 | 11/2014 | Ogaki et al. | |

FOREIGN PATENT DOCUMENTS

| | | | |
|---|---|---|---|
| JP | 2005-208112 | A | 8/2005 |
| JP | 2007-79555 | A | 3/2007 |
| JP | 2010-230845 | A | 10/2010 |
| JP | 2011-128213 | A | 6/2011 |
| JP | 2011-145521 | A | 7/2011 |
| JP | 4854824 | B1 | 1/2012 |
| JP | 2012-27091 | A | 2/2012 |

OTHER PUBLICATIONS

U.S. Appl. No. 14/378,228, filed Aug. 12, 2014. Inventor: Akihiro, et al.
U.S. Appl. No. 14/304,172, filed Jun. 13, 2014. Inventor: Atsushi, et al.
U.S. Appl. No. 14/295,989, filed Jun. 4, 2014. Inventor: Harunobu, et al.
U.S. Appl. No. 14/468,266, filed Aug. 25, 2014. Inventor: Watariguchi, et al.
PCT International Search Report and Written Opinion of the International Searching Authority, International Application No. PCT/JP2013/056877, Mailing Date Jun. 11, 2013.

* cited by examiner

METHOD OF PRODUCING ELECTROPHOTOGRAPHIC PHOTOSENSITIVE MEMBER, AND EMULSION FOR A CHARGE TRANSPORTING LAYER

TECHNICAL FIELD

The present invention relates to a method of producing an electrophotographic photosensitive member, and an emulsion for a charge transporting layer.

BACKGROUND ART

Electrophotographic photosensitive members to be mounted on electrophotographic apparatuses include organic electrophotographic photosensitive members containing an organic photoconductive substance (hereinafter, also referred to as an "electrophotographic photosensitive member"). The organic electrophotographic photosensitive members are currently a mainstream as an electrophotographic photosensitive member used in a process cartridge for the electrophotographic apparatus or the electrophotographic apparatus, and produced in a large scale. Among these electrophotographic photosensitive members, a laminate type electrophotographic photosensitive member is often used, of which properties are improved by separately providing the functions necessary for the electrophotographic photosensitive member in individual layers.

A method of producing the laminate type electrophotographic photosensitive member is usually used in which a functional material is dissolved in an organic solvent to prepare an application solution (coating solution), and the coating solution is applied onto a support. Among the layers in the laminate type electrophotographic photosensitive member, a charge transporting layer often demands durability. For this reason, the charge transporting layer has a film thickness of a coat relatively thicker than those of other layers. Accordingly, a large amount of the coating solution is used for the charge transporting layer, resulting in a large amount of the organic solvent to be used. In order to reduce the amount of the organic solvent to be used in production of the electrophotographic photosensitive member, the amount of the organic solvent to be used for the coating solution for a charge transporting layer is desirably reduced. To prepare the coating solution for a charge transporting layer, however, a halogen solvent or an aromatic organic solvent needs to be used because a charge transporting substance and a binder resin are highly soluble in the halogen solvent or the aromatic organic solvent. For this reason, the amount of the organic solvent to be used is difficult to reduce.

PTL 1 discloses an attempt to reduce a volatile substance and the amount of an organic solvent to be used in a coating solution for forming a charge transporting layer (coating solution for a charge transporting layer). PTL 1 discloses preparation of an emulsion type coating solution (emulsion) by forming an organic solution into oil droplets in water in which the organic solution is prepared by dissolving a substance included in a charge transporting layer in an organic solvent.

CITATION LIST

Patent Literature

PTL 1: Japanese Patent Application Laid-Open No. 2011-128213

SUMMARY OF INVENTION

Technical Problem

As a result of research by the present inventors, however, it was found out that in the method of producing an electrophotographic photosensitive member disclosed in PTL 1 in which the emulsion is prepared, the emulsion is uniformly emulsified immediately after the preparation of the emulsion, but the liquid properties of the emulsion are reduced after the emulsion is left as it is for a long time.

The reason for this is thought as follows: the organic solution prepared by dissolving the substance included in a charge transporting layer in the organic solvent coalesces in water as the time has passes; this coalescence makes it difficult to form a stable state of oil droplets, leading to aggregation or sediment. Then, further improvement is desired from the viewpoint of reducing the amount of the organic solvent to be used and ensuring the stability of the coating solution for a charge transporting layer at the same time.

An object of the present invention is to provide a method of producing an electrophotographic photosensitive member in which the amount of an organic solvent to be used for a coating solution for a charge transporting layer is reduced, and the stability of the coating solution for a charge transporting layer after preservation for a long time is improved, enabling formation of a charge transporting layer having high uniformity.

Another object of the present invention is to provide a coating solution for a charge transporting layer having high stability after preservation for a long time.

Solution to Problem

The objects above are attained by the present invention below.

The present invention is a method of producing an electrophotographic photosensitive member which includes a support, and a charge transporting layer formed thereon, the method including: preparing a solution including: a charge transporting substance; and at least one compound selected from the group consisting of a fluorine-atom-containing polyacrylate, a fluorine-atom-containing polymethacrylate, a polycarbonate having a siloxane bond, a polyester having a siloxane bond, a polystyrene having a siloxane bond, a silicone oil, a polyolefin, an aliphatic acid, an aliphatic acid amide and an aliphatic acid ester; dispersing the solution in water to prepare an emulsion; forming a coat for the charge transporting layer by using the emulsion; and heating the coat to form the charge transporting layer.

Moreover, the present invention relates to an emulsion for a charge transporting layer in which a solution is dispersed in water, wherein the solution includes: a charge transporting substance; and at least one compound selected from the group consisting of a fluorine-atom-containing polyacrylate, a fluorine-atom-containing polymethacrylate, a polycarbonate having a siloxane bond, a polyester having a siloxane bond, a polystyrene having a siloxane bond, a silicone oil, a polyolefin, an aliphatic acid, an aliphatic acid amide and an aliphatic acid ester.

Advantageous Effects of Invention

The present invention can provide a method of producing an electrophotographic photosensitive member in which the stability of the coating solution for a charge transporting layer (emulsion) after preservation for a long time can be improved, enabling formation of a charge transporting layer having high uniformity. Moreover, the present invention can provide a coating solution for a charge transporting layer (emulsion) having high stability after preservation for a long time.

Further features of the present invention will become apparent from the following description of exemplary embodiments with reference to the attached drawings.

Further features of the present invention will become apparent from the following description of exemplary embodiments with reference to the attached drawings.

DESCRIPTION OF EMBODIMENTS

Figure 1A:
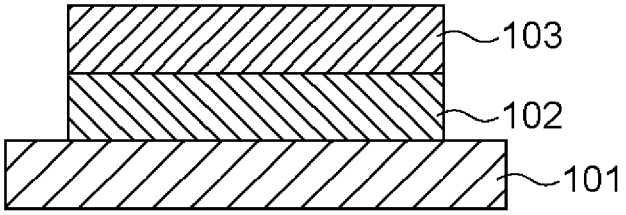
FIGS. 1A and 1B are drawings showing an example of a layer configuration in an electrophotographic photosensitive member according to the present invention.

As described above, the method of producing an electrophotographic photosensitive member according to the present invention includes: preparing a solution including: a charge transporting substance; and at least one compound selected from the group consisting of a fluorine-atom-containing polyacrylate, a fluorine-atom-containing polymethacrylate, a polycarbonate having a siloxane bond, a polyester having a siloxane bond, a polystyrene having a siloxane bond, a silicone oil, a polyolefin, an aliphatic acid, an aliphatic acid amide and an aliphatic acid ester; dispersing the solution in water to prepare an emulsion; forming a coat for the charge transporting layer by using the emulsion; and heating the coat to form the charge transporting layer.

The present inventors think the reason why the method of producing an electrophotographic photosensitive member according to the present invention can improve the stability of the emulsion (coating solution for a charge transporting layer) after preservation for a long time, enabling formation of a charge transporting layer having high uniformity as follows.

In the present invention, in preparation of the solution containing the charge transporting substance, a solution further containing a compound that provides an effect of reducing surface energy (fluorine-atom-containing polyacrylate, fluorine-atom-containing polymethacrylate, polycarbonate having a siloxane bond, polyester having a siloxane bond, polystyrene having a siloxane bond, silicone oil, polyolefin, aliphatic acid, aliphatic acid amide, aliphatic acid ester) is prepared. By preparing an emulsion including the solution and water, the emulsion never aggregates (coalesces) even if the emulsion is preserved for a long time. It is thought that this provides the effect of the present invention.

As the techniques described in PTL 1, a period for which the dispersion state of the emulsion is kept can be extended by containing a large amount of a surfactant, but the oil droplet state (emulsion) may be difficult to keep. Then, it is thought that in the present invention, by addition of the compound that provides an effect of reducing surface energy above, the surface energy of the oil droplets in the emulsion is reduced to reduce an aggregation (coalescence) force of the oil droplets, and thereby, aggregation (coalescence) of the oil droplets is suppressed. For this reason, aggregation of the emulsion is suppressed even after the emulsion is preserved for a long time, and stability of the emulsion is enhanced. Moreover, because aggregation of the emulsion caused by preservation for a long time is suppressed, use of even the emulsion after preservation for a long time allows formation of a charge transporting layer having high uniformity.

Hereinafter, the materials that form the electrophotographic photosensitive member produced by the production method above will be described.

The electrophotographic photosensitive member produced by the production method above is an electrophotographic photosensitive member including a support, and a charge transporting layer formed thereon. The electrophotographic photosensitive member can be a laminate type (function separate type) photosensitive layer in which a charge generating layer containing a charge generating substance and a charge transporting layer containing a charge transporting substance are separately provided. The laminate type photosensitive layer may be a normal layer type photosensitive layer in which the charge generating layer and the charge transporting layer are laminated in this order from the side of the support, or may be an inverted layer type photosensitive layer in which the charge transporting layer and the charge generating layer are laminated in this order from the side of the support. From the viewpoint of electrophotographic properties, the normal layer type photosensitive layer can be used.

Figure 1B:
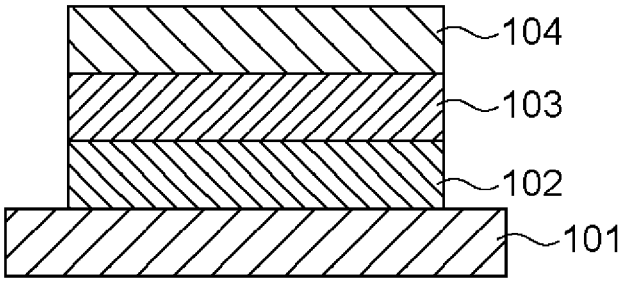

FIGS. 1A and 1B are drawings showing an example of a layer configuration of the electrophotographic photosensitive member according to the present invention. In FIGS. 1A and 1B, a support 101, a charge generating layer 102, a charge transporting layer 103, and a protective layer 104 (second charge transporting layer) are shown. When necessary, an undercoat layer may be provided between the support 101 and the charge generating layer 102.

The charge transporting substance is a substance having a hole transporting ability. Examples of the charge transporting substance include triarylamine compounds or hydrazone compounds. Among these, use of the triarylamine compounds can be used from the viewpoint of improving the electrophotographic properties.

The specific examples of the charge transporting substance are shown below:

CTM-1

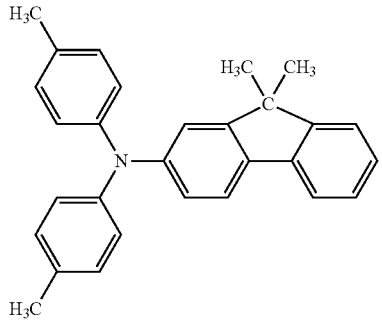

-continued

CTM-2

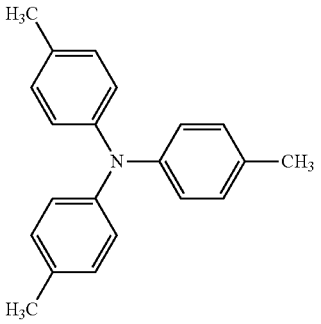

CTM-3

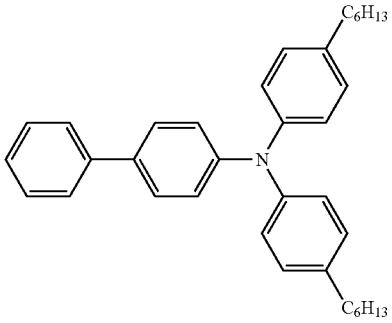

CTM-4

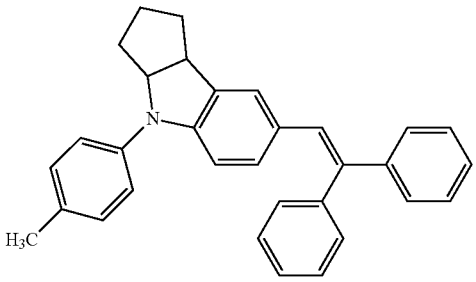

CTM-5

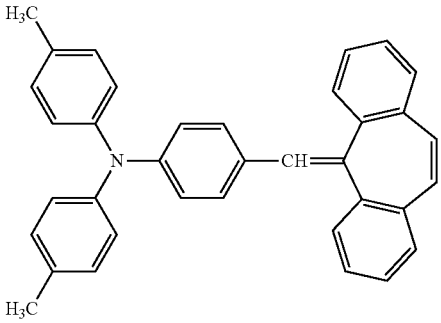

CTM-6

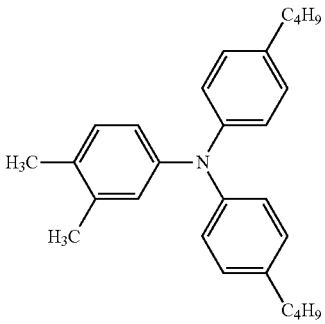

-continued

CTM-7

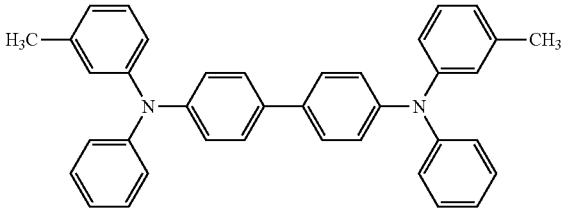

CTM-8

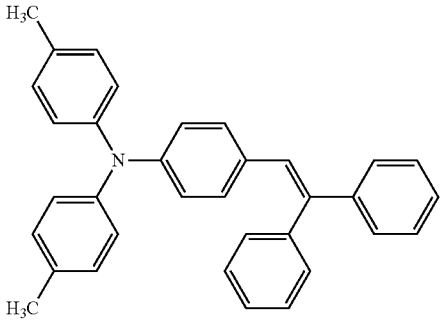

CTM-9

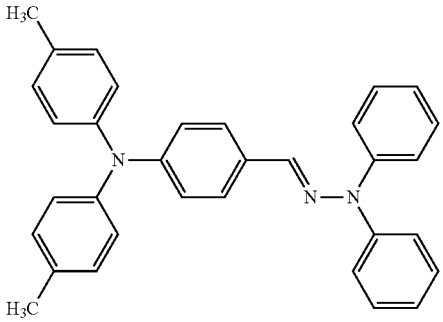

The charge transporting substance may be used alone or in combination.

As a material that forms the charge transporting layer, a binder resin may be contained.

Examples of the binder resin used for the charge transporting layer include styrene resins, acrylic resins, polycarbonate resins and polyester resins. Among these, polycarbonate resins or polyester resins can be used. Further, polycarbonate resins having a repeating structural unit represented by the following formula (B1) or polyester resins having a repeating structural unit represented by the following formula (B2) can be used.

(B1)

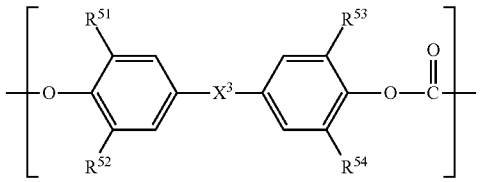

where $R^{51}$ to $R^{54}$ each independently represent a hydrogen atom or a methyl group; $X^3$ represents a single bond, a methylene group, an ethylidene group, a propylidene group, a phenylethylidene group, a cyclohexylidene group or an oxygen atom.

(B2)

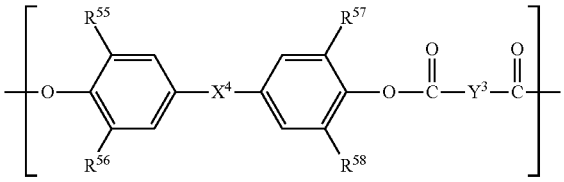

where $R^{55}$ to $R^{58}$ each independently represent a hydrogen atom or a methyl group; $X^4$ represents a single bond, a methylene group, an ethylidene group, a propylidene group, a cyclohexylidene group or an oxygen atom; $Y^3$ represents an m-phenylene group, a p-phenylene group or a divalent group having two p-phenylene groups bonded with an oxygen atom.

Specific examples of the repeating structural unit represented by the formula (B1) are shown below:

(B1-1)

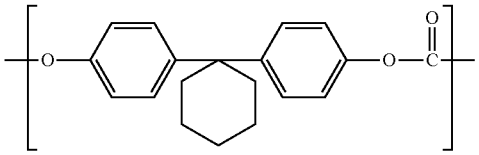

(B1-2)

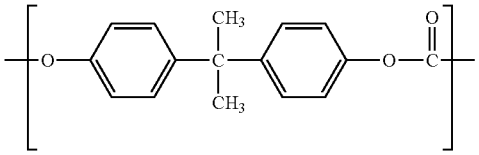

(B1-3)

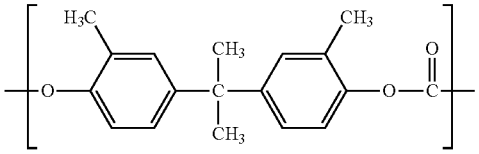

-continued (B1-4)

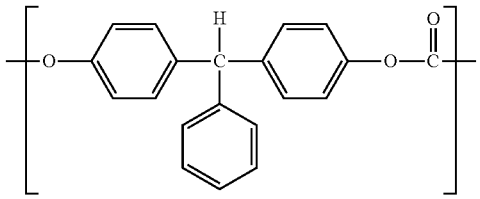

(B1-5)

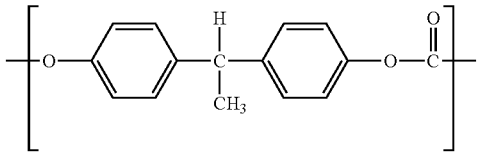

(B1-6)

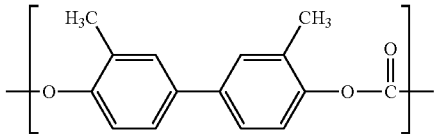

(B1-7)

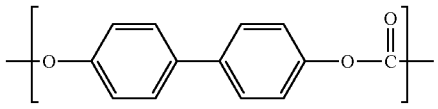

(B1-8)

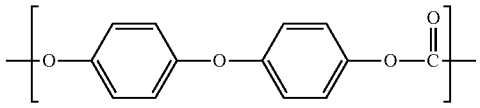

Specific examples of the repeating structural unit represented by the formula (B2) are shown below:

(B2-1)

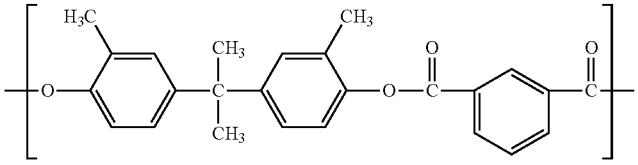

(B2-2)

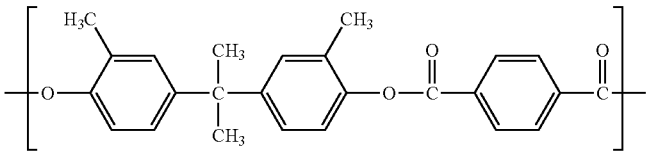

-continued (B2-3)

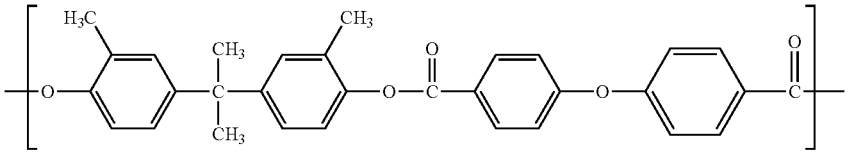

(B2-4)

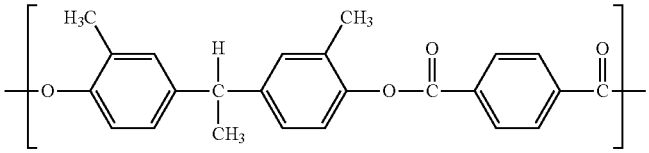

(B2-5)

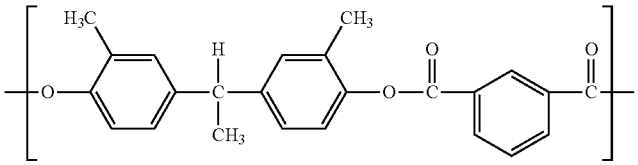

(B2-6)

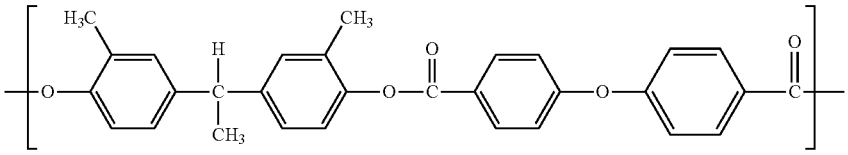

These polycarbonate resins and polyester resins can be used alone, or can be used in combination by mixing or as a copolymer. The form of the copolymerization may be any form of block copolymerization, random copolymerization and alternating copolymerization. The polycarbonate resins and polyester resins above can have no siloxane bond because the effect of the present invention is obtained stably.

The weight average molecular weight of the binder resin is a weight average molecular weight in terms of polystyrene measured according to the standard method, specifically according to the method described in Japanese Patent Application Laid-Open No. 2007-079555.

In the present invention, examples of the fluorine-atom-containing polyacrylate and the fluorine-atom-containing polymethacrylate include a compound having a repeating structural unit represented by the following formula (1):

(1)

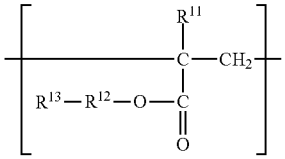

where $R^{11}$ represents hydrogen or a methyl group; $R^{12}$ represents an alkylene group, and can be an alkylene group having 1 to 4 carbon atoms; $R^{13}$ represents a perfluoroalkyl group having 4 to 6 carbon atoms.

Hereinafter, specific examples of the repeating structural unit represented by the formula (1) are shown:

(1-1)

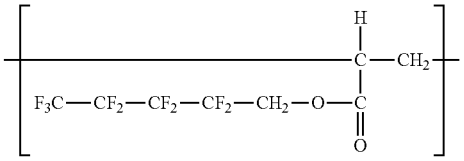

(1-2)

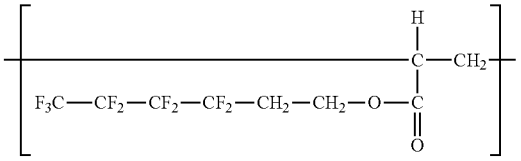

(1-3)

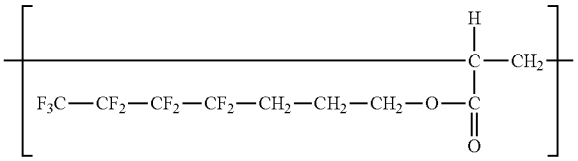

(1-4)

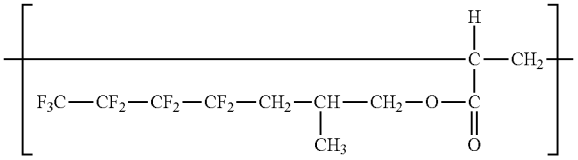

-continued (1-5)

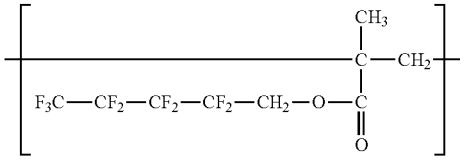

(1-6)

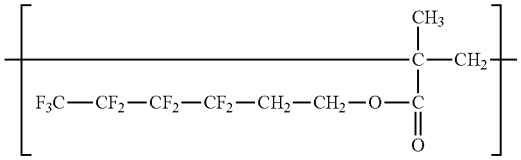

(1-7)

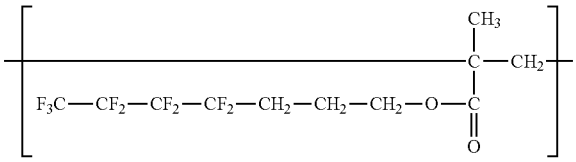

(1-8)

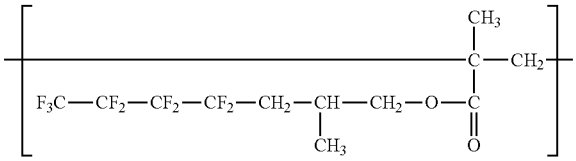

(1-9)

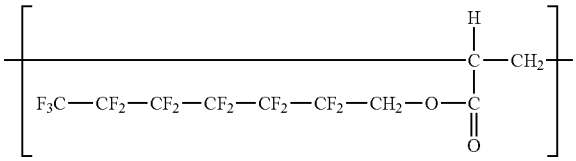

(1-10)

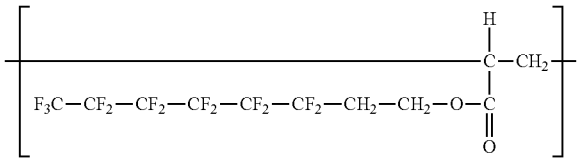

(1-11)

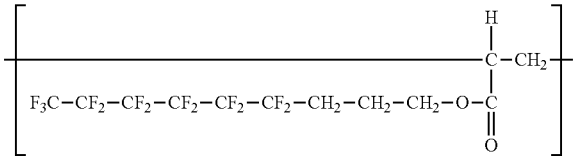

-continued (1-12)

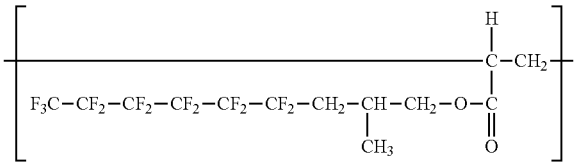

(1-13)

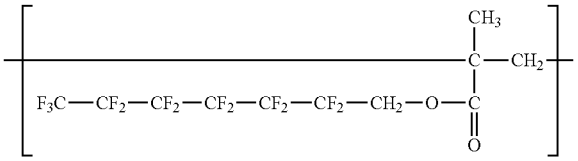

(1-14)

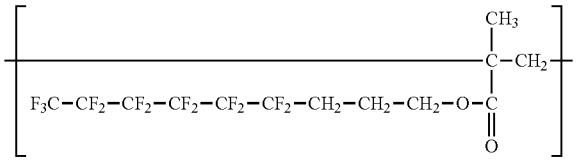

The fluorine-atom-containing polyacrylates and fluorine-atom-containing polymethacrylates can be used alone, or can be used in combination by mixing or a copolymer. The form of copolymerization may be any form of block copolymerization, random copolymerization and alternating copolymerization.

In the emulsion according to the present invention, the content of the fluorine-atom-containing polyacrylate and the fluorine-atom-containing polymethacrylate can be not less than 0.1% by mass and not more than 1% by mass based on the total mass of the charge transporting substance and the binder resin. At a content within this range, the effect of stabilizing the emulsion by use of the fluorine-atom-containing polyacrylate and the fluorine-atom-containing polymethacrylate can be sufficiently obtained, and the effect of sufficient electrophotographic properties can be obtained.

Examples of the polycarbonate having a siloxane bond include polycarbonate A having a repeating structural unit represented by the following formula (2-1) and a repeating structural unit represented by the following formula (2-3), or polycarbonate B having a repeating structural unit represented by the following formula (2-2) and repeating structural unit represented by the following formula (2-3):

(2-1)

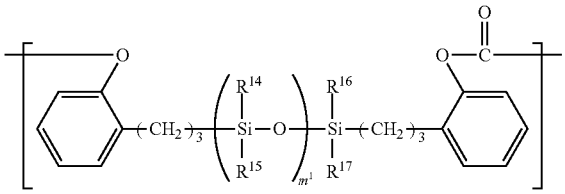

-continued (2-2)

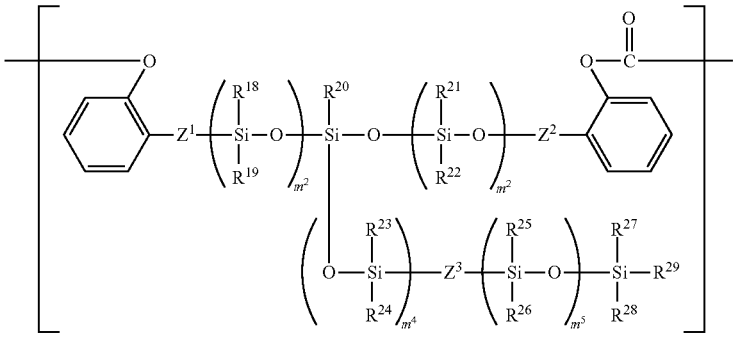

(2-3)

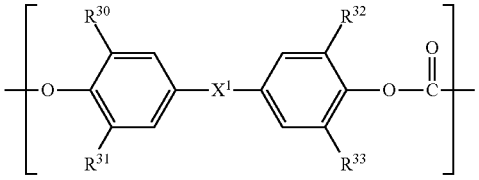

In the formula (2-1), $R^{14}$ to $R^{17}$ each independently represent a methyl group or a phenyl group; $m^1$ represents the number of repetition of the structure enclosed in brackets, and the average of $m^1$ in the polycarbonate A ranges from 20 to 100. Further, the number of repetition of the structure enclosed in brackets $m^1$ is preferably within the range of ±10% of the value indicated by the average of the number of repetition of $m^1$ because the effect of the present invention is obtained stably.

In the formula (2-2), $R^{18}$ to $R^{29}$ each independently represent a methyl group or a phenyl group; $m^2$, $m^3$, $m^4$, and $m^5$ each independently represent the number of repetition of the structure enclosed in brackets, and the average of $m^2+m^3+m^4+m^5$ in the polycarbonate B ranges from 0 to 450; $Z^1$ and $Z^2$ each independently represent an ethylene group or a propylene group; $Z^3$ represents a single bond, an oxygen atom, an ethylene group or a propylene group. Further, the sum of the numbers of repetition of the structure enclosed in brackets $m^2+m^3+m^4+m^5$ is preferably within the range of ±10% of the value indicated by the average of the number of repetition of $m^2+m^3+m^4+m^5$ because the effect of the present invention is obtained stably.

In the formula (2-3), $X^1$ represents a single bond, a methylene group, an ethylidene group, a propylidene group, a phenylethylidene group, a cyclohexylidene group or an oxygen atom; $R^{30}$ to $R^{33}$ each independently represent a hydrogen atom or a methyl group.

Hereinafter, specific examples of the repeating structural unit represented by the formula (2-1) are shown. In Table 1, the average of $m^1$ represents the average of $m^1$ in the polycarbonate A.

TABLE 1

| Repeating structural unit represented by formula (2-1) | $R^{14}$ | $R^{15}$ | $R^{16}$ | $R^{17}$ | Average of $m^1$ |
|---|---|---|---|---|---|
| Repeating structural unit example (2-1-1) | Methyl group | Methyl group | Methyl group | Methyl group | 20 |

TABLE 1-continued

| Repeating structural unit represented by formula (2-1) | $R^{14}$ | $R^{15}$ | $R^{16}$ | $R^{17}$ | Average of $m^1$ |
|---|---|---|---|---|---|
| Repeating structural unit example (2-1-2) | Methyl group | Methyl group | Methyl group | Methyl group | 40 |
| Repeating structural unit example (2-1-3) | Methyl group | Methyl group | Methyl group | Methyl group | 60 |
| Repeating structural unit example (2-1-4) | Methyl group | Methyl group | Methyl group | Methyl group | 100 |
| Repeating structural unit example (2-1-5) | Methyl group | Methyl group | Phenyl group | Methyl group | 40 |
| Repeating structural unit example (2-1-6) | Phenyl group | Methyl group | Methyl group | Methyl group | 40 |
| Repeating structural unit example (2-1-7) | Phenyl group | Methyl group | Phenyl group | Methyl group | 40 |

Hereinafter, specific examples of the repeating structural unit represented by the formula (2-2) are shown. In Table 2, the sum of $m^2$, $m^3$, $m^4$, and $m^5$ represents the average of $m^2+m^3+m^4+m^5$ in the polycarbonate B.

TABLE 2

| Repeating structural unit represented by formula (2-2) | $R^{18}$-$R^{29}$ | $Z^1$ | $Z^2$ | $Z^3$ | $m^2$ | $m^3$ | $m^4$ | $m^5$ |
|---|---|---|---|---|---|---|---|---|
| Repeating structural unit example (2-2-1) | $R^{20}$,$R^{27}$-$R^{29}$: Methyl group | Propylene group | Propylene group | Ethylene group | 0 | 0 | 0 | 0 |
| Repeating structural unit example (2-2-2) | $R^{18}$-$R^{29}$: Methyl group | Propylene group | Propylene group | Ethylene group | 1 | 1 | 1 | 100 |
| Repeating structural unit example (2-2-3) | $R^{18}$-$R^{29}$: Methyl group | Ethylene group | Ethylene group | Ethylene group | 1 | 1 | 1 | 200 |
| Repeating structural unit example (2-2-4) | $R^{18}$-$R^{29}$: Methyl group | Propylene group | Propylene group | Ethylene group | 1 | 1 | 1 | 400 |
| Repeating structural unit example (2-2-5) | $R^{18}$-$R^{29}$: Methyl group | Propylene group | Propylene group | Ethylene group | 20 | 20 | 20 | 20 |
| Repeating structural unit example (2-2-6) | $R^{18}$-$R^{29}$: Methyl group | Ethylene group | Ethylene group | Ethylene group | 100 | 100 | 50 | 200 |
| Repeating structural unit example (2-2-7) | $R^{18}$-$R^{29}$: Methyl group | Propylene group | Propylene group | Ethylene group | 150 | 150 | 50 | 100 |
| Repeating structural unit example (2-2-8) | $R^{19}$,$R^{20}$,$R^{22}$,$R^{23}$, $R^{25}$,$R^{27}$-$R^{29}$: Methyl group; $R^{18}$,$R^{21}$,$R^{24}$,$R^{26}$: Phenylene group | Propylene group | Propylene group | Ethylene group | 20 | 20 | 20 | 20 |
| Repeating structural unit example (2-2-9) | $R^{20}$,$R^{27}$-$R^{29}$: Methyl group; $R^{25}$,$R^{26}$: Phenylene group | Propylene group | Propylene group | Ethylene group | 0 | 0 | 0 | 100 |
| Repeating structural unit example (2-2-10) | $R^{18}$-$R^{24}$,$R^{27}$-$R^{29}$: Methyl group | Propylene group | Propylene group | Single bond | 20 | 20 | 100 | 0 |
| Repeating structural unit example (2-2-11) | $R^{18}$-$R^{24}$,$R^{27}$-$R^{29}$: Methyl group | Propylene group | Propylene group | Single bond | 100 | 100 | 100 | 0 |
| Repeating structural unit example (2-2-12) | $R^{18}$-$R^{29}$: Methyl group | Propylene group | Propylene group | Propylene group | 100 | 100 | 100 | 100 |
| Repeating structural unit example (2-2-13) | $R^{18}$-$R^{29}$: Methyl group | Propylene group | Propylene group | Propylene group | 20 | 20 | 20 | 20 |
| Repeating structural unit example (2-2-14) | $R^{18}$-$R^{24}$,$R^{27}$-$R^{29}$: Methyl group | Ethylene group | Ethylene group | Single bond | 20 | 20 | 100 | 0 |
| Repeating structural unit example (2-2-15) | $R^{18}$-$R^{24}$,$R^{27}$-$R^{29}$: Methyl group | Ethylene group | Ethylene group | Single bond | 150 | 150 | 150 | 0 |
| Repeating structural unit example (2-2-16) | $R^{18}$-$R^{29}$: Methyl group | Ethylene group | Ethylene group | Ethylene group | 20 | 20 | 20 | 20 |

Specific examples of the repeating structural unit represented by the formula (2-3) include the repeating structural units represented by the formulas (B1-1) to (B1-8). The present invention is not limited to these.

In the polycarbonate having a siloxane bond, the polycarbonate A and the polycarbonate B can have a terminal structure represented by the following formula (2-4) in one terminal or both terminals. In the case where the polycarbonate A and the polycarbonate B have the terminal structure represented by the formula (2-4) in one terminal, a molecular weight adjuster (terminal terminator) is used to terminate the other terminal. Examples of the molecular weight adjuster include phenol, para-cumylphenol, para-tert-butylphenol, and benzoic acid. Among these, phenol and para-tert-butylphenol can be used. In this case, the other terminal structure is a terminal structure represented by the following formula (2-5) or the following formula (2-6):

(2-4)

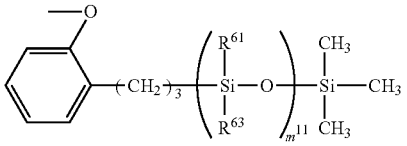

(2-5)

—OH

-continued (2-6)

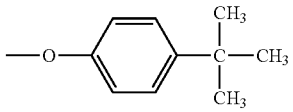

In the formula (2-4), $m^{11}$ represents the number of repetition enclosed in brackets; the average of $m^{11}$ in the polycarbonate A or the polycarbonate B ranges from 20 to 100; $R^{61}$ and $R^{62}$ each independently represent a methyl group or a phenyl group.

Hereinafter, specific examples of the terminal structure represented by the formula (2-4) are shown:

(2-4-1)

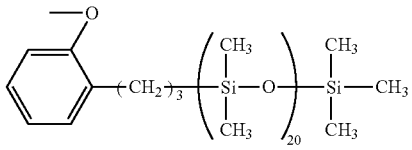

(2-4-2)

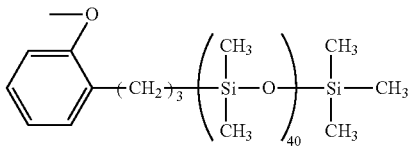

-continued (2-4-3)

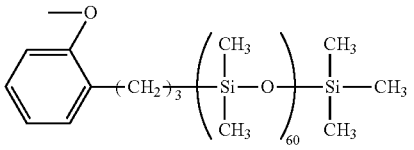

(2-4-4)

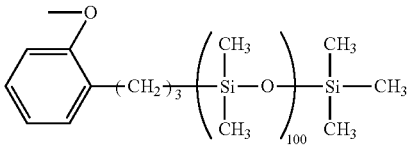

The polycarbonates having a siloxane bond can be used alone, or can be used in combination by mixing.

The content of the polycarbonate having a siloxane bond in the emulsion can be not less than 0.1% by mass and not more than 5% by mass based on the total mass of the charge transporting substance and the binder resin. At a content within this range, the effect of stability of the emulsion by used of the polycarbonate having a siloxane bond can be sufficiently obtained, and the effect of sufficient electrophotographic properties can be obtained.

Examples of the polyester having a siloxane bond include polyester C having a repeating structural unit represented by the following formula (3-1) and a repeating structural unit represented by the following formula (3-2):

(3-1)

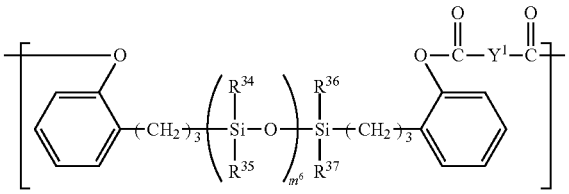

-continued (3-2)

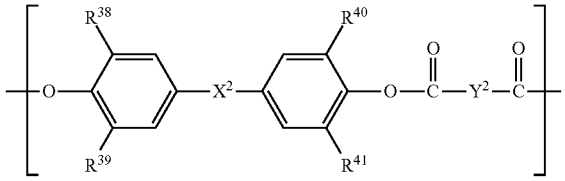

In the formula (3-1), $R^{34}$ to $R^{37}$ each independently represent a methyl group or a phenyl group; $Y^1$ represents a meta-phenylene group, a para-phenylene group, or a bivalent group having two para-phenylene groups bonded with an oxygen atom; $m^6$ represents the number of repetition of the structure enclosed in brackets, and the average of $m^6$ in the polyester C ranges from 20 to 100.

In the formula (3-2), $R^{38}$ to $R^{41}$ each independently represent a hydrogen atom or a methyl group; $X^2$ represents a single bond, a methylene group, an ethylidene group, a propylidene group, a cyclohexylidene group or an oxygen atom; $Y^2$ represents a meta-phenylene group, a para-phenylene group or a bivalent group having two para-phenylene groups bonded with an oxygen atom.

Hereinafter, specific examples of the repeating structural unit represented by the formula (3-1) are shown. In Table 3, the average of $m^6$ represents the average of $m^6$ in the polyester C.

TABLE 3

| Repeating structural unit represented by formula (3-1) | $R^{34}$ | $R^{35}$ | $R^{36}$ | $R^{37}$ | Average of $m^6$ | $Y^1$ |
|---|---|---|---|---|---|---|
| Repeating structural unit example (3-1-1) | Methyl group | Methyl group | Methyl group | Methyl group | 20 | p-Phenylene group |
| Repeating structural unit example (3-1-2) | Methyl group | Methyl group | Methyl group | Methyl group | 40 | p-Phenylene group |
| Repeating structural unit example (3-1-3) | Methyl group | Methyl group | Methyl group | Methyl group | 60 | p-Phenylene group |
| Repeating structural unit example (3-1-4) | Methyl group | Methyl group | Methyl group | Methyl group | 100 | p-Phenylene group |
| Repeating structural unit example (3-1-5) | Methyl group | Methyl group | Phenyl group | Methyl group | 40 | p-Phenylene group |
| Repeating structural unit example (3-1-6) | Phenyl group | Methyl group | Methyl group | Methyl group | 40 | p-Phenylene group |
| Repeating structural unit example (3-1-7) | Phenyl group | Methyl group | Phenyl group | Methyl group | 40 | p-Phenylene group |
| Repeating structural unit example (3-1-8) | Methyl group | Methyl group | Methyl group | Methyl group | 20 | m-Phenylene group |
| Repeating structural unit example (3-1-9) | Methyl group | Methyl group | Methyl group | Methyl group | 40 | m-Phenylene group |
| Repeating structural unit example (3-1-10) | Methyl group | Methyl group | Methyl group | Methyl group | 60 | m-Phenylene group |
| Repeating structural unit example (3-1-11) | Methyl group | Methyl group | Methyl group | Methyl group | 100 | m-Phenylene group |
| Repeating structural unit example (3-1-12) | Methyl group | Methyl group | Phenyl group | Methyl group | 40 | m-Phenylene group |

TABLE 3-continued

| Repeating structural unit represented by formula (3-1) | $R^{34}$ | $R^{35}$ | $R^{36}$ | $R^{37}$ | Average of $m^6$ | $Y^1$ |
|---|---|---|---|---|---|---|
| Repeating structural unit example (3-1-13) | Phenyl group | Methyl group | Methyl group | Methyl group | 40 | m-Phenylene group |
| Repeating structural unit example (3-1-14) | Phenyl group | Methyl group | Phenyl group | Methyl group | 40 | m-Phenylene group |
| Repeating structural unit example (3-1-15) | Methyl group | Methyl group | Methyl group | Methyl group | 20 | 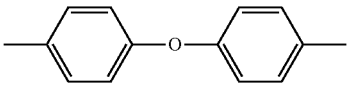 |
| Repeating structural unit example (3-1-16) | Methyl group | Methyl group | Methyl group | Methyl group | 40 | 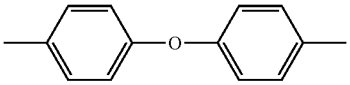 |
| Repeating structural unit example (3-1-17) | Methyl group | Methyl group | Methyl group | Methyl group | 60 | 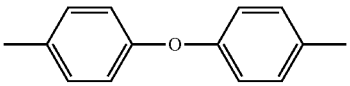 |
| Repeating structural unit example (3-1-18) | Methyl group | Methyl group | Methyl group | Methyl group | 100 | 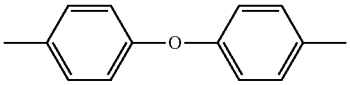 |
| Repeating structural unit example (3-1-19) | Methyl group | Methyl group | Phenyl group | Methyl group | 40 | 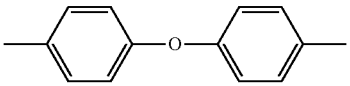 |
| Repeating structural unit example (3-1-20) | Phenyl group | Methyl group | Methyl group | Methyl group | 40 | 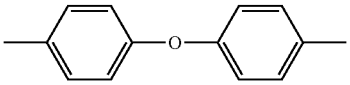 |
| Repeating structural unit example (3-1-21) | Phenyl group | Methyl group | Phenyl group | Methyl group | 40 | 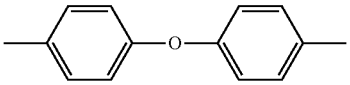 |

Specific examples of the repeating structural unit represented by the formula (3-2) include repeating structural units represented by the formulas (B2-1) to (B2-6).

In the polyester having a siloxane bond, the polyester C may have a terminal structure represented by the formula (3-3) in one terminal or both terminals. In the case where the polyester C has the terminal structure represented by the formula (3-3) in one terminal, a molecular weight adjuster (terminal terminator) is used to terminate the other terminal. Examples of the molecular weight adjuster include phenol, para-cumylphenol, para-tert-butylphenol, and benzoic acid. Among these, phenol and para-tert-butylphenol can be used. In this case, the other terminal structure is a terminal structure represented by the following formula (3-5) or the following formula (3-6):

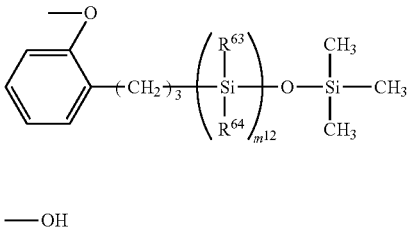

(3-3)

(3-4)

-continued

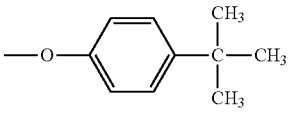

(3-5)

In the formula (3-3), $m^{12}$ represents the number of repetition enclosed in brackets; the average of $m^{12}$ in the polyester C ranges from 20 to 100; $R^{63}$ and $R^{64}$ each independently represent a methyl group or a phenyl group.

Hereinafter, specific examples of the terminal structure represented by the formula (3-3) are shown:

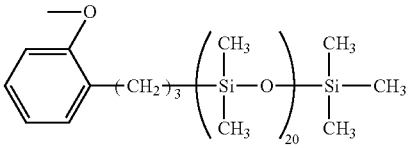

(3-3-1)

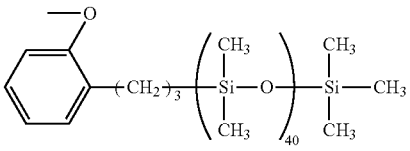

(3-3-2)

-continued (3-3-3)

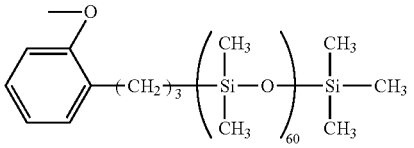

(3-3-4)

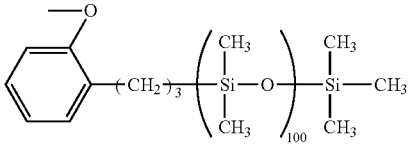

The polyesters having a siloxane bond can be used alone or in combination by mixing.

The content of the polyester having a siloxane bond in the emulsion can be not less than 0.01% by mass and not more than 5% by mass based on the total mass of the charge transporting substance and the binder resin. At a content within this range, the effect of stability of the emulsion by use of the polyester having a siloxane bond can be sufficiently obtained, and the effect of sufficient electrophotographic properties can be obtained.

Examples of the polystyrene having a siloxane bond include a polystyrene D having a repeating structural unit represented by the following formula (4-1) and a repeating structural unit represented by the following formula (4-2):

(4-1)

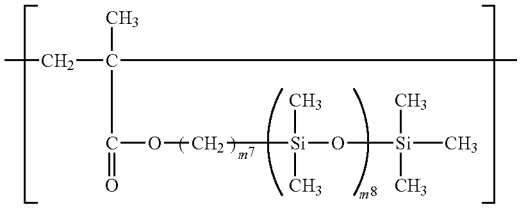

(4-2)

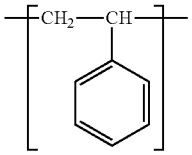

where $m^7$ represents an integer selected from 1 to 10; $m^8$ represents an integer selected from 20 to 100.

Hereinafter, specific examples of the formula (4-1) are shown.

TABLE 4

| Repeating structural unit represented by formula (4-1) | $m^7$ | $m^8$ |
|---|---|---|
| Repeating structural unit example (4-1-1) | 1 | 20 |
| Repeating structural unit example (4-1-2) | 3 | 20 |
| Repeating structural unit example (4-1-3) | 3 | 40 |
| Repeating structural unit example (4-1-4) | 1 | 60 |

TABLE 4-continued

| Repeating structural unit represented by formula (4-1) | $m^7$ | $m^8$ |
|---|---|---|
| Repeating structural unit example (4-1-5) | 3 | 100 |

The polystyrenes having a siloxane bond can be used alone or in combination by mixing.

The content of the polystyrene having a siloxane bond in the emulsion can be not less than 0.5% by mass and not more than 10% by mass based on the total mass of the charge transporting substance and the binder resin. At a content within this range, the effect of stability of the emulsion by used of the polystyrene having a siloxane bond can be sufficiently obtained, and the effect of sufficient electrophotographic properties can be obtained.

Examples of the silicone oil include a compound represented by the following formula (5):

(5)

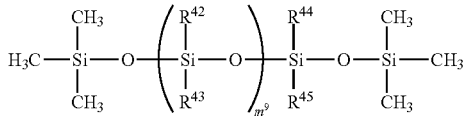

where $R^{42}$ to $R^{45}$ each independently represent a methyl group or a phenyl group; $m^9$ represents an integer selected from 20 to 100.

Hereinafter, specific examples of the silicone oil are shown:

(5-1)

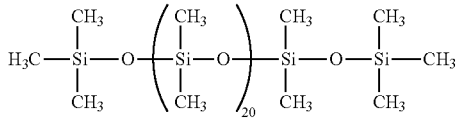

(5-2)

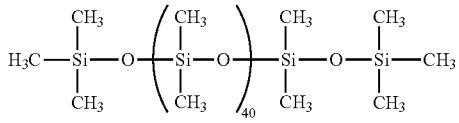

(5-3)

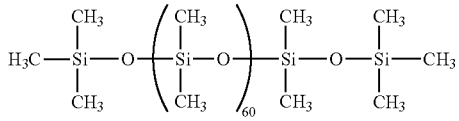

(5-4)

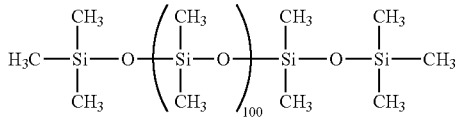

(5-5)

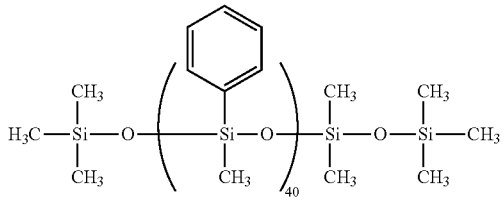

-continued (5-6)

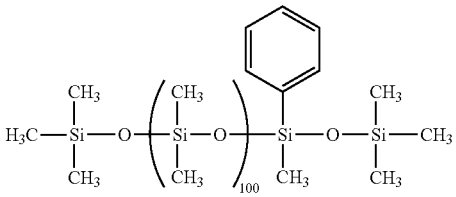

(5-7)

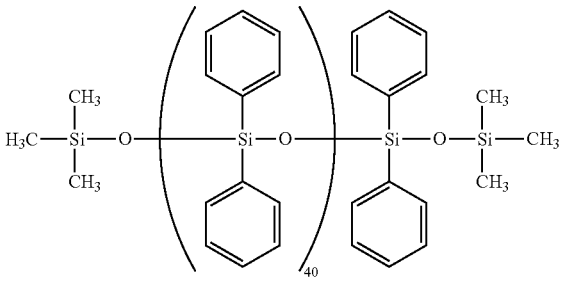

The silicone oils can be used alone or in combination by mixing.

The content of the silicone oil in the emulsion can be not less than 0.5% by mass and not more than 10% by mass based on the total mass of the charge transporting substance and the binder resin. At a content within this range, the effect of stability of the emulsion by use of the silicone oil can be sufficiently obtained, and the effect of sufficient electrophotographic properties can be obtained.

Examples of the polyolefin include aliphatic hydrocarbons.

Hereinafter, specific examples of the polyolefin are shown:

$H_3C-(CH_2)_8CH_3$ (6-1)

$H_3C-(CH_2)_{10}CH_3$ (6-2)

$H_3C-(CH_2)_{14}CH_3$ (6-3)

$H_3C-(CH_2)_{16}CH_3$ (6-4)

$H_3C-(CH_2)_{22}CH_3$ (6-5)

$H_3C-(CH_2)_{30}CH_3$ (6-6)

$H_3C-(CH_2)_{38}CH_3$ (6-7)

The polyolefins can be used alone or in combination by mixing.

The content of the polyolefin in the emulsion can be not less than 1% by mass and not more than 10% by mass based on the total mass of the charge transporting substance and the binder resin. At a content within this range, the effect of stability of the emulsion by use of the polyolefin can be sufficiently obtained, and the effect of sufficient electrophotographic properties can be obtained.

Examples of the aliphatic acid, aliphatic acid amide, and aliphatic acid ester include a compound having a repeating structure represented by the following formula (7-1):

(7-1)

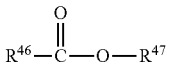

where $R^{46}$ represents an alkyl group having 10 to 40 carbon atoms; $R^{47}$ represents a hydrogen atom, an amino group and an alkyl group having 10 to 40 carbon atoms.

Hereinafter, specific examples of the aliphatic acid are shown:

(7-1-1)

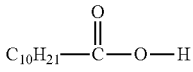

(7-1-2)

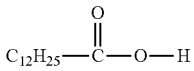

(7-1-3)

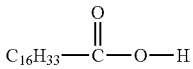

(7-1-4)

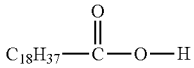

(7-1-5)

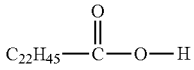

(7-1-6)

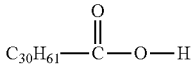

(7-1-7)

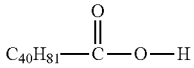

Hereinafter, specific examples of the aliphatic acid amide are shown:

(7-1-8)

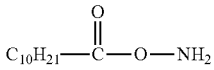

(7-1-9)

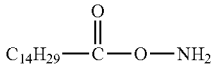

(7-1-10)

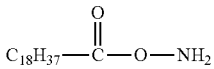

(7-1-11)

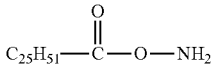

(7-1-12)

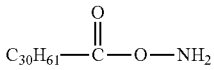

(7-1-13)

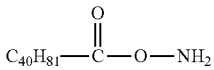

Hereinafter, specific examples of the aliphatic acid ester are shown, but not limited to these:

(7-1-14)

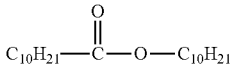

-continued (7-1-15)

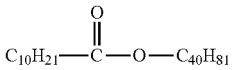

(7-1-16)

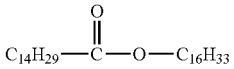

(7-1-17)

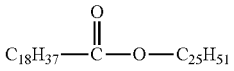

(7-1-18)

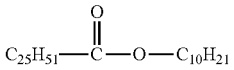

(7-1-19)

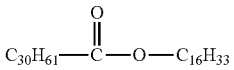

(7-1-20)

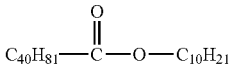

(7-1-21)

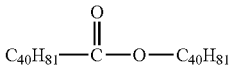

The aliphatic acids, aliphatic acid amides, and aliphatic acid esters can be used alone or in combination by mixing.

The content of the aliphatic acid, aliphatic acid amide, and aliphatic acid ester in the emulsion can be not less than 1% by mass and not more than 10% by mass based on the total mass of the charge transporting substance and the binder resin. At a content within this range, the effect of stability of the emulsion by use of the aliphatic acid, aliphatic acid amide, and aliphatic acid ester can be sufficiently obtained, and the effect of sufficient electrophotographic properties can be obtained.

The fluorine-atom-containing polyacrylate and fluorine-atom-containing polymethacrylate, the polycarbonate having a siloxane bond, the polyester having a siloxane bond, the polystyrene having a siloxane bond, the silicone oil, the polyolefin, the aliphatic acid, aliphatic acid amide, and aliphatic acid ester can be used in combination by mixing.

A solvent used to prepare the solution containing the charge transporting substance and the compound that reduces the surface energy is those that dissolve the charge transporting substance. A liquid (hydrophobic solvent) whose solubility in water is 1.0% by mass or less at 25° C. and 1 atmosphere (atmospheric pressure) can be used.

Hereinafter, representative examples of the hydrophobic solvent are shown in table 5. The water solubility in table 5 means solubility in water at 25° C. and 1 atmospheric pressure (atmospheric pressure) which is indicated by % by mass.

TABLE 5

Representative examples of hydrophobic solvent

| No | Name | Water solubility |
|---|---|---|
| (E-1) | Toluene | 0.1% by mass |
| (E-2) | Chloroform | 0.8% by mass |
| (E-3) | o-Dichlorobenzene | 0.0% by mass |
| (E-4) | Chlorobenzene | 0.1% by mass |
| (E-5) | o-Xylene | 0.0% by mass |

TABLE 5-continued

Representative examples of hydrophobic solvent

| No | Name | Water solubility |
|---|---|---|
| (E-6) | Ethylbenzene | 0.0% by mass |
| (E-7) | Phenetole | 0.1% by mass |

Among these hydrophobic solvents, solvents having an aromatic ring structure are preferable, and at least one selected from the group consisting of toluene and xylene is more preferable from the viewpoint of stabilizing the emulsion. These hydrophobic solvents can be used in combination by mixing.

In the solution containing the charge transporting substance and the compound that reduces the surface energy, a hydrophilic solvent which is a solvent having solubility in water at 1 atmospheric pressure (atmospheric pressure) of 5.0% by mass or more can be mixed and used in addition of the hydrophobic solvent above.

Hereinafter, representative examples of the hydrophilic solvent are shown in Table 6. The water solubility in Table 6 means solubility in water at 25° C. and 1 atmospheric pressure (atmospheric pressure) which is indicated by % by mass.

TABLE 6

Representative examples of hydrophilic solvent

| No | Name | Water solubility |
|---|---|---|
| F-1 | Tetrahydrofuran | 100.0% by mass or more |
| F-2 | Dimethoxymethane | 32.3% by mass |
| F-3 | 1,2-Dioxane | 100.0% by mass or more |
| F-4 | 1,3-Dioxane | 100.0% by mass or more |
| F-5 | 1,4-Dioxane | 100.0% by mass or more |
| F-6 | 1,3,5-Trioxane | 21.1% by mass |
| F-7 | Methanol | 100.0% by mass or more |
| F-8 | 2-Pentanone | 5.9% by mass |
| F-9 | Ethanol | 100.0% by mass or more |
| F-10 | Tetrahydropyran | 100.0% by mass or more |
| F-11 | Diethylene glycol dimethyl ether | 100.0% by mass or more |
| F-12 | Ethylene glycol dimethyl ether | 100.0% by mass or more |
| F-13 | Propylene glycol n-butyl ether | 6.0% by mass |
| F-14 | Propylene glycol monopropyl ether | 100.0% by mass or more |
| F-15 | Ethylene glycol monomethyl ether | 100.0% by mass or more |
| F-16 | Diethylene glycol monoethyl ether | 100.0% by mass or more |
| F-17 | Ethylene glycol monoisopropyl ether | 100.0% by mass or more |
| F-18 | Ethylene glycol monobutyl ether | 100.0% by mass or more |
| F-19 | Ethylene glycol monoisobutyl ether | 100.0% by mass or more |
| F-20 | Ethylene glycol monoallyl ether | 100.0% by mass or more |
| F-21 | PROPYLENE GLYCOL MONOMETHYL ETHER | 100.0% by mass or more |
| F-22 | Dipropylene glycol monomethyl ether | 100.0% by mass or more |
| F-23 | Tripropylene glycol monomethyl ether | 100.0% by mass or more |
| F-24 | Propylene glycol monobutyl ether | 6.4% by mass |
| F-25 | Propylene glycol | 20.5% by mass |
| F-26 | Diethylene glycol methyl ethyl ether | 100.0% by mass or more |

TABLE 6-continued

Representative examples of hydrophilic solvent

| No | Name | Water solubility |
|---|---|---|
| F-27 | Diethylene glycol diethyl ether | 100.0% by mass or more |
| F-28 | Dipropylene glycol dimethyl ether | 37.0% by mass |
| F-29 | Propylene glycol diacetate | 7.4% by mass |
| F-30 | Methyl acetate | 19.6% by mass |
| F-31 | Ethyl acetate | 8.3% by mass |
| F-32 | n-Propyl alcohol | 100.0% by mass or more |
| F-33 | 3-Methoxy butanol | 100.0% by mass or more |
| F-34 | 3-Methoxybutyl acetate | 6.5% by mass |
| F-35 | Ethylene glycol monomethyl ether acetate | 100.0% by mass or more |

Among these hydrophilic solvents, ether solvents are preferable, and at least one selected from the group consisting of tetrahydrofuran and dimethoxymethane is more preferable from the viewpoint of stabilizing the emulsion.

These hydrophilic solvents can be used in combination by mixing. Particularly, in the case where a coat of the emulsion is formed on the support by dip coating in the step of forming the coat of the emulsion on the support, use of a hydrophilic solvent having a relatively low boiling point of 100° C. or less is preferable. This is more preferable from the viewpoint of uniformity of the coat because the solvent is quickly removed in the heating and drying step.

Next, a method of preparing the emulsion by dispersing the solution prepared by the method above in water will be described.

As an emulsifying method for preparing an emulsion, existing emulsifying methods can be used. The emulsion contains at least the charge transporting substance, the compound that reduces the surface energy, and the binder resin in the emulsion particles in the state where the charge transporting substance, the compound that reduces the surface energy, and the binder resin are partially or entirely dissolved in the emulsion particles. Hereinafter, as specific emulsifying methods, a stirring method and a high pressure collision method will be shown, but the production method according to the present invention will not be limited to these.

The stirring method will be described. In this method, the charge transporting substance, the compound that reduces the surface energy, and the binder resin are dissolved in the solvent (hydrophobic solvent, hydrophilic solvent) to prepare a solution. The solution is mixed with water, and stirred by a stirrer. Here, from the viewpoint of the electrophotographic properties, water can be ion exchange water from which metal ions and the like are removed with an ion exchange resin or the like. The ion exchange water can have a conductivity of 5 μS/cm or less. As the stirrer, a stirrer enabling high speed stirring can be used because a uniform emulsion can be prepared in a short time. Examples of the stirrer include a homogenizer (Physcotron) made by MICROTEC CO., LTD. and a circulation homogenizer (Cleamix) made by M Technique Co., Ltd.

The high pressure collision method will be described. In this method, the charge transporting substance, the compound that reduces the surface energy, and the binder resin are dissolved in the solvent (hydrophobic solvent, hydrophilic solvent) to prepare a solution. The solution is mixed with water, and the mixed solution is collided under high pressure. Thus, an emulsion can be prepared. Alternatively, without mixing the solution with water, the solution may be collided with water as individual solutions to prepare an emulsion. Examples of a high pressure colliding apparatus include a Microfluidizer M-110EH made by Microfluidics Corporation in U.S. and a Nanomizer YSNM-2000AR made by YOSHIDA KIKAI CO., LTD.

As the mixing ratio of water to the solution containing the charge transporting substance, the compound that reduces the surface energy, and the binder resin in the emulsion, water/solution is 3/7 to 8/2, and can be 5/5 to 7/3 from the viewpoint of obtaining an emulsion having a high concentration of the solid content while stability of the emulsion is kept.

The ratio of water to the solvent (hydrophobic solvent, hydrophilic solvent) can be 4/6 to 8/2 (water has a higher proportion) from the viewpoint of reducing the size of the oil droplet in emulsifying and stabilizing the emulsion. The ratio above can be adjusted in the range in which the charge transporting substance and the binder resin are dissolved in an organic solvent. Thus, the size of the oil droplet is reduced to enhance solution stability.

In the oil droplets in the emulsion, the proportion of the charge transporting substance, the compound that reduces the surface energy, and the binder resin to the solvent can be 10 to 50% by mass. The proportion of the charge transporting substance to the binder resin to be contained in the solution is preferably in the range of 4:10 to 20:10 (mass ratio), and more preferably in the range of 5:10 to 12:10 (mass ratio).

Moreover, the emulsion may contain a surfactant for the purpose of further stabilizing the emulsion. As the surfactant, a nonionic surfactant (nonionic surfactant) can be used from the viewpoint of suppressing reduction in the electrophotographic properties. The nonionic surfactant has a hydrophilic portion which is a non-electrolyte, that is, not ionized. Examples of the nonionic surfactant include:

NAROACTY Series, EMULMIN Series, SANNONIC Series, and NEWPOL Series made by Sanyo Chemical Industries, Ltd., EMULGEN Series, RHEODOL Series, and EMANON Series made by Kao Corporation, Adekatol Series, ADEKA ESTOL Series, and ADEKA NOL Series made by ADEKA Corporation, and nonionic surfactant Series among Newcol Series made by NIPPON NYUKAZAI CO., LTD.

Surfactants above can be used alone or in combination. The surfactant having an HLB value (Hydrophile-Lipophile Balance value) in the range of 8 to 15 can be selected for stabilization of the emulsion.

The amount of the surfactant to be added is preferably as small as possible from the viewpoint of preventing reduction in the electrophotographic properties. The content of the surfactant in the emulsion is preferably in the range of 0% by mass to 1.5% by mass, and more preferably in the range of 0% by mass to 0.5% by mass based on the total mass of the charge transporting substance and the binder resin. The surfactant may be contained in water, or may be contained in the solution containing the charge transporting substance the compound that reduces the surface energy, and the binder resin. Alternatively, the surfactant may be contained in both water and the solution.

Moreover, the emulsion may contain an antifoaming agent, a viscoelastic adjuster and the like in the range in which the effect of the present invention is not inhibited.

The average particle diameter of the emulsion particle in the emulsion is preferably in the range of 0.1 to 20.0 μm, and more preferably in the range of 0.1 to 5.0 μm from the viewpoint of stability of the emulsion.

Next, a method of applying the coat of the emulsion onto a support will be described.

As a step of forming the coat of the emulsion on the support, any of existing coating methods such as a dip coating method, a ring coating method, a spray coating method, a spinner coating method, a roller coating method, a Meyer bar coating method, and a blade coating method can be used. From the viewpoint of productivity, the dip coating can be used. According to the dip coating method, the emulsion can be applied onto a support to form a coat.

Next, a step of heating the coat to form a charge transporting layer will be described. The formed coat is heated to form a charge transporting layer.

The coat of the emulsion may be formed on the charge generating layer. Alternatively, the coat of the emulsion may be formed on an undercoat layer, and the charge generating layer may be formed on the coat. Further, in the case where the charge transporting layer has a laminate structure (first charge transporting layer, second charge transporting layer), the coat of the emulsion may be formed on the first charge transporting layer to form the second charge transporting layer. Alternatively, using the coat of the emulsion, both of the first charge transporting layer and the second charge transporting layer may be formed.

In the present invention, the emulsion containing at least the charge transporting substance, the compound that reduces the surface energy, and the binder resin is applied to form the coat. For this reason, by heating the coat, the dispersion medium (water) can be removed and the emulsion particles can be brought into close contact with each other at the same time. Thereby, a more uniform coat can be formed. Thereby, a coat having high uniformity can be formed. Further, if the emulsion particle has a smaller particle diameter, a film thickness having high uniformity can be quickly obtained after the dispersion medium is removed. Accordingly, a smaller particle diameter of the emulsion particle is preferable. A heating temperature can be 100° C. or more. Further, from the viewpoint of enhancing close contact of the emulsion particles, the heating temperature can be a heating temperature of the melting point or more of the charge transporting substance having the lowest melting point among the charge transporting substances that form the charge transporting layer. By heating at a temperature of the melting point or more of the charge transporting substance, the charge transporting substance is fused. The binder resin is dissolved in the fused charge transporting substance. Thereby, a highly uniform coat can be formed. Further, heating can be performed at a heating temperature 5° C. or more higher than the melting point of the charge transporting substance having the lowest melting point among the charge transporting substances that form the charge transporting layer. Moreover, the heating temperature can be 200° C. or less. Occurrence of modification or the like of the charge transporting substance can be suppressed, obtaining sufficient electrophotographic properties.

The film thickness of the charge transporting layer produced by the production method according to the present invention is preferably not less than 3 μm and not more than 50 μm, and more preferably not less than 5 μm and not more than 35 μm.

Next, the configuration of the electrophotographic photosensitive member produced by the production method of the electrophotographic photosensitive member according to the present invention above will be described.

A cylindrical electrophotographic photosensitive member formed of a cylindrical support and a photosensitive layer (charge generating layer, charge transporting layer) formed thereon is usually widely used, but the electrophotographic photosensitive member can have a belt-like shape or a sheet-like shape, for example.

As the support, those having conductivity (electrically conductive support) can be used. A metallic conductive support made of aluminum, an aluminum alloy, stainless steel, or the like can be used. In the case of the aluminum or aluminum alloy conductive support, an ED tube, an EI tube, or those subjected to machining, electrochemical mechanical polishing, a wet or dry honing treatment can also be used. Moreover, a metallic conductive support or a resin conductive support having a layer of a coat formed by vacuum depositing aluminum, an aluminum alloy or an indium oxide-tin oxide alloy can also be used. Moreover, a conductive support formed by impregnating conductive particles such as carbon black, tin oxide particles, titanium oxide particles, and silver particles into a resin, or a plastic having a conductive resin can also be used.

The surface of the support may be subjected to a machining treatment, a surface roughening treatment, an anodic oxidation treatment, or the like.

An electrically conductive layer may be provided between the support and an undercoat layer or charge generating layer described later. The electrically conductive layer can be obtained by forming a coat on the support using a coating solution for an electrically conductive layer in which conductive particles are dispersed in a resin, and drying the coat. Examples of the conductive particles include carbon black, acetylene black, metal powders of aluminum, nickel, iron, nichrome, copper, zinc, and silver, and metal oxide powders of conductive tin oxide and ITO.

Examples of the resin include polyester resins, polycarbonate resins, polyvinyl butyral, acrylic resins, silicone resins, epoxy resins, melamine resins, urethane resins, phenol resins and alkyd resins.

Examples of a solvent used in the coating solution for an electrically conductive layer include ether solvents, alcohol solvents, ketone solvents and aromatic hydrocarbon solvents.

The film thickness of the electrically conductive layer is preferably not less than 0.2 μm and not more than 40 μm, more preferably not less than 1 μm and not more than 35 μm, and still more preferably not less than 5 μm and not more than 30 μm.

An undercoat layer may be provided between the support or electrically conductive layer and the charge generating layer.

The undercoat layer can be formed by forming a coat on the support or electrically conductive layer using a coating solution for an undercoat layer having a resin, and drying or curing the coat.

Examples of the resin for the undercoat layer include polyacrylic acids, methyl cellulose, ethyl cellulose, polyamide resins, polyimide resins, polyamidimide resins, polyamic acid resins, melamine resins, epoxy resins, polyurethane resins, and polyolefin resins. As the resin used for the undercoat layer, thermoplastic resins can be used. Specifically, thermoplastic polyamide resins or polyolefin resins can be used. As the polyamide resins, copolymerized nylons having low crystallinity or non-crystallinity and allowing application in a liquid state can be used. As the polyolefin resins, those in a state where those can be used as a particle dispersion liquid can be used. Further, polyolefin resins can be dispersed in an aqueous medium.

The film thickness of the undercoat layer is preferably not less than 0.05 μm and not more than 30 μm, and more preferably not less than 1 μm and not more than 25 μm. Moreover, the undercoat layer may contain a metal-oxide particle.

Moreover, the undercoat layer may contain a semi-conductive particle, an electron transporting substance, or an electron receiving substance.

A charge generating layer can be provided on the support, the electrically conductive layer or the undercoat layer.

Examples of the charge generating substance used in the electrophotographic photosensitive member include azo pigments, phthalocyanine pigments, indigo pigments and perylene pigments. These charge generating substances may be used alone or in combination. Among these, particularly metal phthalocyanines such as oxytitanium phthalocyanine, hydroxy gallium phthalocyanine, and chlorogallium phthalocyanine have high sensitivity and can be used.

Examples of a binder resin used in the charge generating layer include polycarbonate resins, polyester resins, butyral resins, polyvinylacetal resins, acrylic resins, vinyl acetate resins and urea resins. Among these, particularly butyral resins can be used. These can be used alone, or can be used in combination by mixing or as a copolymer.

The charge generating layer can be formed by forming a coat using a coating solution for a charge generating layer obtained by dispersing the charge generating substance together with a binder resin and a solvent, and heating the coat. Alternatively, the charge generating layer may be a deposited film of the charge generating substance.

Examples of a dispersing method include methods using a homogenizer, ultrasonic waves, a ball mill, a sand mill, an Attritor, and a roll mill.

The proportion of the charge generating substance to the binder resin is preferably in the range of 1:10 to 10:1 (mass ratio), and particularly more preferably in the range of 1:1 to 3:1 (mass ratio).

Examples of the solvent used in the coating solution for a charge generating layer include alcohol solvents, sulfoxide solvents, ketone solvents, ether solvents, ester solvents or aromatic hydrocarbon solvents.

The film thickness of the charge generating layer is preferably not less than 0.01 μm and not more than 5 μm, and more preferably not less than 0.1 μm and not more than 2 μm.

Moreover, a variety of a sensitizer, an antioxidant, an ultraviolet absorbing agent, a plasticizer and the like can also be added to the charge generating layer when necessary. In order to prevent stagnation of a flow of charges in the charge generating layer, an electron transporting substance or electron receiving substance may be contained in the charge generating layer.

The charge transporting layer is provided on the charge generating layer.

The charge transporting layer is produced by the production method above.

Deterioration preventing materials such as an antioxidant, an ultraviolet absorbing agent, and a light stabilizer, and fine particles such as organic fine particles and inorganic fine particles may be added to each of the layers in the electrophotographic photosensitive member. Examples of the antioxidant include hindered phenol antioxidants, hindered amine light stabilizers, sulfur atom-containing antioxidants, and phosphorus atom-containing antioxidants. Examples of the organic fine particles include molecule resin particles such as fluorine atom-containing resin particles, polystyrene fine particles, and polyethylene resin particles. Examples of the inorganic fine particles include metal oxides such as silica and alumina.

In application of the coating solutions for the respective layers above, coating methods such as a dip coating method, a spray coating method, a spinner coating method, a roller coating method, a Meyer bar coating method, and a blade coating method can be used.

Moreover, a shape of depressions and projections (a shape of depressions, a shape of projections) may be formed on the surface of the charge transporting layer which is a surface layer in the electrophotographic photosensitive member. As a method of forming a shape of depressions and projections, a known method can be used. Examples of the forming method include a method for forming a shape of depressions by spraying polished particles to the surface, a method for forming a shape of depressions and projections by bringing a mold having a shape of depressions and projections into contact with the surface under pressure, and a method for forming a shape of depressions by irradiating the surface with laser light. Among these, a method can be used in which a mold having a shape of depressions and projections is brought into contact with the surface of the surface layer of the electrophotographic photosensitive member under pressure to form a shape of depressions and projections.

Figure 2:
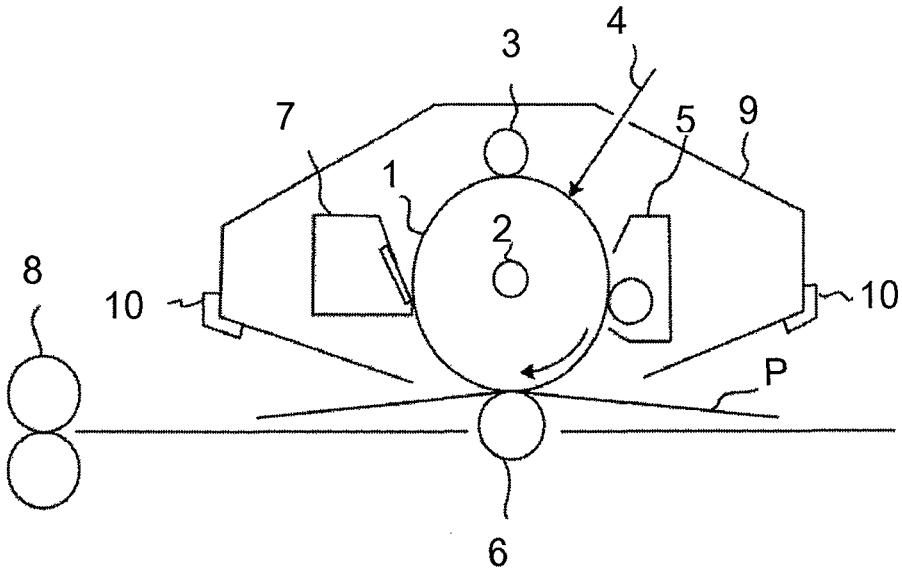
FIG. 2 is a drawing showing an example of a schematic configuration of an electrophotographic apparatus including a process cartridge having the electrophotographic photosensitive member according to the present invention.

FIG. 2 shows an example of a schematic configuration of an electrophotographic apparatus including a process cartridge having the electrophotographic photosensitive member according to the present invention.

In FIG. 2, a cylindrical electrophotographic photosensitive member 1 is shown. The electrophotographic photosensitive member 1 is rotated and driven around a shaft 2 in the arrow direction at a predetermined circumferential speed. The surface of the electrophotographic photosensitive member 1 rotated and driven is uniformly charged at a positive or negative potential by a charging unit (primary charging unit: charging roller or the like) 3. Next, the surface of the electrophotographic photosensitive member 1 receives expositing light (image expositing light) 4 output from an exposing unit (not shown) such as slit exposure and laser beam scanning exposure. Thus, an electrostatic latent image corresponding to a target image is sequentially formed on the surface of the electrophotographic photosensitive member 1.

The electrostatic latent image formed on the surface of the electrophotographic photosensitive member 1 is developed with a toner included in a developer in a developing unit 5 to form a toner image. Next, the toner image carried on the surface of the electrophotographic photosensitive member 1 is sequentially transferred onto a transfer material (such as paper) P by a transfer bias from a transferring unit (transfer roller or the like) 6. The transfer material P is extracted from a transfer material feeding unit (not shown) and fed to a region between the electrophotographic photosensitive member 1 and the transferring unit 6 (contact region) in synchronization with the rotation of the electrophotographic photosensitive member 1.

The transfer material P to which the toner image is transferred is separated from the surface of the electrophotographic photosensitive member 1, and introduced to a fixing unit 8 to fix the image. Thereby, the transfer material P is printed out to the outside the apparatus as an image forming product (print, copy).

The surface of the electrophotographic photosensitive member 1 after transfer of the toner image is cleaned by removing a transfer remaining developer (toner) by a cleaning unit (cleaning blade or the like) 7. Next, the surface of the electrophotographic photosensitive member 1 is discharged by a pre-expositing light (not shown) from a pre-exposing unit (not shown), and repeatedly used for formation of an image. As shown in FIG. 2, in the case where the charging unit 3 is a contact charging unit using a charging roller, pre-exposure is not always necessary.

Among the components such as the electrophotographic photosensitive member 1, the charging unit 3, the developing unit 5, the transferring unit 6 and the cleaning unit 7, a plurality of the components may be accommodated in a container and integrally formed into a process cartridge, and the process cartridge may be formed attachably to and detachably from the main body of the electrophotographic apparatus such as a copier and a laser beam printer. In FIG. 2, the electrophotographic photosensitive member 1, the charging unit 3, the developing unit 5 and the cleaning unit 7 are integrally supported and formed as a cartridge, and the cartridge is formed as a process cartridge 9 attachably to and detachably from the main body of the electrophotographic apparatus using a guiding unit 10 such as a rail in the main body of the electrophotographic apparatus.

EXAMPLES

Hereinafter, the present invention will be described more in detail using Examples and Comparative Examples. The present invention will not be limited by Examples below. In Examples, "parts" mean "parts by mass."

Example 1

(Preparation of Emulsion)

5 parts of the compound represented by the formula (CTM-1) and 5 parts of the compound represented by the formula (CTM-7) as the charge transporting substance, and 10 parts of a polycarbonate resin having a repeating structural unit represented by the formula (B1-1) (weight average molecular weight Mw=57,000), and 0.1 parts of the compound represented by the formula (1-2) as the binder resin were dissolved in 60 parts of toluene to prepare a solution. Next, while 120 parts of ion exchange water (conductivity of 0.2 μS/cm) was stirred by a homogenizer (Physcotron) made by MICROTEC CO., LTD. at a rate of 3,000 turns/min, 80.1 parts of the solution was gradually added for 10 minutes. After dropping was completed, the number of rotation of the homogenizer was raised to 7,000 turns/min and stirring was performed for 20 minutes. Then, the obtained solution was emulsified by a high pressure collision dispersing machine Nanomizer (made by YOSHIDA KIKAI CO., LTD.) on a pressure condition of 150 MPa to obtain an emulsion (80.1 parts).

(Evaluation of Solution Stability of Emulsion)

After the emulsion was prepared according to the method above, the emulsion was visually evaluated and the particle diameter of the emulsion particle was evaluated. Further, the prepared emulsion was left as it was for 2 weeks (under an environment of the temperature of 25° C. and the humidity of 50% RH). After the state of the emulsion after leaving was observed, the emulsion was stirred at a rate of 1,000 turns/min for 3 minutes using a homogenizer made by MICROTEC CO., LTD. The state of the emulsion after stirring was visually observed in the same manner. The average particle diameters of the emulsion particle in the emulsion before and after leaving the emulsion as it was and stirring it were measured. In the measurement of the average particle diameter of the emulsion particle, the emulsion was diluted with water, and the average particle diameter was measured using an ultracentrifugal automatic particle size distribution analyzer (CAPA700) made by HORIBA, Ltd. The results are shown in Table 14. The states of the emulsion obtained in Example 1 before and after leaving were not greatly changed even by visually observation. The average particle diameter hardly changed, and the emulsion was kept stably. The results of evaluation are shown in Table 7.

Examples 2 to 296

Emulsions were prepared by the same method as that in Example 1 except that the kinds and ratios of the charge transporting substance, the compound that reduced the surface energy, the binder resin, and the solvent were changed as shown in Table 7 to Table 13. The results of evaluation of solution stability of the obtained emulsions are shown in Tables 14 to 15. In Examples 5, 15, 45, 58, 105, 118, 144, 155, 173, 185, 202, 215, 236, and 242, 0.5% by mass of a surfactant (trade name: NAROACTY CL-85, made by Sanyo Chemical Industries, Ltd., HLB=12.6) was further contained based on the total mass of the charge transporting substance and the binder resin.

Example 297

An emulsion was prepared by the same method as that in Example 3 except that in Example 3, the fluorine-containing acrylate used in Example 6 and the silicone oil used in Example 173 were mixed and used. The results of evaluation of solution stability of the obtained emulsion are shown in Table 15.

Examples 298 to 300

Emulsions were prepared by the same method as that in Example 297 except that in Example 297, the fluorine-containing acrylate used in Example 6 was replaced by the compound shown below. The results of evaluation of solution stability of the obtained emulsions are shown in Table 15. In Example 298, the fluorine-containing acrylate used in Example 6 was replaced by the polycarbonate A used in Example 36. In Example 299, the fluorine-containing acrylate used in Example 6 was replaced by the polyester C used in Example 98. In Example 300, the fluorine-containing acrylate used in Example 6 was replaced by the polystyrene D used in Example 139.

Example 701

An emulsion was prepared by the same method as that in Example 36 except that in Example 36, the hydrophobic solvent was replaced by (E-7). The solution stability of the obtained emulsion is shown in Table 15.

Comparative Example 1

An emulsion containing a charge transporting substance and a binder resin was prepared according to the method described in Japanese Patent Application Laid-Open No. 2011-128213 as follows.

5 parts of the compound represented by the formula (CTM-7) as the charge transporting substance, and 5 parts of a polycarbonate resin having a repeating structural unit represented by the formula (B1-1) (weight average molecular weight Mw=36,000) as the binder resin were dissolved in 40 parts of toluene to prepare the solution (50 parts). Next, 1.5 parts of a surfactant (trade name: NAROACTY CL-70 made by Sanyo Chemical Industries, Ltd.) was added to 48.5 parts of water. While the water was stirred at a rate of 3,000 turns/min with a homogenizer made by MICROTEC CO., LTD., the solution was added, and stirred for 10 minutes. Further, the number of rotation of the homogenizer made by MICROTEC CO., LTD. was raised to 7,000 turns/min and stirring was performed for 20 minutes. Then, the obtained solution was emulsified on a pressure condition of 150 MPa using a high pressure collision dispersing machine Nanomizer (made by YOSHIDA KIKAI CO., LTD.) to obtain 100 parts of an emulsion. In the obtained emulsion, the states of the emulsion and the average particle diameters before leaving and after leaving and stirring with a homogenizer, were measured by the same method as that in Example 1. The results are shown in Table 16.

In the state after leaving of the emulsion obtained in Comparative Example 1, sediment of the oil droplet component was found, and the oil droplet component partially coalesced and aggregates were found on the bottom. Unlike the emulsion immediately after the emulsion was prepared, in the emulsion after stirring, aggregation of the oil droplet component was found, and the state of an emulsion having high uniformity could not be obtained.

Comparative Example 2

An emulsion was prepared by the same method as that in Comparative Example 1 except that in Comparative Example 1, a compound represented by the formula (CTM-3) was used as the charge transporting substance, and chlorobenzene was used as the solvent. The stability of the obtained emulsion for a charge transporting layer was evaluated by the same method as that in Comparative Example 1. The results are shown in Table 16.

Comparative Example 3

An emulsion was prepared by the same method as that in Comparative Example 1 except that in Comparative Example 1, 20 parts of chlorobenzene was replaced by 20 parts of chloroform as the solvent, and the surfactant was replaced by NAROACTY CL-85 made by Sanyo Chemical Industries, Ltd. The stability of the obtained emulsion was evaluated by the same method as that in Comparative Example 1. The results are shown in Table 16.

Comparative Example 4

An emulsion was prepared by the same method as that in Comparative Example 1 except that in Comparative Example 1, 20 parts of chlorobenzene was replaced by 20 parts of o-dichlorobenzene as the solvent, and the surfactant was replaced by EMULMIN 140 made by Sanyo Chemical Industries, Ltd. The stability of the obtained emulsion was evaluated by the same method as that in Comparative Example 1. The results are shown in Table 16.

Comparative Example 5

An emulsion was prepared by the same method as that in Comparative Example 1 except that in Comparative Example 1, zinc stearate was further contained. The stability of the obtained emulsion was evaluated by the same method as that in Comparative Example 1. The results are shown in Table 16.

Comparative Example 6

An emulsion was prepared by the same method as that in Comparative Example 1 except that in Comparative Example 1, zinc linolenate was further contained. The stability of the obtained emulsion was evaluated by the same method as that in Comparative Example 1. The results are shown in Table 16.

TABLE 7

| | Fluorine-atom-containing acrylate, fluorine-atom-containing methacrylate | | | Binder resin and ratio | | Kind and ratio of solvent | |
|---|---|---|---|---|---|---|---|
| Example | Repeating structural unit, ratio | Content (%) | Charge transporting substance and ratio | Repeating structural unit, ratio | Weight average molecular weight | Hydrophobic solvent/hydrophilic solvent, ratio | Water/solvent |
| 1 | (1-2) | 0.5% | CTM-1/CTM-7 = 5/5 | (B1-1) | 57000 | (E-1) | 6/4 |
| 2 | (1-3) | 0.5% | CTM-1/CTM-7 = 5/5 | (B1-1) | 57000 | (E-4)/(F-2) = 9/1 | 6/4 |
| 3 | (1-10) | 0.5% | CTM-1/CTM-7 = 5/5 | (B1-1) | 57000 | (E-1)/(F-1) = 9/1 | 6/4 |
| 4 | (1-11) | 0.5% | CTM-1/CTM-7 = 5/5 | (B1-1) | 57000 | (E-5) | 6/4 |
| 5 | (1-2)/(1-10) = 7/3 | 0.5% | CTM-1/CTM-7 = 5/5 | (B1-1) | 57000 | (E-1)/(F-1) = 9/1 | 6/4 |
| 6 | (1-2)/(1-10) = 5/5 | 0.5% | CTM-1/CTM-7 = 5/5 | (B1-1) | 57000 | (E-1)/(F-1) = 9/1 | 6/4 |
| 7 | (1-2)/(1-10) = 3/7 | 0.5% | CTM-1/CTM-7 = 5/5 | (B1-1) | 57000 | (E-1)/(F-1) = 9/1 | 6/4 |
| 8 | (1-2)/(1-10) = 5/5 | 0.5% | CTM-1 | (B1-1) | 57000 | (E-5) | 6/4 |
| 9 | (1-2)/(1-10) = 5/5 | 0.5% | CTM-1/CTM-7 = 7/3 | (B1-1) | 57000 | (E-5)/(F-2) = 9/1 | 6/4 |
| 10 | (1-2)/(1-10) = 5/5 | 0.5% | CTM-1/CTM-7 = 3/7 | (B1-1) | 57000 | (E-4)/(F-1) = 9/1 | 6/4 |
| 11 | (1-2)/(1-10) = 5/5 | 0.5% | CTM-7 | (B1-1) | 57000 | (E-4)/(F-2) = 9/1 | 6/4 |
| 12 | (1-2)/(1-10) = 5/5 | 0.5% | CTM-1/CTM-7 = 5/5 | (B1-1) | 14000 | (E-1)/(F-2) = 9/1 | 6/4 |
| 13 | (1-2)/(1-10) = 5/5 | 0.5% | CTM-1/CTM-7 = 5/5 | (B1-1) | 120000 | (E-1)/(F-1) = 9/1 | 6/4 |

TABLE 7-continued

| Example | Fluorine-atom-containing acrylate, fluorine-atom-containing methacrylate: Repeating structural unit, ratio | Content (%) | Charge transporting substance and ratio | Binder resin and ratio: Repeating structural unit, ratio | Weight average molecular weight | Kind and ratio of solvent: Hydrophobic solvent/hydrophilic solvent, ratio | Water/solvent |
|---|---|---|---|---|---|---|---|
| 14 | (1-2)/(1-10) = 5/5 | 0.5% | CTM-1/CTM-7 = 5/5 | (B1-2) | 55000 | (E-5) | 6/4 |
| 15 | (1-2)/(1-10) = 5/5 | 0.5% | CTM-1/CTM-7 = 5/5 | (B1-3) | 53000 | (E-4)/(F-1) = 9/1 | 6/4 |
| 16 | (1-2)/(1-10) = 5/5 | 0.5% | CTM-1/CTM-7 = 5/5 | (B1-2)/(B1-3) = 3/7 | 55000 | (E-5)/(F-1) = 9/1 | 6/4 |
| 17 | (1-2)/(1-10) = 5/5 | 0.5% | CTM-1/CTM-7 = 5/5 | (B1-2)/(B1-3) = 5/5 | 55000 | (E-1)/(F-1) = 9/1 | 6/4 |
| 18 | (1-2)/(1-10) = 5/5 | 0.5% | CTM-1/CTM-7 = 5/5 | (B1-2)/(B1-3) = 7/3 | 55000 | (E-4)/(F-2) = 9/1 | 6/4 |
| 19 | (1-2)/(1-10) = 5/5 | 0.5% | CTM-1/CTM-7 = 5/5 | (B2-1) | 120000 | (E-1) | 6/4 |
| 20 | (1-2)/(1-10) = 5/5 | 0.5% | CTM-1/CTM-7 = 5/5 | (B2-2) | 120000 | (E-5)/(F-2) = 9/1 | 6/4 |
| 21 | (1-2)/(1-10) = 5/5 | 0.5% | CTM-1/CTM-7 = 5/5 | (B2-1)/(B2-2) = 7/3 | 120000 | (E-1)/(F-2) = 9/1 | 6/4 |
| 22 | (1-2)/(1-10) = 5/5 | 0.5% | CTM-1/CTM-7 = 5/5 | (B1-1) | 57000 | (E-4) | 6/4 |
| 23 | (1-2)/(1-10) = 5/5 | 0.5% | CTM-1/CTM-7 = 5/5 | (B1-1) | 57000 | (E-1)/(F-1) = 9/1 | 6/4 |
| 24 | (1-2)/(1-10) = 5/5 | 0.5% | CTM-1/CTM-7 = 5/5 | (B1-1) | 57000 | (F-1) | 6/4 |
| 25 | (1-1)/(1-2) = 5/5 | 0.1% | CTM-2 | (B1-4) | 57000 | (E-2)/(F-1) = 9/1 | 6/4 |
| 26 | (1-4)/(1-5) = 5/5 | 1% | CTM-3 | (B1-6) | 57000 | (E-6)/(F-10) = 9/1 | 6/4 |
| 27 | (1-5)/(1-11) = 5/5 | 5% | CTM-4 | (B1-8) | 57000 | (E-3)/(F-21) = 9/1 | 6/4 |
| 28 | (1-6)/(1-3) = 5/5 | 0.3% | CTM-5 | (B1-5)/(B1-7) = 5/5 | 57000 | (E-2)/(F-32) = 9/1 | 6/4 |
| 29 | (1-7)/(1-1) = 5/5 | 0.5% | CTM-6 | (B2-3) | 57000 | (E-2)/(F-20) = 9/1 | 6/4 |
| 30 | (1-8)/(1-4) = 5/5 | 1% | CTM-8 | (B2-5) | 57000 | (E-6)/(F-11) = 9/1 | 6/4 |
| 31 | (1-9)/(1-7) = 5/5 | 1% | CTM-9 | (B2-6) | 57000 | (E-6)/(F-7) = 9/1 | 6/4 |
| 32 | (1-12)/(1-10) = 5/5 | 0.3% | CTM-1/CTM-5 = 7/3 | (B2-4)/(B2-6) = 5/5 | 57000 | (E-6)/(F-16) = 9/1 | 6/4 |
| 33 | (1-3)/(1-6) = 5/5 | 0.1% | CTM-1/CTM-5 = 5/5 | (B2-2)/(B2-4) = 5/5 | 57000 | (E-6)/(F-5) = 9/1 | 6/4 |
| 34 | (1-12)/(1-14) = 5/5 | 1% | CTM-1/CTM-5 = 3/7 | (B2-3)/(B2-5) = 5/5 | 57000 | (E-3)/(F-3) = 9/1 | 6/4 |

TABLE 8

| Example | Polycarbonate having siloxane bond: Repeating structural unit, ratio | Terminal structure | Content (%) | Charge transporting substance and ratio | Binder resin: Repeating structural unit, ratio | Weight average molecular weight | Kind and ratio of solvent: Hydrophobic solvent/hydrophilic solvent, ratio | Water/solvent |
|---|---|---|---|---|---|---|---|---|
| 35 | (2-1-1)/(B1-1) = 9/1 | — | 0.5% | CTM-1/CTM-7 = 5/5 | (B1-1) | 57000 | (E-4) | 6/4 |
| 36 | (2-1-2)/(B1-1) = 9/1 | — | 0.5% | CTM-1/CTM-7 = 5/5 | (B1-1) | 57000 | (E-1)/(F-1) = 9/1 | 6/4 |
| 37 | (2-1-2)/(B1-2) = 9/1 | — | 0.5% | CTM-1/CTM-7 = 5/5 | (B1-1) | 57000 | (E-5)/(F-1) = 9/1 | 6/4 |
| 38 | (2-1-2)/(B1-2) = 9/1 | — | 0.5% | CTM-1/CTM-7 = 5/5 | (B1-1) | 57000 | (E-4) | 6/4 |
| 39 | (2-1-2)/(2-1-6)/(B1-1) = 3.5/3.5/3 | — | 0.5% | CTM-1/CTM-7 = 5/5 | (B1-1) | 57000 | (E-1)/(F-1) = 9/1 | 6/4 |
| 40 | (2-1-2)/(2-1-6)/(B1-1) = 2.5/2.5/5 | — | 0.5% | CTM-1/CTM-7 = 5/5 | (B1-1) | 57000 | (E-1)/(F-1) = 9/1 | 6/4 |
| 41 | (2-1-2)/(2-1-6)/(B1-1) = 1.5/1.5/7 | — | 0.5% | CTM-1/CTM-7 = 5/5 | (B1-1) | 57000 | (E-1)/(F-1) = 9/1 | 6/4 |
| 42 | (2-1-3)/(B1-1) = 9/1 | — | 0.5% | CTM-1/CTM-7 = 5/5 | (B1-1) | 57000 | (E-5)/(F-2) = 9/1 | 6/4 |
| 43 | (2-1-4)/(B1-1) = 9/1 | — | 0.5% | CTM-1/CTM-7 = 5/5 | (B1-1) | 57000 | (E-5) | 6/4 |
| 44 | (2-1-5)/(B1-1) = 9/1 | — | 0.5% | CTM-1/CTM-7 = 5/5 | (B1-1) | 57000 | (E-1)/(F-1) = 9/1 | 6/4 |
| 45 | (2-1-6)/(B1-1) = 9/1 | — | 0.5% | CTM-1/CTM-7 = 5/5 | (B1-1) | 57000 | (E-4) | 6/4 |

TABLE 8-continued

| Example | Polycarbonate having siloxane bond: Repeating structural unit, ratio | Polycarbonate having siloxane bond: Terminal structure | Polycarbonate having siloxane bond: Content (%) | Charge transporting substance and ratio | Binder resin: Repeating structural unit, ratio | Binder resin: Weight average molecular weight | Kind and ratio of solvent: Hydrophobic solvent/hydrophilic solvent, ratio | Kind and ratio of solvent: Water/solvent |
|---|---|---|---|---|---|---|---|---|
| 46 | (2-1-7)/(B1-1) = 9/1 | — | 0.5% | CTM-1/CTM-7 = 5/5 | (B1-1) | 57000 | (E-4)/(F-1) = 9/1 | 6/4 |
| 47 | (2-2-1 )/(B1-1) = 7/3 | (2-4-2) | 0.5% | CTM-1/CTM-7 = 5/5 | (B1-1) | 57000 | (E-5) | 6/4 |
| 48 | (2-2-2)/(B1-1) = 5/5 | (2-4-2) | 0.5% | CTM-1/CTM-7 = 5/5 | (B1-1) | 57000 | (E-5)/(F-1) = 9/1 | 6/4 |
| 49 | (2-2-3)/(B1-1) = 8/2 | (2-4-2) · (2-5) | 0.5% | CTM-1/CTM-7 = 5/5 | (B1-1) | 57000 | (E-4)/(F-1) = 9/1 | 6/4 |
| 50 | (2-2-4)/(B1-1) = 7/3 | (2-4-2) | 0.5% | CTM-1/CTM-7 = 5/5 | (B1-1) | 57000 | (E-5) | 6/4 |
| 51 | (2-2-5)/(B1-1) = 7/3 | — | 0.5% | CTM-1/CTM-7 = 5/5 | (B1-1) | 57000 | (E-5)/(F-1) = 9/1 | 6/4 |
| 52 | (2-2-6)/(B1-1) = 7/3 | (2-4-2) | 0.5% | CTM-1/CTM-7 = 5/5 | (B1-1) | 57000 | (E-1)/(F-2) = 9/1 | 6/4 |
| 53 | (2-2-7)/(B1-1) = 8/2 | — | 0.5% | CTM-1/CTM-7 = 5/5 | (B1-1) | 57000 | (E-4)/(F-2) = 9/1 | 6/4 |
| 54 | (2-2-8)/(B1-1) = 8/2 | (2-4-2) | 0.5% | CTM-1/CTM-7 = 5/5 | (B1-1) | 57000 | (E-5) | 6/4 |
| 55 | (2-2-9)/(B1-1) = 5/5 | — | 0.5% | CTM-1/CTM-7 = 5/5 | (B1-1) | 57000 | (E-1)/(F-2) = 9/1 | 6/4 |
| 56 | (2-2-10)/(B1-1) = 6/4 | — | 0.5% | CTM-1/CTM-7 = 5/5 | (B1-1) | 57000 | (E-4) | 6/4 |
| 57 | (2-2-11)/(B1-1) = 8/2 | (2-4-2) | 0.5% | CTM-1/CTM-7 = 5/5 | (B1-1) | 57000 | (E-1) | 6/4 |
| 58 | (2-2-12)/(B1-1) = 7/3 | (2-4-2) · (2-6) | 0.5% | CTM-1/CTM-7 = 5/5 | (B1-1) | 57000 | (E-5)/(F-1) = 9/1 | 6/4 |
| 59 | (2-2-13)/(B1-1) = 5/5 | — | 0.5% | CTM-1/CTM-7 = 5/5 | (B1-1) | 57000 | (E-5) | 6/4 |
| 60 | (2-2-14)/(B1-1) = 8/2 | (2-4-2) | 0.5% | CTM-1/CTM-7 = 5/5 | (B1-1) | 57000 | (E-1) | 6/4 |
| 61 | (2-2-15)/(B1-1) = 7/3 | — | 0.5% | CTM-1/CTM-7 = 5/5 | (B1-1) | 57000 | (E-5) | 6/4 |
| 62 | (2-2-16)/(B1-1) = 6/4 | (2-4-2) | 0.5% | CTM-1/CTM-7 = 5/5 | (B1-1) | 57000 | (E-5) | 6/4 |
| 63 | (2-1-2)/(B1-1) = 9/1 | — | 0.5% | CTM-1 | (B1-1) | 57000 | (E-4)/(F-1) = 9/1 | 6/4 |
| 64 | (2-1-2)/(B1-1) = 9/1 | — | 0.5% | CTM-1/CTM-7 = 7/3 | (B1-1) | 57000 | (E-1)/(F-2) = 9/1 | 6/4 |
| 65 | (2-1-2)/(B1-1) = 8/2 | — | 0.5% | CTM-1/CTM-7 = 3/7 | (B1-1) | 57000 | (E-4)/(F-1) = 9/1 | 6/4 |
| 66 | (2-1-2)(B1-1) = 9/1 | — | 0.5% | CTM-7 | (B1-1) | 57000 | (E-1) | 6/4 |
| 67 | (2-1-2)/(B1-1) = 9/1 | — | 0.5% | CTM-1/CTM-7 = 5/5 | (B1-1) | 14000 | (E-4)/(F-2) = 9/1 | 6/4 |
| 68 | (2-1-2)/(B1-1) = 9/1 | — | 0.5% | CTM-1/CTM-7 = 5/5 | (B1-1) | 120000 | (E-4) | 6/4 |
| 69 | (2-1-2)/(B1-1) = 9/1 | — | 0.5% | CTM-1/CTM-7 = 5/5 | (B1-2) | 55000 | (E-1) | 6/4 |
| 70 | (2-1-2)/(B1-1) = 9/1 | — | 0.5% | CTM-1/CTM-7 = 5/5 | (B1-3) | 53000 | (E-5)/(F-2) = 9/1 | 6/4 |
| 71 | (2-1-2)/(B1-1) = 9/1 | — | 0.5% | CTM-1/CTM-7 = 5/5 | (B1-2)/(B1-3) = 3/7 | 55000 | (E-5)/(F-2) = 9/1 | 6/4 |
| 72 | (2-1-2)/(B1-1) = 8/2 | — | 0.5% | CTM-1/CTM-7 = 5/5 | (B1-2)/(B1-3) = 5/5 | 55000 | (E-4) | 6/4 |
| 73 | (2-1-2)/(B1-1) = 9/1 | — | 0.5% | CTM-1/CTM-7 = 5/5 | (B1-2)/(B1-3) = 7/3 | 55000 | (E-4)/(F-2) = 9/1 | 6/4 |
| 74 | (2-1-2)/(B1-1) = 9/1 | — | 0.5% | CTM-1/CTM-7 = 5/5 | (B2-1) | 120000 | (E-5)/(F-2) = 9/1 | 6/4 |
| 75 | (2-1-2)/(B1-1) = 9/1 | — | 0.5% | CTM-1/CTM-7 = 5/5 | (B2-2) | 120000 | (E-4) | 6/4 |
| 76 | (2-1-2)/(B1-1) = 9/1 | — | 0.5% | CTM-1/CTM-7 = 5/5 | (B2-1)/(B2-2) = 7/3 | 120000 | (E-1)/(F-2) = 9/1 | 6/4 |
| 77 | (2-1-2)/(B1-1) = 9/1 | — | 0.5% | CTM-1/CTM-7 = 5/5 | (B1-1) | 57000 | (E-1) | 6/4 |
| 78 | (2-1-2)/(B1-1) = 9/1 | — | 0.5% | CTM-1/CTM-7 = 5/5 | (B1-1) | 57000 | (E-4)/(F-2) = 9/1 | 6/4 |
| 79 | (2-1-2)/(B1-1) = 9/1 | — | 0.5% | CTM-1/CTM-7 = 5/5 | (B1-1) | 57000 | (F-1) | 6/4 |
| 80 | (2-1-2)/(B1-1) = 9/1 | — | 2% | CTM-1/CTM-7 = 5/5 | (B1-1) | 57000 | (E-1)/(F-1) = 9/1 | 6/4 |
| 81 | (2-1-2)/(B1-1) = 9/1 | — | 2% | CTM-1/CTM-7 = 5/5 | (B1-1) | 57000 | (E-4)/(F-2) = 9/1 | 6/4 |

TABLE 8-continued

| Example | Polycarbonate having siloxane bond: Repeating structural unit, ratio | Terminal structure | Content (%) | Charge transporting substance and ratio | Binder resin: Repeating structural unit, ratio | Weight average molecular weight | Kind and ratio of solvent: Hydrophobic solvent/hydrophilic solvent, ratio | Water/solvent |
|---|---|---|---|---|---|---|---|---|
| 82 | (2-1-2)/(B1-2) = 9/1 | — | 2% | CTM-1/CTM-7 = 5/5 | (B1-1) | 57000 | (E-5)/(F-1) = 9/1 | 6/4 |
| 83 | (2-1-2)/(B1-3) = 9/1 | — | 2% | CTM-1/CTM-7 = 5/5 | (B1-1) | 57000 | (E-1)/(F-2) = 9/1 | 6/4 |
| 84 | (2-1-2)/(2-1-6)/(B1-1) = 3.5/3.5/3 | — | 2% | CTM-1/CTM-7 = 5/5 | (B1-1) | 57000 | (E-5)/(F-2) = 9/1 | 6/4 |
| 85 | (2-1-2)/(2-1-6)/(B1-1) = 2.5/2.5/5 | — | 2% | CTM-1/CTM-7 = 5/5 | (B1-1) | 57000 | (E-4)/(F-2) = 9/1 | 6/4 |
| 86 | (2-1-2)/(2-1-6)/(B1-1) = 1.5/1.5/7 | — | 2% | CTM-1/CTM-7 = 5/5 | (B1-1) | 57000 | (E-1)/(F-1) = 9/1 | 6/4 |
| 87 | (2-1-3)/(B-1) = 9/1 | — | 2% | CTM-1/CTM-7 = 5/5 | (B1-1) | 57000 | (E-5)/(F-2) = 9/1 | 6/4 |
| 88 | (2-1-4)/(B1-1) = 9/1 | — | 2% | CTM-1/CTM-7 = 5/5 | (B1-1) | 57000 | (E-4)/(F-1) = 9/1 | 6/4 |
| 89 | (2-1-5)/(B1-1) = 9/1 | — | 2% | CTM-1/CTM-7 = 5/5 | (B1-1) | 57000 | (E-1)/(F-2) = 9/1 | 6/4 |
| 90 | (2-1-6)/(B1-1) = 9/1 | — | 2% | CTM-1/CTM-7 = 5/5 | (B1-1) | 57000 | (E-4)/(F-1) = 9/1 | 6/4 |
| 91 | (2-1-7)/(B1-1) = 9/1 | — | 2% | CTM-1/CTM-7 = 5/5 | (B1-1) | 57000 | (E-5)/(F-1) = 9/1 | 6/4 |
| 92 | (2-1-1)/(2-1-4)/(B1-4) = 4.5/4.5/1 | — | 0.1% | CTM-1/CTM-5 = 7/3 | (B1-5) | 57000 | (E-6)/(F-1) = 9/1 | 6/4 |
| 93 | (2-1-3)/(2-1-4)/(B1-5) = 4.5/4.5/1 | — | 1% | CTM-1/CTM-5 = 5/5 | (B1-6) | 57000 | (E-6)/(F-8) = 9/1 | 6/4 |
| 94 | (2-1-5)/(2-1-6)/(B1-6) = 4.5/4.5/1 | — | 5% | CTM-1/CTM-5 = 3/7 | (B1-7) | 57000 | (E-3)/(F-14) = 9/1 | 6/4 |
| 95 | (2-1-7)/(2-1-2)/(B1-7) = 4.5/4.5/1 | — | 2% | CTM-2/CTM-4 = 5/5 | (B1-8) | 57000 | (E-2)/(F-33) = 9/1 | 6/4 |
| 96 | (2-1-2)/(2-1-5)/(B1-8) = 4.5/4.5/1 | — | 2% | CTM-3/CTM-8 = 5/5 | (B1-9) | 57000 | (E-2)/(F-18) = 9/1 | 6/4 |

TABLE 9

| Example | Polyester having siloxane bond: Repeating structural unit, ratio | Terminal structure | Content (%) | Charge transporting substance and ratio | Binder resin: Repeating structural unit, ratio | Weight average molecular weight | Kind and ratio of solvent: Hydrophobic solvent/hydrophilic solvent, ratio | Water/solvent |
|---|---|---|---|---|---|---|---|---|
| 97 | (3-1-1)/(B2-1) = 9/1 | (3-3-2) | 0.5% | CTM-1/CTM-7 = 5/5 | (B1-1) | 57000 | (E-5)/(F-1) = 9/1 | 6/4 |
| 98 | (3-1-2)/(B2-1) = 9/1 | (3-3-2) | 0.5% | CTM-1/CTM-7 = 5/5 | (B1-1) | 57000 | (E-1)/(F-2) = 9/1 | 6/4 |
| 99 | (3-1-2)/(B2-2) = 9/1 | (3-3-4) | 0.5% | CTM-1/CTM-7 = 5/5 | (B1-1) | 57000 | (E-1) | 6/4 |
| 100 | (3-1-2)/(B2-3) = 9/1 | (3-3-2) · (3-5) | 0.5% | CTM-1/CTM-7 = 5/5 | (B1-1) | 57000 | (E-4) | 6/4 |
| 101 | (3-1-2)/(3-1-9)/(B2-1) = 3.5/3.5/3 | (3-3-2) | 0.5% | CTM-1/CTM-7 = 5/5 | (B1-1) | 57000 | (E-1) | 6/4 |
| 102 | (3-1-2)(3-1-9)/(B2-1) = 2.5/2.5/5 | (3-3-2) | 0.5% | CTM-1/CTM-7 = 5/5 | (B1-1) | 57000 | (E-5)/(F-1) = 9/1 | 6/4 |
| 103 | (3-1-2)/(3-1-9)/(B2-1) = 1.5/1.5/7 | (3-3-2) | 0.5% | CTM-1/CTM-7 = 5/5 | (B1-1) | 57000 | (E-4) | 6/4 |
| 104 | (3-1-2)/(3-1-16)/(B2-1) = 1.5/1.5/7 | (3-3-2) | 0.5% | CTM-1/CTM-7 = 5/5 | (B1-1) | 57000 | (E-5)/(F-1) = 9/1 | 6/4 |
| 105 | (3-1-3)/(B2-1) = 9/1 | (3-3-2) | 0.5% | CTM-1/CTM-7 = 5/5 | (B1-1) | 57000 | (E-1) | 6/4 |
| 106 | (3-1-4)/(B2-1) = 9/1 | (3-3-2) | 0.5% | CTM-1/CTM-7 = 5/5 | (B1-1) | 57000 | (E-1)/(F-2) = 9/1 | 6/4 |
| 107 | (3-1-5)/(B2-1) = 9/1 | (3-3-2) | 0.5% | CTM-1/CTM-7 = 5/5 | (B1-1) | 57000 | (E-5) | 6/4 |
| 108 | (3-1-6)/(B2-1) = 9/1 | (3-3-2) | 0.5% | CTM-1/CTM-7 = 5/5 | (B1-1) | 57000 | (E-4)/(F-2) = 9/1 | 6/4 |
| 109 | (3-1-7)/(B2-1) = 9/1 | (3-3-2) | 0.5% | CTM-1/CTM-7 = 5/5 | (B1-1) | 57000 | (E-4)/(F-2) = 9/1 | 6/4 |
| 110 | (3-1-9)/(B2-1) = 5/5 | (3-3-2) | 0.5% | CTM-1/CTM-7 = 5/5 | (B1-1) | 57000 | (E-5) | 6/4 |

TABLE 9-continued

| Example | Polyester having siloxane bond: Repeating structural unit, ratio | Polyester having siloxane bond: Terminal structure | Polyester having siloxane bond: Content (%) | Charge transporting substance and ratio | Binder resin: Repeating structural unit, ratio | Binder resin: Weight average molecular weight | Kind and ratio of solvent: Hydrophobic solvent/hydrophilic solvent, ratio | Kind and ratio of solvent: Water/solvent |
|---|---|---|---|---|---|---|---|---|
| 111 | (3-1-11)/(B2-1) = 7/3 | (3-3-2) | 0.5% | CTM-1/CTM-7 = 5/5 | (B1-1) | 57000 | (E-4)/(F-1) = 9/1 | 6/4 |
| 112 | (3-1-14)/(B2-1) = 9/1 | (3-3-2) | 0.5% | CTM-1/CTM-7 = 5/5 | (B1-1) | 57000 | (E-1) | 6/4 |
| 113 | (3-1-16)/(B2-1) = 6/4 | (3-3-2) | 0.5% | CTM-1/CTM-7 = 5/5 | (B1-1) | 57000 | (E-5) | 6/4 |
| 114 | (3-1-18)/(B2-1) = 8/2 | (3-3-2) | 0.5% | CTM-1/CTM-7 = 5/5 | (B1-1) | 57000 | (E-4)/(F-2) = 9/1 | 6/4 |
| 115 | (3-1-21)/(B2-1) = 9/1 | (3-3-2) | 0.5% | CTM-1/CTM-7 = 5/5 | (B1-1) | 57000 | (E-5) | 6/4 |
| 116 | (3-1-2)/(B2-1) = 9/1 | (3-3-2) | 0.5% | CTM-1 | (B1-1) | 57000 | (E-4) | 6/4 |
| 117 | (3-1-2)/(B2-1) = 9/1 | (3-3-2) | 0.5% | CTM-1/CTM-7 = 7/3 | (B1-1) | 57000 | (E-1) | 6/4 |
| 118 | (3-1-2)/(B2-1) = 9/1 | (3-3-2) | 0.5% | CTM-1/CTM-7 = 3/7 | (B1-1) | 57000 | (E-5)/(F-2) = 9/1 | 6/4 |
| 119 | (3-1-2)/(B2-1) = 9/1 | (3-3-2) | 0.5% | CTM-7 | (B1-1) | 57000 | (E-1) | 6/4 |
| 120 | (3-1-2)/(B2-1) = 9/1 | (3-3-2) | 0.5% | CTM-1/CTM-7 = 5/5 | (B1-1) | 14000 | (E-4) | 6/4 |
| 121 | (3-1-2)/(B2-1) = 9/1 | (3-3-2) | 0.5% | CTM-1/CTM-7 = 5/5 | (B1-1) | 120000 | (E-5)/(F-2) = 9/1 | 6/4 |
| 122 | (3-1-2)/(B2-1) = 9/1 | (3-3-2) | 0.5% | CTM-1/CTM-7 = 5/5 | (B1-2) | 55000 | (E-4) | 6/4 |
| 123 | (3-1-2)/(B2-1) = 9/1 | (3-3-2) | 0.5% | CTM-1/CTM-7 = 5/5 | (B1-3) | 53000 | (E-1)/(F-1) = 9/1 | 6/4 |
| 124 | (3-1-2)/(B2-1) = 9/1 | (3-3-2) | 0.5% | CTM-1/CTM-7 = 5/5 | (B1-2)/(B1-3) = 3/7 | 55000 | (E-5)/(F-2) = 9/1 | 6/4 |
| 125 | (3-1-2)/(B2-1) = 9/1 | (3-3-2) | 0.5% | CTM-1/CTM-7 = 5/5 | (B1-2)/(B1-3) = 5/5 | 55000 | (E-4)/(F-1) = 9/1 | 6/4 |
| 126 | (3-1-2)/(B2-1) = 9/1 | (3-3-2) | 0.5% | CTM-1/CTM-7 = 5/5 | (B1-2)/(B1-3) = 7/3 | 55000 | (E-4) | 6/4 |
| 127 | (3-1-2)/(B2-1) = 9/1 | (3-3-2) | 0.5% | CTM-1/CTM-7 = 5/5 | (B2-1) | 120000 | (E-1)/(F-1) = 9/1 | 6/4 |
| 128 | (3-1-2)/(B2-1) = 9/1 | (3-3-2) | 0.5% | CTM-1/CTM-7 = 5/5 | (B2-2) | 120000 | (E-1)/(F-2) = 9/1 | 6/4 |
| 129 | (3-1-2)/(B2-1) = 9/1 | (3-3-2) | 0.5% | CTM-1/CTM-7 = 5/5 | (B2-1)/(B2-2) = 7/3 | 120000 | (E-4) | 6/4 |
| 130 | (3-1-2)/(B2-1) = 9/1 | (3-3-2) | 0.5% | CTM-1/CTM-7 = 5/5 | (B1-1) | 57000 | (E-4)/(F-1) = 9/1 | 6/4 |
| 131 | (3-1-2)/(B2-1) = 9/1 | (3-3-2) | 0.5% | CTM-1/CTM-7 = 5/5 | (B1-1) | 57000 | (E-1)/(F-1) = 9/1 | 6/4 |
| 132 | (3-1-2)/(B2-1) = 9/1 | (3-3-2) | 0.5% | CTM-1/CTM-7 = 5/5 | (B1-1) | 57000 | (F-1) | 6/4 |
| 133 | (3-1-2)/(B2-4) = 9 | (3-3-1) | 0.1% | CTM-1/CTM-5 = 3/7 | (B2-2)/(B2-3) = 3/7 | 57000 | (E-6)/(F-6) = 9/1 | 6/4 |
| 134 | (3-1-2)/(B2-5) = 9 | (3-3-2) · (3-4) | 1% | CTM-1/CTM-5 = 5/5 | (B2-2)/(B2-3) = 5/5 | 57000 | (E-6)/(F-35) = 9/1 | 6/4 |
| 135 | (3-1-2)/(B2-6) = 9 | (3-3-2) | 5% | CTM-1/CTM-5 = 7/3 | (B2-2)/(B2-3) = 7/3 | 57000 | (E-3)/(F-23) = 9/1 | 6/4 |
| 136 | (3-1-2)/(B2-1) = 9/1 | (3-3-2) | 1% | CTM-8/CTM-9 = 5/5 | (B2-4)/(B2-6) = 5/5 | 57000 | (E-6)/(F-29) = 9/1 | 6/4 |

TABLE 10

| Example | Polystyrene having siloxane bond: Repeating structural unit, ratio | Polystyrene having siloxane bond: Content (%) | Charge transporting substance and ratio | Binder resin: Repeating structural unit, ratio | Binder resin: Weight average molecular weight | Kind and ratio of solvent: Hydrophobic solvent/hydrophilic solvent, ratio | Kind and ratio of solvent: Water/solvent |
|---|---|---|---|---|---|---|---|
| 137 | (4-1-1)/(4-2) = 2/8 | 1% | CTM-1/CTM-7 = 5/5 | (B1-1) | 57000 | (E-4)/(F-1) = 9/1 | 6/4 |
| 138 | (4-1-2)/(4-2) = 2/8 | 1% | CTM-1/CTM-7 = 5/5 | (B1-1) | 57000 | (E-1)/(F-1) = 9/1 | 6/4 |
| 139 | (4-1-3)/(4-2) = 1/9 | 1% | CTM-1/CTM-7 = 5/5 | (B1-1) | 57000 | (E-1) | 6/4 |
| 140 | (4-1-3)/(4-2) = 2/8 | 1% | CTM-1/CTM-7 = 5/5 | (B1-1) | 57000 | (E-5)/(F-2) = 9/1 | 6/4 |

TABLE 10-continued

| Example | Polystyrene having siloxane bond: Repeating structural unit, ratio | Content (%) | Charge transporting substance and ratio | Binder resin: Repeating structural unit, ratio | Weight average molecular weight | Kind and ratio of solvent: Hydrophobic solvent/hydrophilic solvent, ratio | Water/solvent |
|---|---|---|---|---|---|---|---|
| 141 | (4-1-3)/(4-2) = 3/7 | 1% | CTM-1/CTM-7 = 5/5 | (B1-1) | 57000 | (E-5) | 6/4 |
| 142 | (4-1-4)/(4-2) = 2/8 | 1% | CTM-1/CTM-7 = 5/5 | (B1-1) | 57000 | (E-5)/(F-2) = 9/1 | 6/4 |
| 143 | (4-1-5)/(4-2) = 2/8 | 1% | CTM-1/CTM-7 = 5/5 | (B1-1) | 57000 | (E-1) | 6/4 |
| 144 | (4-1-3)/(4-2) = 2/8 | 1% | CTM-1 | (B1-1) | 57000 | (E-4)/(F-1) = 9/1 | 6/4 |
| 145 | (4-1-3)/(4-2) = 2/8 | 1% | CTM-1/CTM-7 = 7/3 | (B1-1) | 57000 | (E-4) | 6/4 |
| 146 | (4-1-3)/(4-2) = 2/8 | 1% | CTM-1/CTM-7 = 3/7 | (B1-1) | 57000 | (E-5) | 6/4 |
| 147 | (4-1-3)/(4-2) = 2/8 | 1% | CTM-7 | (B1-1) | 57000 | (E-1)/(F-2) = 9/1 | 6/4 |
| 148 | (4-1-3)/(4-2) = 2/8 | 1% | CTM-1/CTM-7 = 5/5 | (B1-1) | 14000 | (E-1)/(F-2) = 9/1 | 6/4 |
| 149 | (4-1-3)/(4-2) = 2/8 | 1% | CTM-1/CTM-7 = 5/5 | (B1-1) | 120000 | (E-1) | 6/4 |
| 150 | (4-1-3)/(4-2) = 2/8 | 1% | CTM-1/CTM-7 = 5/5 | (B1-2) | 55000 | (E-4)/(F-2) = 9/1 | 6/4 |
| 151 | (4-1-3)/(4-2) = 2/8 | 1% | CTM-1/CTM-7 = 5/5 | (B1-3) | 53000 | (E-5)/(F-1) = 9/1 | 6/4 |
| 152 | (4-1-3)/(4-2) = 2/8 | 1% | CTM-1/CTM-7 = 5/5 | (B1-2)/(B1-3) = 3/7 | 55000 | (E-4) | 6/4 |
| 153 | (4-1-3)/(4-2) = 2/8 | 1% | CTM-1/CTM-7 = 5/5 | (B1-2)/(B1-3) = 5/5 | 55000 | (E-1)/(F-1) = 9/1 | 6/4 |
| 154 | (4-1-3)/(4-2) = 2/8 | 1% | CTM-1/CTM-7 = 5/5 | (B1-2)/(B1-3) = 7/3 | 55000 | (E-4) | 6/4 |
| 155 | (4-1-3)/(4-2) = 2/8 | 1% | CTM-1/CTM-7 = 5/5 | (B2-1) | 120000 | (E-5)/(F-1) = 9/1 | 6/4 |
| 156 | (4-1-3)/(4-2) = 2/8 | 1% | CTM-1/CTM-7 = 5/5 | (B2-2) | 120000 | (E-1)/(F-1) = 9/1 | 6/4 |
| 157 | (4-1-3)/(4-2) = 2/8 | 1% | CTM-1/CTM-7 = 5/5 | (B2-1)/(B2-2) = 7/3 | 120000 | (E-4) | 6/4 |
| 158 | (4-1-3)/(4-2) = 2/8 | 1% | CTM-1/CTM-7 = 5/5 | (B1-1) | 57000 | (E-4)/(F-2) = 9/1 | 6/4 |
| 159 | (4-1-3)/(4-2) = 2/8 | 1% | CTM-1/CTM-7 = 5/5 | (B1-1) | 57000 | (E-5) | 6/4 |
| 160 | (4-1-3)/(4-2) = 2/8 | 1% | CTM-1/CTM-7 = 5/5 | (B1-1) | 57000 | (F-1) | 6/4 |
| 161 | (4-1-3)/(4-2) = 2/8 | 0.5% | CTM-1/CTM-5 = 3/7 | (B1-4) | 57000 | (E-6)/(F-17) = 9/1 | 6/4 |
| 162 | (4-1-3)/(4-2) = 2/8 | 3% | CTM-1/CTM-5 = 5/5 | (B1-5) | 57000 | (E-2)/(F-30) = 9/1 | 6/4 |
| 163 | (4-1-3)/(4-2) = 2/8 | 10% | CTM-1/CTM-5 = 7/3 | (B1-6) | 57000 | (E-2)/(F-35) = 9/1 | 6/4 |
| 164 | (4-1-3)/(4-2) = 2/8 | 0.5% | CTM-2/CTM-3 = 5/5 | (B2-4) | 57000 | (E-6)/(F-26) = 9/1 | 6/4 |
| 165 | (4-1-3)/(4-2) = 2/8 | 3% | CTM-6/CTM-8 = 5/5 | (B2-5) | 57000 | (E-6)/(F-15) = 9/1 | 6/4 |

TABLE 11

| Example | Compound represented by formula (5): Formula | Content (%) | Charge transporting substance and ratio | Binder resin: Repeating structural unit, ratio | Weight average molecular weight | Kind and ratio of solvent: Hydrophobic solvent/hydrophilic solvent, ratio | Water/solvent |
|---|---|---|---|---|---|---|---|
| 166 | (5-1) | 1% | CTM-1/CTM-7 = 5/5 | (B1-1) | 57000 | (E-4)/(F-2) = 9/1 | 6/4 |
| 167 | (5-2) | 10% | CTM-1/CTM-7 = 5/5 | (B1-1) | 57000 | (E-4)/(F-2) = 9/1 | 6/4 |
| 168 | (5-3) | 1% | CTM-1/CTM-7 = 5/5 | (B1-1) | 57000 | (E-1)/(F-2) = 9/1 | 6/4 |
| 169 | (5-4) | 10% | CTM-1/CTM-7 = 5/5 | (B1-1) | 57000 | (E-1)/(F-2) = 9/1 | 6/4 |

TABLE 11-continued

| Example | Compound represented by formula (5) Formula | Content (%) | Charge transporting substance and ratio | Binder resin Repeating structural unit, ratio | Weight average molecular weight | Kind and ratio of solvent Hydrophobic solvent/hydrophilic solvent, ratio | Water/solvent |
|---|---|---|---|---|---|---|---|
| 170 | (5-5) | 2% | CTM-1/CTM-7 = 5/5 | (B1-1) | 57000 | (E-5) | 6/4 |
| 171 | (5-6) | 2% | CTM-1/CTM-7 = 5/5 | (B1-1) | 57000 | (E-4)/(F-1) = 9/1 | 6/4 |
| 172 | (5-7) | 2% | CTM-1/CTM-7 = 5/5 | (B1-1) | 57000 | (E-1)/(F-1) = 9/1 | 6/4 |
| 173 | (5-2) | 2% | CTM-1 | (B1-1) | 57000 | (E-5)/(F-2) = 9/1 | 6/4 |
| 174 | (5-2) | 2% | CTM-1/CTM-7 = 7/3 | (B1-1) | 57000 | (E-1)/(F-2) = 9/1 | 6/4 |
| 175 | (5-2) | 2% | CTM-1/CTM-7 = 3/7 | (B1-1) | 57000 | (E-5)/(F-2) = 9/1 | 6/4 |
| 176 | (5-2) | 2% | CTM-7 | (B1-1) | 57000 | (E-1)/(F-1) = 9/1 | 6/4 |
| 177 | (5-2) | 2% | CTM-1/CTM-7 = 5/5 | (B1-1) | 14000 | (E-5) | 6/4 |
| 178 | (5-2) | 2% | CTM-1/CTM-7 = 5/5 | (B1-1) | 120000 | (E-4)/(F-1) = 9/1 | 6/4 |
| 179 | (5-2) | 2% | CTM-1/CTM-7 = 5/5 | (B1-2) | 55000 | (E-1)/(F-1) = 9/1 | 6/4 |
| 180 | (5-2) | 2% | CTM-1/CTM-7 = 5/5 | (B1-3) | 53000 | (E-5)/(F-2) = 9/1 | 6/4 |
| 181 | (5-2) | 2% | CTM-1/CTM-7 = 5/5 | (B1-2)/(B1-3) = 3/7 | 55000 | (E-5)/(F-1) = 9/1 | 6/4 |
| 182 | (5-2) | 2% | CTM-1/CTM-7 = 5/5 | (B1-2)/(B1-3) = 5/5 | 55000 | (E-1) | 6/4 |
| 183 | (5-2) | 2% | CTM-1/CTM-7 = 5/5 | (B1-2)/(B1-3) = 7/3 | 55000 | (E-4)/(F-1) = 9/1 | 6/4 |
| 184 | (5-2) | 2% | CTM-1/CTM-7 = 5/5 | (B2-1) | 120000 | (E-5)/(F-1) = 9/1 | 6/4 |
| 185 | (5-2) | 2% | CTM-1/CTM-7 = 5/5 | (B2-2) | 120000 | (E-1) | 6/4 |
| 186 | (5-2) | 2% | CTM-1/CTM-7 = 5/5 | (B2-1)/(B2-2) = 7/3 | 120000 | (E-4)/(F-2) = 9/1 | 6/4 |
| 187 | (5-2) | 2% | CTM-1/CTM-7 = 5/5 | (B1-1) | 57000 | (E-5)/(F-1) = 9/1 | 6/4 |
| 188 | (5-2) | 2% | CTM-1/CTM-7 = 5/5 | (B1-1) | 57000 | (E-4) | 6/4 |
| 189 | (5-2) | 2% | CTM-1/CTM-7 = 5/5 | (B1-1) | 57000 | (F-1) | 6/4 |
| 190 | (5-2) | 0.5% | CTM-1/CTM-5 = 7/3 | (B1-4) | 57000 | (E-6)/(F-4) = 9/1 | 6/4 |
| 191 | (5-2) | 2% | CTM-1/CTM-5 = 5/5 | (B1-5) | 57000 | (E-3)/(F-19) = 9/1 | 6/4 |
| 192 | (5-2) | 5% | CTM-1/CTM-5 = 3/7 | (B1-6) | 57000 | (E-2)/(F-28) = 9/1 | 6/4 |
| 193 | (5-2) | 10% | CTM-2/CTM-3 = 5/5 | (B1-7) | 57000 | (E-2)/(F-31) = 9/1 | 6/4 |
| 194 | (5-2) | 1% | CTM-4/CTM-6 = 5/5 | (B1-8) | 57000 | (E-6)/(F-12) = 9/1 | 6/4 |
| 195 | (5-2) | 5% | CTM-8/CTM-9 = 5/5 | (B1-9) | 57000 | (E-2)/(F-13) = 9/1 | 6/4 |

TABLE 12

| Example | Compound represented by formula (6) Formula | Content (%) | Charge transporting substance and ratio | Binder resin Repeating structural unit, ratio | Weight average molecular weight | Kind and ratio of solvent Hydrophobic solvent/hydrophilic solvent, ratio | Water/solvent |
|---|---|---|---|---|---|---|---|
| 196 | (6-1) | 1% | CTM-1/CTM-7 = 5/5 | (B1-1) | 57000 | (E-1)/(F-2) = 9/1 | 6/4 |
| 197 | (6-2) | 10% | CTM-1/CTM-7 = 5/5 | (B1-1) | 57000 | (E-1)/(F-2) = 9/1 | 6/4 |
| 198 | (6-3) | 1% | CTM-1/CTM-7 = 5/5 | (B1-1) | 57000 | (E-4)/(F-1) = 9/1 | 6/4 |

TABLE 12-continued

| Example | Compound represented by formula (6) Formula | Content (%) | Charge transporting substance and ratio | Binder resin Repeating structural unit, ratio | Weight average molecular weight | Kind and ratio of solvent Hydrophobic solvent/hydrophilic solvent, ratio | Water/solvent |
|---|---|---|---|---|---|---|---|
| 199 | (6-4) | 10% | CTM-1/CTM-7 = 5/5 | (B1-1) | 57000 | (E-4)/(F-1) = 9/1 | 6/4 |
| 200 | (6-5) | 3% | CTM-1/CTM-7 = 5/5 | (B1-1) | 57000 | (E-1)/(F-1) = 9/1 | 6/4 |
| 201 | (6-6) | 3% | CTM-1/CTM-7 = 5/5 | (B1-1) | 57000 | (E-4) | 6/4 |
| 202 | (6-7) | 3% | CTM-1/CTM-7 = 5/5 | (B1-1) | 57000 | (E-4)/(F-2) = 9/1 | 6/4 |
| 203 | (6-4) | 3% | CTM-1 | (B1-1) | 57000 | (E-1)/(F-1) = 9/1 | 6/4 |
| 204 | (6-4) | 3% | CTM-1/CTM-7 = 7/3 | (B1-1) | 57000 | (E-5)/(F-2) = 9/1 | 6/4 |
| 205 | (6-4) | 3% | CTM-1/CTM-7 = 3/7 | (B1-1) | 57000 | (E-1)/(F-2) = 9/1 | 6/4 |
| 206 | (6-4) | 3% | CTM-7 | (B1-1) | 57000 | (E-4)/(F-1) = 9/1 | 6/4 |
| 207 | (6-4) | 3% | CTM-1/CTM-7 = 5/5 | (B1-1) | 14000 | (E-5)/(F-2) = 9/1 | 6/4 |
| 208 | (6-4) | 3% | CTM-1/CTM-7 = 5/5 | (B1-1) | 120000 | (E-1)/(F-1) = 9/1 | 6/4 |
| 209 | (6-4) | 3% | CTM-1/CTM-7 = 5/5 | (B1-2) | 55000 | (E-4)/(F-2) = 9/1 | 6/4 |
| 210 | (6-4) | 3% | CTM-1/CTM-7 = 5/5 | (B1-3) | 53000 | (E-4)/(F-1) = 9/1 | 6/4 |
| 211 | (6-4) | 3% | CTM-1/CTM-7 = 5/5 | (B1-2)/(B1-3) = 3/7 | 55000 | (E-5)/(F-2) = 9/1 | 6/4 |
| 212 | (6-4) | 3% | CTM-1/CTM-7 = 5/5 | (B1-2)/(B1-3) = 5/5 | 55000 | (E-5)/(F-2) = 9/1 | 6/4 |
| 213 | (6-4) | 3% | CTM-1/CTM-7 = 5/5 | (B1-2)/(B1-3) = 7/3 | 55000 | (E-1) | 6/4 |
| 214 | (6-4) | 3% | CTM-1/CTM-7 = 5/5 | (B2-1) | 120000 | (E-5)/(F-2) = 9/1 | 6/4 |
| 215 | (6-4) | 3% | CTM-1/CTM-7 = 5/5 | (B2-2) | 120000 | (E-5) | 6/4 |
| 216 | (6-4) | 3% | CTM-1/CTM-7 = 5/5 | (B2-1)/(B2-2) = 7/3 | 120000 | (E-5)/(F-1) = 9/1 | 6/4 |
| 217 | (6-4) | 3% | CTM-1/CTM-7 = 5/5 | (B1-1) | 57000 | (E-1)/(F-1) = 9/1 | 6/4 |
| 218 | (6-4) | 3% | CTM-1/CTM-7 = 5/5 | (B1-1) | 57000 | (E-4)/(F-2) = 9/1 | 6/4 |
| 219 | (6-4) | 3% | CTM-1/CTM-7 = 5/5 | (B1-1) | 57000 | (F-1) | 6/4 |
| 220 | (6-4) | 1% | CTM-1/CTM-5 = 7/3 | (B2-2)/(B2-4) = 5/5 | 57000 | (E-3)/(F-22) = 9/1 | 6/4 |
| 221 | (6-4) | 3% | CTM-1/CTM-5 = 5/5 | (B2-3)/(B2-6) = 5/5 | 57000 | (E-6)/(F-27) = 9/1 | 6/4 |
| 222 | (6-4) | 10% | CTM-1/CTM-5 = 3/7 | (B2-4)/(B2-5) = 5/5 | 57000 | (E-2)/(F-34) = 9/1 | 6/4 |
| 223 | (6-4) | 5% | CTM-4/CTM-8 = 5/5 | (B1-4)/(B1-8) = 5/5 | 57000 | (E-3)/(F-24) = 9/1 | 6/4 |
| 224 | (6-4) | 5% | CTM-3/CTM-9 = 5/5 | (B1-5)/(B1-6) = 5/5 | 57000 | (E-6)/(F-9) = 9/1 | 6/4 |

TABLE 13

| Example | Compound represented by formula (7) Formula | Content (%) | Charge transporting substance and ratio | Binder resin Repeating structural unit, ratio | Weight average molecular weight | Kind and ratio of solvent Hydrophobic solvent/hydrophilic solvent, ratio | Water/solvent |
|---|---|---|---|---|---|---|---|
| 225 | (7-1-1) | 1% | CTM-1/CTM-7 = 5/5 | (B1-1) | 57000 | (E-1)/(F-1) = 9/1 | 6/4 |
| 226 | (7-1-2) | 10% | CTM-1/CTM-7 = 5/5 | (B1-1) | 57000 | (E-1)/(F-1) = 9/1 | 6/4 |
| 227 | (7-1-3) | 1% | CTM-1/CTM-7 = 5/5 | (B1-1) | 57000 | (E-4)/(F-1) = 9/1 | 6/4 |

TABLE 13-continued

| Example | Compound represented by formula (7) Formula | Content (%) | Charge transporting substance and ratio | Binder resin Repeating structural unit, ratio | Weight average molecular weight | Kind and ratio of solvent Hydrophobic solvent/hydrophilic solvent, ratio | Water/solvent |
|---|---|---|---|---|---|---|---|
| 228 | (7-1-4) | 10% | CTM-1/CTM-7 = 5/5 | (B1-1) | 57000 | (E-4)/(F-1) = 9/1 | 6/4 |
| 229 | (7-1-5) | 3% | CTM-1/CTM-7 = 5/5 | (B1-1) | 57000 | (E-1) | 6/4 |
| 230 | (7-1-6) | 3% | CTM-1/CTM-7 = 5/5 | (B1-1) | 57000 | (E-4) | 6/4 |
| 231 | (7-1-7) | 3% | CTM-1/CTM-7 = 5/5 | (B1-1) | 57000 | (E-5)/(F-1) = 9/1 | 6/4 |
| 232 | (7-1-5) | 3% | CTM-1 | (B1-1) | 57000 | (E-4)/(F-2) = 9/1 | 6/4 |
| 233 | (7-1-6) | 3% | CTM-1/CTM-7 = 7/3 | (B1-1) | 57000 | (E-4) | 6/4 |
| 234 | (7-1-7) | 3% | CTM-1/CTM-7 = 3/7 | (B1-1) | 57000 | (E-5)/(F-2) = 9/1 | 6/4 |
| 235 | (7-1-8) | 3% | CTM-7 | (B1-1) | 57000 | (E-1)/(F-1) = 9/1 | 6/4 |
| 236 | (7-1-9) | 3% | CTM-1/CTM-7 = 5/5 | (B1-1) | 14000 | (E-4) | 6/4 |
| 237 | (7-1-10) | 3% | CTM-1/CTM-7 = 5/5 | (B1-1) | 120000 | (E-5)/(F-1) = 9/1 | 6/4 |
| 238 | (7-1-11) | 3% | CTM-1/CTM-7 = 5/5 | (B1-2) | 55000 | (E-5) | 6/4 |
| 239 | (7-1-12) | 3% | CTM-1/CTM-7 = 5/5 | (B1-3) | 53000 | (E-1)/(F-2) = 9/1 | 6/4 |
| 240 | (7-1-13) | 3% | CTM-1/CTM-7 = 5/5 | (B1-2)/(B1-3) = 3/7 | 55000 | (E-4) | 6/4 |
| 241 | (7-1-14) | 3% | CTM-1/CTM-7 = 5/5 | (B1-2)/(B1-3) = 5/5 | 55000 | (E-4)/(F-1) = 9/1 | 6/4 |
| 242 | (7-1-15) | 3% | CTM-1/CTM-7 = 5/5 | (B1-2)/(B1-3) = 7/3 | 55000 | (E-5)/(F-1) = 9/1 | 6/4 |
| 243 | (7-1-16) | 3% | CTM-1/CTM-7 = 5/5 | (B2-1) | 120000 | (E-1) | 6/4 |
| 244 | (7-1-17) | 3% | CTM-1/CTM-7 = 5/5 | (B2-2) | 120000 | (E-5)/(F-2) = 9/1 | 6/4 |
| 245 | (7-1-18) | 3% | CTM-1/CTM-7 = 5/5 | (B2-1)/(B2-2) = 7/3 | 120000 | (E-1) | 6/4 |
| 246 | (7-1-19) | 3% | CTM-1/CTM-7 = 5/5 | (B1-1) | 57000 | (E-5)/(F-1) = 9/1 | 6!4 |
| 247 | (7-1-20) | 3% | CTM-1/CTM-7 = 5/5 | (B1-1) | 57000 | (E-4)/(F-2) = 9/1 | 6/4 |
| 248 | (7-1-28) | 3% | CTM-1/CTM-7 = 5/5 | (B1-1) | 57000 | (F-1) | 6/4 |
| 249 | (7-1-8) | 1% | CTM-1/CTM-7 = 5/5 | (B1-1) | 57000 | (E-1)/(F-1) = 9/1 | 6/4 |
| 250 | (7-1-9) | 10% | CTM-1/CTM-7 = 5/5 | (B1-1) | 57000 | (E-1)/(F-1) = 9/1 | 6/4 |
| 251 | (7-1-10) | 1% | CTM-1/CTM-7 = 5/5 | (B1-1) | 57000 | (E-4)/(F-1) = 9/1 | 6/4 |
| 252 | (7-1-11) | 10% | CTM-1/CTM-7 = 5/5 | (B1-1) | 57000 | (E-4)/(F-1) = 9/1 | 6/4 |
| 253 | (7-1-12) | 3% | CTM-1/CTM-7 = 5/5 | (B1-1) | 57000 | (E-1) | 6/4 |
| 254 | (7-1-13) | 3% | CTM-1/CTM-7 = 5/5 | (B1-1) | 57000 | (E-5)/(F-1) = 9/1 | 6/4 |
| 255 | (7-1-10) | 3% | CTM-1 | (B1-1) | 57000 | (E-1)/(F-1) = 9/1 | 6/4 |
| 256 | (7-1-10) | 3% | CTM-1/CTM-7 = 7/3 | (B1-1) | 57000 | (E-4)/(F-2) = 9/1 | 6/4 |
| 257 | (7-1-10) | 3% | CTM-1/CTM-7 = 3/7 | (B1-1) | 57000 | (E-1) | 6/4 |
| 258 | (7-1-10) | 3% | CTM-7 | (B1-1) | 57000 | (E-1) | 6/4 |
| 259 | (7-1-10) | 3% | CTM-1/CTM-7 = 5/5 | (B1-1) | 14000 | (E-5)/(F-2) = 9/1 | 6/4 |
| 260 | (7-1-10) | 3% | CTM-1/CTM-7 = 5/5 | (B1-1) | 120000 | (E-5)/(F-1) = 9/1 | 6/4 |
| 261 | (7-1-10) | 3% | CTM-1/CTM-7 = 5/5 | (B1-2) | 55000 | (E-4)/(F-1) = 9/1 | 6/4 |
| 262 | (7-1-10) | 3% | CTM-1/CTM-7 = 5/5 | (B1-3) | 53000 | (E-1)/(F-2) = 9/1 | 6/4 |
| 263 | (7-1-10) | 3% | CTM-1/CTM-7 = 5/5 | (B1-2)/(B1-3) = 3/7 | 55000 | (E-5)/(F-2) = 9/1 | 6/4 |

TABLE 13-continued

| Example | Compound represented by formula (7) Formula | Content (%) | Charge transporting substance and ratio | Binder resin Repeating structural unit, ratio | Weight average molecular weight | Kind and ratio of solvent Hydrophobic solvent/hydrophilic solvent, ratio | Water/solvent |
|---|---|---|---|---|---|---|---|
| 264 | (7-1-10) | 3% | CTM-1/CTM-7 = 5/5 | (B1-2)/(B1-3) = 5/5 | 55000 | (E-5) | 6/4 |
| 265 | (7-1-10) | 3% | CTM-1/CTM-7 = 5/5 | (B1-2)/(B1-3) = 7/3 | 55000 | (E-4) | 6/4 |
| 266 | (7-1-10) | 3% | CTM-1/CTM-7 = 5/5 | (B2-1) | 120000 | (E-1)/(F-2) = 9/1 | 6/4 |
| 267 | (7-1-10) | 3% | CTM-1/CTM-7 = 5/5 | (B2-2) | 120000 | (E-5)/(F-1) = 9/1 | 6/4 |
| 268 | (7-1-10) | 3% | CTM-1/CTM-7 = 5/5 | (B2-1)/(B2-2) = 7/3 | 120000 | (E-4)/(F-2) = 9/1 | 6/4 |
| 269 | (7-1-10) | 3% | CTM-1/CTM-7 = 5/5 | (B1-1) | 57000 | (E-5) | 6/4 |
| 270 | (7-1-10) | 3% | CTM-1/CTM-7 = 5/5 | (B1-1) | 57000 | (E-4) | 6/4 |
| 271 | (7-1-10) | 3% | CTM-1/CTM-7 = 5/5 | (B1-1) | 57000 | (F-1) | 6/4 |
| 272 | (7-1-14) | 1% | CTM-1/CTM-7 = 5/5 | (B1-1) | 57000 | (E-1)/(F-1) = 9/1 | 6/4 |
| 273 | (7-1-15) | 10% | CTM-1/CTM-7 = 5/5 | (B1-1) | 57000 | (E-1)/(F-1) = 9/1 | 6/4 |
| 274 | (7-1-16) | 1% | CTM-1/CTM-7 = 5/5 | (B1-1) | 57000 | (E-4)/(F-1) = 9/1 | 6/4 |
| 275 | (7-1-17) | 10% | CTM-1/CTM-7 = 5/5 | (B1-1) | 57000 | (E-4)/(F-1) = 9/1 | 6/4 |
| 276 | (7-1-18) | 3% | CTM-1/CTM-7 = 5/5 | (B1-1) | 57000 | (E-1)/(F-2) = 9/1 | 6/4 |
| 277 | (7-1-19) | 3% | CTM-1/CTM-7 = 5/5 | (B1-1) | 57000 | (E-5) | 6/4 |
| 278 | (7-1-20) | 3% | CTM-1/CTM-7 = 5/5 | (B1-1) | 57000 | (E-1)/(F-2) = 9/1 | 6/4 |
| 279 | (7-1-21) | 3% | CTM-1/CTM-7 = 5/5 | (B1-1) | 57000 | (E-5)/(F-1) = 9/1 | 6/4 |
| 280 | (7-1-16) | 3% | CTM-1 | (B1-1) | 57000 | (E-4)/(F-1) = 9/1 | 6/4 |
| 281 | (7-1-16) | 3% | CTM-1/CTM-7 = 7/3 | (B1-1) | 57000 | (E-5) | 6/4 |
| 282 | (7-1-16) | 3% | CTM-1/CTM-7 = 3/7 | (B1-1) | 57000 | (E-1)/(F-1) = 9/1 | 6/4 |
| 283 | (7-1-16) | 3% | CTM-7 | (B1-1) | 57000 | (E-5)/(F-2) = 9/1 | 6/4 |
| 284 | (7-1-16) | 3% | CTM-1/CTM-7 = 5/5 | (B1-1) | 14000 | (E-5)/(F-2) = 9/1 | 6/4 |
| 285 | (7-1-16) | 3% | CTM-1/CTM-7 = 5/5 | (B1-1) | 120000 | (E-4) | 6/4 |
| 286 | (7-1-16) | 3% | CTM-1/CTM-7 = 5/5 | (B1-2) | 55000 | (E-5)/(F-1) = 9/1 | 6/4 |
| 287 | (7-1-16) | 3% | CTM-1/CTM-7 = 5/5 | (B1-3) | 53000 | (E-4)/(F-2) = 9/1 | 6/4 |
| 288 | (7-1-16) | 3% | CTM-1/CTM-7 = 5/5 | (B1-2)/(B1-3) = 3/7 | 55000 | (E-1) | 6/4 |
| 289 | (7-1-16) | 3% | CTM-1/CTM-7 = 5/5 | (B1-2)/(B1-3) = 5/5 | 55000 | (E-4)/(F-2) = 9/1 | 6/4 |
| 290 | (7-1-16) | 3% | CTM-1/CTM-7 = 5/5 | (B1-2)/(B1-3) = 7/3 | 55000 | (E-1) | 6/4 |
| 291 | (7-1-16) | 3% | CTM-1/CTM-7 = 5/5 | (B2-1) | 120000 | (E-5) | 6/4 |
| 292 | (7-1-16) | 3% | CTM-1/CTM-7 = 5/5 | (B2-2) | 120000 | (E-1) | 6/4 |
| 293 | (7-1-16) | 3% | CTM-1/CTM-7 = 5/5 | (B2-1)/(B2-2) = 7/3 | 120000 | (E-4) | 6/4 |
| 294 | (7-1-16) | 3% | CTM-1/CTM-7 = 5/5 | (B1-1) | 57000 | (E-4) | 6/4 |
| 295 | (7-1-16) | 3% | CTM-1/CTM-7 = 5/5 | (B1-1) | 57000 | (E-5)/(F-1) = 9/1 | 6/4 |
| 296 | (7-1-16) | 3% | CTM-1/CTM-7 = 5/5 | (B1-1) | 57000 | (F-1) | 6/4 |

TABLE 14

| Example | Evaluation of solution stability: Immediately after preparation: Visual observation | Immediately after preparation: Average particle diameter | Leaving for 2 weeks and stirring: Visual observation | Leaving for 2 weeks and stirring: Average particle diameter |
|---|---|---|---|---|
| 1 | Uniform and semi-transparent | 2.2 μm | Uniform and semi-transparent | 2.5 μm |
| 2 | Uniform and transparent | 1.1 μm | Uniform and transparent | 1.3 μm |
| 3 | Uniform and transparent | 0.9 μm | Uniform and transparent | 1.0 μm |
| 4 | Uniform and semi-transparent | 2.1 μm | Uniform and semi-transparent | 2.4 μm |
| 5 | Uniform and transparent | 0.8 μm | Uniform and transparent | 0.9 μm |
| 6 | Uniform and transparent | 0.8 μm | Uniform and transparent | 0.9 μm |
| 7 | Uniform and transparent | 1.2 μm | Uniform and transparent | 1.4 μm |
| 8 | Uniform and semi-transparent | 2.4 μm | Uniform and semi-transparent | 2.7 μm |
| 9 | Uniform and transparent | 1.2 μm | Uniform and transparent | 1.3 μm |
| 10 | Uniform and transparent | 1.0 μm | Uniform and transparent | 1.2 μm |
| 11 | Uniform and transparent | 1.4 μm | Uniform and transparent | 1.5 μm |
| 12 | Uniform and transparent | 1.6 μm | Uniform and transparent | 1.8 μm |
| 13 | Uniform and transparent | 1.4 μm | Uniform and transparent | 1.5 μm |
| 14 | Uniform and semi-transparent | 2.0 μm | Uniform and semi-transparent | 2.3 μm |
| 15 | Uniform and transparent | 1.2 μm | Uniform and transparent | 1.4 μm |
| 16 | Uniform and transparent | 1.0 μm | Uniform and transparent | 1.3 μm |
| 17 | Uniform and transparent | 1.1 μm | Uniform and transparent | 1.3 μm |
| 18 | Uniform and transparent | 0.9 μm | Uniform and transparent | 1.0 μm |
| 19 | Uniform and semi-transparent | 2.1 μm | Uniform and semi-transparent | 2.3 μm |
| 20 | Uniform and transparent | 1.5 μm | Uniform and transparent | 1.7 μm |
| 21 | Uniform and transparent | 1.7 μm | Uniform and transparent | 1.8 μm |
| 22 | Uniform and semi-transparent | 2.4 μm | Uniform and semi-transparent | 2.6 μm |
| 23 | Uniform and transparent | 1.7 μm | Uniform and transparent | 1.8 μm |
| 24 | Uniform blue white | 4.1 μm | Uniform blue white | 4.5 μm |
| 25 | Uniform and semi-transparent | 3.7 μm | Uniform and semi-transparent | 3.9 μm |
| 26 | Uniform and semi-transparent | 3.4 μm | Uniform and semi-transparent | 3.7 μm |
| 27 | Uniform and semi-transparent | 3.1 μm | Uniform and semi-transparent | 3.4 μm |
| 28 | Uniform and semi-transparent | 3.2 μm | Uniform and semi-transparent | 3.4 μm |
| 29 | Uniform and semi-transparent | 3.1 μm | Uniform and semi-transparent | 3.3 μm |
| 30 | Uniform and semi-transparent | 3.2 μm | Uniform and semi-transparent | 3.4 μm |

TABLE 14-continued

| Example | Evaluation of solution stability: Immediately after preparation: Visual observation | Immediately after preparation: Average particle diameter | Leaving for 2 weeks and stirring: Visual observation | Leaving for 2 weeks and stirring: Average particle diameter |
|---|---|---|---|---|
| 31 | Uniform and semi-transparent | 3.2 μm | Uniform and semi-transparent | 3.4 μm |
| 32 | Uniform and semi-transparent | 3.2 μm | Uniform and semi-transparent | 3.5 μm |
| 33 | Uniform and semi-transparent | 3.7 μm | Uniform and semi-transparent | 3.9 μm |
| 34 | Uniform and semi-transparent | 3.4 μm | Uniform and semi-transparent | 3.7 μm |
| 35 | Uniform and semi-transparent | 2.5 μm | Uniform and semi-transparent | 2.8 μm |
| 36 | Uniform and transparent | 0.8 μm | Uniform and transparent | 0.9 μm |
| 37 | Uniform and transparent | 1.0 μm | Uniform and transparent | 1.1 μm |
| 38 | Uniform and transparent | 0.9 μm | Uniform and transparent | 1.0 μm |
| 39 | Uniform and semi-transparent | 2.4 μm | Uniform and semi-transparent | 2.7 μm |
| 40 | Uniform and transparent | 1.2 μm | Uniform and transparent | 1.3 μm |
| 41 | Uniform and transparent | 1.6 μm | Uniform and transparent | 1.8 μm |
| 42 | Uniform and transparent | 1.5 μm | Uniform and transparent | 1.6 μm |
| 43 | Uniform and semi-transparent | 2.8 μm | Uniform and semi-transparent | 3.0 μm |
| 44 | Uniform and transparent | 1 μm | Uniform and transparent | 1.1 μm |
| 45 | Uniform and semi-transparent | 2.3 μm | Uniform and semi-transparent | 2.5 μm |
| 46 | Uniform and transparent | 1.2 μm | Uniform and transparent | 1.3 μm |
| 47 | Uniform and semi-transparent | 2.7 μm | Uniform and semi-transparent | 2.8 μm |
| 48 | Uniform and transparent | 1.5 μm | Uniform and transparent | 1.6 μm |
| 49 | Uniform and transparent | 1.6 μm | Uniform and transparent | 1.8 μm |
| 50 | Uniform and semi-transparent | 2.6 μm | Uniform and semi-transparent | 2.8 μm |
| 51 | Uniform and transparent | 1.3 μm | Uniform and transparent | 1.4 μm |
| 52 | Uniform and transparent | 1.1 μm | Uniform and transparent | 1.2 μm |
| 53 | Uniform and transparent | 0.9 μm | Uniform and transparent | 1.0 μm |
| 54 | Uniform and semi-transparent | 2.4 μm | Uniform and semi-transparent | 2.5 μm |
| 55 | Uniform and transparent | 1.6 μm | Uniform and transparent | 1.8 μm |
| 56 | Uniform and semi-transparent | 2.2 μm | Uniform and semi-transparent | 2.4 μm |
| 57 | Uniform and semi-transparent | 2.7 μm | Uniform and semi-transparent | 3.0 μm |
| 58 | Uniform and transparent | 1.2 μm | Uniform and transparent | 1.4 μm |
| 59 | Uniform and semi-transparent | 2.4 μm | Uniform and semi-transparent | 2.7 μm |

TABLE 14-continued

| Example | Evaluation of solution stability: Immediately after preparation: Visual observation | Immediately after preparation: Average particle diameter | Leaving for 2 weeks and stirring: Visual observation | Leaving for 2 weeks and stirring: Average particle diameter |
|---|---|---|---|---|
| 60 | Uniform and semi-transparent | 2.6 μm | Uniform and semi-transparent | 2.8 μm |
| 61 | Uniform and semi-transparent | 2.3 μm | Uniform and semi-transparent | 2.5 μm |
| 62 | Uniform and semi-transparent | 2.2 μm | Uniform and semi-transparent | 2.4 μm |
| 63 | Uniform and transparent | 1.1 μm | Uniform and transparent | 1.3 μm |
| 64 | Uniform and transparent | 1.7 μm | Uniform and transparent | 1.9 μm |
| 65 | Uniform and transparent | 1.5 μm | Uniform and transparent | 1.6 μm |
| 66 | Uniform and semi-transparent | 2.4 μm | Uniform and semi-transparent | 2.6 μm |
| 67 | Uniform and transparent | 1.2 μm | Uniform and transparent | 1.3 μm |
| 68 | Uniform and semi-transparent | 2.1 μm | Uniform and semi-transparent | 2.3 μm |
| 69 | Uniform and semi-transparent | 2.6 μm | Uniform and semi-transparent | 2.8 μm |
| 70 | Uniform and transparent | 1.1 μm | Uniform and transparent | 1.3 μm |
| 71 | Uniform and transparent | 1.0 μm | Uniform and transparent | 1.1 μm |
| 72 | Uniform and semi-transparent | 2.8 μm | Uniform and semi-transparent | 3.0 μm |
| 73 | Uniform and transparent | 1.7 μm | Uniform and transparent | 1.9 μm |
| 74 | Uniform and transparent | 1.4 μm | Uniform and transparent | 1.5 μm |
| 75 | Uniform and semi-transparent | 2.6 μm | Uniform and semi-transparent | 2.8 μm |
| 76 | Uniform and transparent | 1.2 μm | Uniform and transparent | 1.3 μm |
| 77 | Uniform and semi-transparent | 2.9 μm | Uniform and semi-transparent | 3.1 μm |
| 78 | Uniform and transparent | 1.9 μm | Uniform and transparent | 2.0 μm |
| 79 | Uniform blue white | 4.3 μm | Uniform blue white | 4.6 μm |
| 80 | Uniform and transparent | 0.9 μm | Uniform and transparent | 1.0 μm |
| 81 | Uniform and transparent | 0.8 μm | Uniform and transparent | 0.9 μm |
| 82 | Uniform and transparent | 1.2 μm | Uniform and transparent | 1.4 μm |
| 83 | Uniform and transparent | 1.1 μm | Uniform and transparent | 1.3 μm |
| 84 | Uniform and transparent | 1.4 μm | Uniform and transparent | 1.6 μm |
| 85 | Uniform and transparent | 1.3 μm | Uniform and transparent | 1.3 μm |
| 86 | Uniform and transparent | 1.7 μm | Uniform and transparent | 1.8 μm |
| 87 | Uniform and transparent | 1.2 μm | Uniform and transparent | 1.3 μm |
| 88 | Uniform and transparent | 1.8 μm | Uniform and transparent | 1.9 μm |
| 89 | Uniform and transparent | 1.4 μm | Uniform and transparent | 1.5 μm |
| 90 | Uniform and transparent | 0.8 μm | Uniform and transparent | 0.9 μm |

TABLE 14-continued

| Example | Evaluation of solution stability: Immediately after preparation: Visual observation | Immediately after preparation: Average particle diameter | Leaving for 2 weeks and stirring: Visual observation | Leaving for 2 weeks and stirring: Average particle diameter |
|---|---|---|---|---|
| 91 | Uniform and transparent | 1.2 μm | Uniform and transparent | 1.4 μm |
| 92 | Uniform and semi-transparent | 3.5 μm | Uniform and semi-transparent | 3.9 μm |
| 93 | Uniform and semi-transparent | 3.2 μm | Uniform and semi-transparent | 3.5 μm |
| 94 | Uniform and semi-transparent | 3.4 μm | Uniform and semi-transparent | 3.6 μm |
| 95 | Uniform and semi-transparent | 3.2 μm | Uniform and semi-transparent | 3.5 μm |
| 96 | Uniform and semi-transparent | 3.2 μm | Uniform and semi-transparent | 3.5 μm |
| 97 | Uniform and transparent | 1.2 μm | Uniform and transparent | 1.4 μm |
| 98 | Uniform and transparent | 1.5 μm | Uniform and transparent | 1.6 μm |
| 99 | Uniform and semi-transparent | 2.3 μm | Uniform and semi-transparent | 2.5 μm |
| 100 | Uniform and semi-transparent | 2.5 μm | Uniform and semi-transparent | 2.6 μm |
| 101 | Uniform and semi-transparent | 2.4 μm | Uniform and semi-transparent | 2.6 μm |
| 102 | Uniform and transparent | 1.7 μm | Uniform and transparent | 1.9 μm |
| 103 | Uniform and semi-transparent | 2.7 μm | Uniform and semi-transparent | 3.0 μm |
| 104 | Uniform and transparent | 1.3 μm | Uniform and transparent | 1.5 μm |
| 105 | Uniform and semi-transparent | 2.5 μm | Uniform and semi-transparent | 2.8 μm |
| 106 | Uniform and transparent | 0.8 μm | Uniform and transparent | 0.9 μm |
| 107 | Uniform and semi-transparent | 2.4 μm | Uniform and semi-transparent | 2.6 μm |
| 108 | Uniform and transparent | 1.1 μm | Uniform and transparent | 1.2 μm |
| 109 | Uniform and transparent | 1.0 μm | Uniform and transparent | 1.0 μm |
| 110 | Uniform and semi-transparent | 2.7 μm | Uniform and semi-transparent | 2.8 μm |
| 111 | Uniform and transparent | 1.4 μm | Uniform and transparent | 1.5 μm |
| 112 | Uniform and semi-transparent | 2.8 μm | Uniform and semi-transparent | 3.0 μm |
| 113 | Uniform and semi-transparent | 2.2 μm | Uniform and semi-transparent | 2.3 μm |
| 114 | Uniform and transparent | 1.7 μm | Uniform and transparent | 1.9 μm |
| 115 | Uniform and semi-transparent | 2.4 μm | Uniform and semi-transparent | 2.7 μm |
| 116 | Uniform and semi-transparent | 2.1 μm | Uniform and semi-transparent | 2.4 μm |
| 117 | Uniform and semi-transparent | 2.7 μm | Uniform and semi-transparent | 2.9 μm |

TABLE 14-continued

| Example | Evaluation of solution stability: Immediately after preparation: Visual observation | Immediately after preparation: Average particle diameter | Leaving for 2 weeks and stirring: Visual observation | Leaving for 2 weeks and stirring: Average particle diameter |
|---|---|---|---|---|
| 118 | Uniform and transparent | 0.9 μm | Uniform and transparent | 1.0 μm |
| 119 | Uniform and semi-transparent | 2.6 μm | Uniform and semi-transparent | 2.8 μm |
| 120 | Uniform and semi-transparent | 2.5 μm | Uniform and semi-transparent | 2.8 μm |
| 121 | Uniform and transparent | 1.2 μm | Uniform and transparent | 1.4 μm |
| 122 | Uniform and semi-transparent | 2.2 μm | Uniform and semi-transparent | 2.5 μm |
| 123 | Uniform and transparent | 1.5 μm | Uniform and transparent | 1.8 μm |
| 124 | Uniform and transparent | 1.6 μm | Uniform and transparent | 1.9 μm |
| 125 | Uniform and transparent | 0.8 μm | Uniform and transparent | 0.9 μm |
| 126 | Uniform and semi-transparent | 2.3 μm | Uniform and semi-transparent | 2.5 μm |
| 127 | Uniform and transparent | 1.2 μm | Uniform and transparent | 1.4 μm |
| 128 | Uniform and transparent | 1.1 μm | Uniform and transparent | 1.2 μm |
| 129 | Uniform and semi-transparent | 2.6 μm | Uniform and semi-transparent | 2.8 μm |
| 130 | Uniform and transparent | 1.7 μm | Uniform and transparent | 1.9 μm |
| 131 | Uniform and transparent | 1.2 μm | Uniform and transparent | 1.4 μm |
| 132 | Uniform blue white | 4.3 μm | Uniform blue white | 4.6 μm |
| 133 | Uniform and semi-transparent | 3.6 μm | Uniform and semi-transparent | 3.9 μm |
| 134 | Uniform and semi-transparent | 3.3 μm | Uniform and semi-transparent | 3.5 μm |
| 135 | Uniform and semi-transparent | 3.1 μm | Uniform and semi-transparent | 3.3 μm |
| 136 | Uniform and semi-transparent | 3.7 μm | Uniform and semi-transparent | 3.8 μm |
| 137 | Uniform and transparent | 1.5 μm | Uniform and transparent | 1.6 μm |
| 138 | Uniform and transparent | 1.2 μm | Uniform and transparent | 1.3 μm |
| 139 | Uniform and semi-transparent | 2.5 μm | Uniform and semi-transparent | 2.7 μm |
| 140 | Uniform and transparent | 0.9 μm | Uniform and transparent | 1.0 μm |
| 141 | Uniform and semi-transparent | 2.2 μm | Uniform and semi-transparent | 2.4 μm |
| 142 | Uniform and transparent | 1.7 μm | Uniform and transparent | 1.9 μm |
| 143 | Uniform and semi-transparent | 2.3 μm | Uniform and semi-transparent | 2.6 μm |
| 144 | Uniform and transparent | 1.9 μm | Uniform and transparent | 2.1 μm |
| 145 | Uniform and semi-transparent | 2.6 μm | Uniform and semi-transparent | 2.9 μm |
| 146 | Uniform and semi-transparent | 2.8 μm | Uniform and semi-transparent | 3.0 μm |

TABLE 14-continued

| Example | Evaluation of solution stability: Immediately after preparation: Visual observation | Immediately after preparation: Average particle diameter | Leaving for 2 weeks and stirring: Visual observation | Leaving for 2 weeks and stirring: Average particle diameter |
|---|---|---|---|---|
| 147 | Uniform and transparent | 1.3 μm | Uniform and transparent | 1.5 μm |
| 148 | Uniform and transparent | 0.8 μm | Uniform and transparent | 0.9 μm |
| 149 | Uniform and semi-transparent | 2.1 μm | Uniform and semi-transparent | 2.3 μm |
| 150 | Uniform and transparent | 1.1 μm | Uniform and transparent | 1.3 μm |

TABLE 15

| Example | Evaluation of solution stability: Immediately after preparation: Visual observation | Immediately after preparation: Average particle diameter | Leaving for 2 weeks and stirring: Visual observation | Leaving for 2 weeks and stirring: Average particle diameter |
|---|---|---|---|---|
| 151 | Uniform and transparent | 1.0 μm | Uniform and transparent | 1.2 μm |
| 152 | Uniform and semi-transparent | 2.3 μm | Uniform and semi-transparent | 2.6 μm |
| 153 | Uniform and transparent | 0.9 μm | Uniform and transparent | 1.1 μm |
| 154 | Uniform and semi-transparent | 2.6 μm | Uniform and semi-transparent | 2.9 μm |
| 155 | Uniform and transparent | 1.4 μm | Uniform and transparent | 1.5 μm |
| 156 | Uniform and transparent | 1.3 μm | Uniform and transparent | 1.4 μm |
| 157 | Uniform and transparent | 2.4 μm | Uniform and transparent | 2.8 μm |
| 158 | Uniform and transparent | 1.2 μm | Uniform and transparent | 1.3 μm |
| 159 | Uniform and semi-transparent | 2.2 μm | Uniform and semi-transparent | 2.4 μm |
| 160 | Uniform blue white | 4.3 μm | Uniform blue white | 4.5 μm |
| 161 | Uniform and semi-transparent | 3.5 μm | Uniform and semi-transparent | 3.8 μm |
| 162 | Uniform and semi-transparent | 3.3 μm | Uniform and semi-transparent | 3.5 μm |
| 163 | Uniform and semi-transparent | 3.0 μm | Uniform and semi-transparent | 3.2 μm |
| 164 | Uniform and semi-transparent | 3.5 μm | Uniform and semi-transparent | 3.9 μm |
| 165 | Uniform and semi-transparent | 3.6 μm | Uniform and semi-transparent | 3.8 μm |
| 166 | Uniform and transparent | 1.7 μm | Uniform and transparent | 1.9 μm |
| 167 | Uniform and transparent | 1.2 μm | Uniform and transparent | 1.4 μm |
| 168 | Uniform and transparent | 1.5 μm | Uniform and transparent | 1.7 μm |
| 169 | Uniform and transparent | 1.3 μm | Uniform and transparent | 1.6 μm |

TABLE 15-continued

| Example | Evaluation of solution stability: Immediately after preparation: Visual observation | Immediately after preparation: Average particle diameter | Leaving for 2 weeks and stirring: Visual observation | Leaving for 2 weeks and stirring: Average particle diameter |
|---|---|---|---|---|
| 170 | Uniform and semi-transparent | 2.6 μm | Uniform and semi-transparent | 2.9 μm |
| 171 | Uniform and transparent | 0.9 μm | Uniform and transparent | 1.1 μm |
| 172 | Uniform and transparent | 1.8 μm | Uniform and transparent | 1.9 μm |
| 173 | Uniform and transparent | 1.6 μm | Uniform and transparent | 1.8 μm |
| 174 | Uniform and transparent | 1.4 μm | Uniform and transparent | 1.6 μm |
| 175 | Uniform and transparent | 1.5 μm | Uniform and transparent | 1.6 μm |
| 176 | Uniform and transparent | 1.0 μm | Uniform and transparent | 1.2 μm |
| 177 | Uniform and semi-transparent | 2.4 μm | Uniform and semi-transparent | 2.7 μm |
| 178 | Uniform and transparent | 0.8 μm | Uniform and transparent | 0.9 μm |
| 179 | Uniform and transparent | 1.4 μm | Uniform and transparent | 1.6 μm |
| 180 | Uniform and transparent | 1.8 μm | Uniform and transparent | 2.0 μm |
| 181 | Uniform and transparent | 1.1 μm | Uniform and transparent | 1.3 μm |
| 182 | Uniform and semi-transparent | 2.7 μm | Uniform and semi-transparent | 3.0 μm |
| 183 | Uniform and transparent | 1.9 μm | Uniform and transparent | 2.0 μm |
| 184 | Uniform and transparent | 1.8 μm | Uniform and transparent | 1.9 μm |
| 185 | Uniform and transparent | 2.4 μm | Uniform and transparent | 2.7 μm |
| 186 | Uniform and transparent | 1.3 μm | Uniform and transparent | 1.4 μm |
| 187 | Uniform and transparent | 1.6 μm | Uniform and transparent | 1.7 μm |
| 188 | Uniform and semi-transparent | 2.5 μm | Uniform and semi-transparent | 2.7 μm |
| 189 | Uniform blue white | 4.1 μm | Uniform blue white | 4.4 μm |
| 190 | Uniform and semi-transparent | 3.8 μm | Uniform and semi-transparent | 3.9 μm |
| 191 | Uniform and semi-transparent | 3.6 μm | Uniform and semi-transparent | 3.8 μm |
| 192 | Uniform and semi-transparent | 3.4 μm | Uniform and semi-transparent | 3.5 μm |
| 193 | Uniform and semi-transparent | 3.2 μm | Uniform and semi-transparent | 3.4 μm |
| 194 | Uniform and semi-transparent | 3.7 μm | Uniform and semi-transparent | 3.9 μm |
| 195 | Uniform and semi-transparent | 3.5 μm | Uniform and semi-transparent | 3.8 μm |
| 196 | Uniform and transparent | 1.2 μm | Uniform and transparent | 1.4 μm |
| 197 | Uniform and transparent | 1.5 μm | Uniform and transparent | 1.6 μm |
| 198 | Uniform and transparent | 1.3 μm | Uniform and transparent | 1.4 μm |
| 199 | Uniform and transparent | 1.7 μm | Uniform and transparent | 1.8 μm |

TABLE 15-continued

| Example | Evaluation of solution stability: Immediately after preparation: Visual observation | Immediately after preparation: Average particle diameter | Leaving for 2 weeks and stirring: Visual observation | Leaving for 2 weeks and stirring: Average particle diameter |
|---|---|---|---|---|
| 200 | Uniform and transparent | 0.9 μm | Uniform and transparent | 1.0 μm |
| 201 | Uniform and semi-transparent | 2.7 μm | Uniform and semi-transparent | 2.9 μm |
| 202 | Uniform and transparent | 1.8 μm | Uniform and transparent | 1.9 μm |
| 203 | Uniform and transparent | 1.7 μm | Uniform and transparent | 1.8 μm |
| 204 | Uniform and transparent | 1.2 μm | Uniform and transparent | 1.4 μm |
| 205 | Uniform and transparent | 1.5 μm | Uniform and transparent | 1.6 μm |
| 206 | Uniform and transparent | 1.6 μm | Uniform and transparent | 1.7 μm |
| 207 | Uniform and transparent | 1.2 μm | Uniform and transparent | 1.3 μm |
| 208 | Uniform and transparent | 1.0 μm | Uniform and transparent | 1.1 μm |
| 209 | Uniform and transparent | 1.1 μm | Uniform and transparent | 1.2 μm |
| 210 | Uniform and transparent | 1.3 μm | Uniform and transparent | 1.5 μm |
| 211 | Uniform and transparent | 0.9 μm | Uniform and transparent | 1.0 μm |
| 212 | Uniform and transparent | 1.9 μm | Uniform and transparent | 2.1 μm |
| 213 | Uniform and semi-transparent | 2.5 μm | Uniform and semi-transparent | 2.7 μm |
| 214 | Uniform and transparent | 1.7 μm | Uniform and transparent | 1.9 μm |
| 215 | Uniform and semi-transparent | 2.4 μm | Uniform and semi-transparent | 2.6 μm |
| 216 | Uniform and transparent | 1.0 μm | Uniform and transparent | 1.1 μm |
| 217 | Uniform and transparent | 1.2 μm | Uniform and transparent | 1.4 μm |
| 218 | Uniform and transparent | 1.4 μm | Uniform and transparent | 1.6 μm |
| 219 | Uniform blue white | 4.3 μm | Uniform blue white | 4.8 μm |
| 220 | Uniform and semi-transparent | 3.8 μm | Uniform and semi-transparent | 4.0 μm |
| 221 | Uniform and semi-transparent | 3.4 μm | Uniform and semi-transparent | 3.6 μm |
| 222 | Uniform and semi-transparent | 3.2 μm | Uniform and semi-transparent | 3.5 μm |
| 223 | Uniform and semi-transparent | 3.3 μm | Uniform and semi-transparent | 3.5 μm |
| 224 | Uniform and semi-transparent | 3.4 μm | Uniform and semi-transparent | 3.6 μm |
| 225 | Uniform and transparent | 1.5 μm | Uniform and transparent | 1.7 μm |
| 226 | Uniform and transparent | 1.3 μm | Uniform and transparent | 1.4 μm |
| 227 | Uniform and transparent | 1.8 μm | Uniform and transparent | 2.0 μm |
| 228 | Uniform and transparent | 1.2 μm | Uniform and transparent | 1.3 μm |
| 229 | Uniform and semi-transparent | 2.8 μm | Uniform and semi-transparent | 3.0 μm |

TABLE 15-continued

| Example | Evaluation of solution stability: Immediately after preparation: Visual observation | Immediately after preparation: Average particle diameter | Leaving for 2 weeks and stirring: Visual observation | Leaving for 2 weeks and stirring: Average particle diameter |
|---|---|---|---|---|
| 230 | Uniform and semi-transparent | 2.5 μm | Uniform and semi-transparent | 2.7 μm |
| 231 | Uniform and transparent | 1.1 μm | Uniform and transparent | 1.2 μm |
| 232 | Uniform and transparent | 1.4 μm | Uniform and transparent | 1.6 μm |
| 233 | Uniform and semi-transparent | 2.6 μm | Uniform and semi-transparent | 2.8 μm |
| 234 | Uniform and transparent | 0.9 μm | Uniform and transparent | 1.0 μm |
| 235 | Uniform and transparent | 1.4 μm | Uniform and transparent | 1.5 μm |
| 236 | Uniform and semi-transparent | 2.7 μm | Uniform and semi-transparent | 2.9 μm |
| 237 | Uniform and transparent | 1.2 μm | Uniform and transparent | 1.4 μm |
| 238 | Uniform and semi-transparent | 2.3 μm | Uniform and semi-transparent | 2.5 μm |
| 239 | Uniform and transparent | 1.1 μm | Uniform and transparent | 1.2 μm |
| 240 | Uniform and semi-transparent | 2.6 μm | Uniform and semi-transparent | 2.8 μm |
| 241 | Uniform and transparent | 1.5 μm | Uniform and transparent | 1.6 μm |
| 242 | Uniform and transparent | 1.7 μm | Uniform and transparent | 1.8 μm |
| 243 | Uniform and semi-transparent | 2.4 μm | Uniform and semi-transparent | 2.6 μm |
| 244 | Uniform and transparent | 1.1 μm | Uniform and transparent | 1.2 μm |
| 245 | Uniform and semi-transparent | 2.6 μm | Uniform and semi-transparent | 2.9 μm |
| 246 | Uniform and transparent | 1.3 μm | Uniform and transparent | 1.4 μm |
| 247 | Uniform and transparent | 1.3 μm | Uniform and transparent | 1.4 μm |
| 248 | Uniform blue white | 4.4 μm | Uniform blue white | 4.8 μm |
| 249 | Uniform and transparent | 1.7 μm | Uniform and transparent | 1.9 μm |
| 250 | Uniform and transparent | 1.5 μm | Uniform and transparent | 1.6 μm |
| 251 | Uniform and transparent | 1.1 μm | Uniform and transparent | 1.2 μm |
| 252 | Uniform and transparent | 1.8 μm | Uniform and transparent | 2.μm |
| 253 | Uniform and semi-transparent | 2.5 μm | Uniform and semi-transparent | 2.8 μm |
| 254 | Uniform and transparent | 1.3 μm | Uniform and transparent | 1.4 μm |
| 255 | Uniform and transparent | 1.1 μm | Uniform and transparent | 1.2 μm |
| 256 | Uniform and transparent | 1.0 μm | Uniform and transparent | 1.1 μm |
| 257 | Uniform and semi-transparent | 2.7 μm | Uniform and semi-transparent | 2.9 μm |
| 258 | Uniform and semi-transparent | 2.3 μm | Uniform and semi-transparent | 2.6 μm |
| 259 | Uniform and transparent | 1.5 μm | Uniform and transparent | 1.6 μm |

TABLE 15-continued

| Example | Evaluation of solution stability: Immediately after preparation: Visual observation | Immediately after preparation: Average particle diameter | Leaving for 2 weeks and stirring: Visual observation | Leaving for 2 weeks and stirring: Average particle diameter |
|---|---|---|---|---|
| 260 | Uniform and transparent | 1.7 μm | Uniform and transparent | 1.8 μm |
| 261 | Uniform and transparent | 1.6 μm | Uniform and transparent | 1.7 μm |
| 262 | Uniform and transparent | 1.4 μm | Uniform and transparent | 1.5 μm |
| 263 | Uniform and transparent | 1.2 μm | Uniform and transparent | 1.4 μm |
| 264 | Uniform and semi-transparent | 2.1 μm | Uniform and semi-transparent | 2.4 μm |
| 265 | Uniform and semi-transparent | 2.7 μm | Uniform and semi-transparent | 3.0 μm |
| 266 | Uniform and transparent | 1.8 μm | Uniform and transparent | 2.0 μm |
| 267 | Uniform and transparent | 1.9 μm | Uniform and transparent | 2.0 μm |
| 268 | Uniform and transparent | 1.1 μm | Uniform and transparent | 1.2 μm |
| 269 | Uniform and semi-transparent | 2.3 μm | Uniform and semi-transparent | 2.4 μm |
| 270 | Uniform and semi-transparent | 2.7 μm | Uniform and semi-transparent | 2.9 μm |
| 271 | Uniform blue white | 4.5 μm | Uniform blue white | 4.8 μm |
| 272 | Uniform and transparent | 1.1 μm | Uniform and transparent | 1.2 μm |
| 273 | Uniform and transparent | 1.5 μm | Uniform and transparent | 1.7 μm |
| 274 | Uniform and transparent | 1.3 μm | Uniform and transparent | 1.4 μm |
| 275 | Uniform and transparent | 1.5 μm | Uniform and transparent | 1.6 μm |
| 276 | Uniform and transparent | 0.9 μm | Uniform and transparent | 1.0 μm |
| 277 | Uniform and semi-transparent | 2.4 μm | Uniform and semi-transparent | 2.7 μm |
| 278 | Uniform and transparent | 1.7 μm | Uniform and transparent | 1.8 μm |
| 279 | Uniform and transparent | 1.8 μm | Uniform and transparent | 2.0 μm |
| 280 | Uniform and transparent | 1.5 μm | Uniform and transparent | 1.7 μm |
| 281 | Uniform and semi-transparent | 2.7 μm | Uniform and semi-transparent | 2.9 μm |
| 282 | Uniform and transparent | 1.4 μm | Uniform and transparent | 1.5 μm |
| 283 | Uniform and transparent | 1.4 μm | Uniform and transparent | 1.5 μm |
| 284 | Uniform and transparent | 1.2 μm | Uniform and transparent | 1.4 μm |
| 285 | Uniform and semi-transparent | 2.2 μm | Uniform and semi-transparent | 2.5 μm |
| 286 | Uniform and transparent | 1.5 μm | Uniform and transparent | 1.6 μm |
| 287 | Uniform and transparent | 1.7 μm | Uniform and transparent | 1.4 μm |
| 288 | Uniform and semi-transparent | 2.3 μm | Uniform and semi-transparent | 2.5 μm |
| 289 | Uniform and transparent | 1.3 μm | Uniform and transparent | 1.5 μm |
| 290 | Uniform and semi-transparent | 2.5 μm | Uniform and semi-transparent | 2.8 μm |

TABLE 15-continued

| | Evaluation of solution stability | | | |
|---|---|---|---|---|
| | Immediately after preparation | | Leaving for 2 weeks and stirring | |
| Example | Visual observation | Average particle diameter | Visual observation | Average particle diameter |
| 291 | Uniform and semi-transparent | 2.8 μm | Uniform and semi-transparent | 3.0 μm |
| 292 | Uniform and semi-transparent | 2.4 μm | Uniform and semi-transparent | 2.6 μm |
| 293 | Uniform and semi-transparent | 2.1 μm | Uniform and semi-transparent | 2.3 μm |
| 294 | Uniform and semi-transparent | 2.9 μm | Uniform and semi-transparent | 3.0 μm |
| 295 | Uniform and transparent | 1.2 μm | Uniform and transparent | 1.5 μm |
| 296 | Uniform blue white | 4.2 μm | Uniform blue white | 4.6 μm |
| 297 | Uniform and transparent | 0.8 μm | Uniform and transparent | 1.0 μm |
| 298 | Uniform and transparent | 0.9 μm | Uniform and transparent | 1.1 μm |
| 299 | Uniform and transparent | 0.9 μm | Uniform and transparent | 1.1 μm |
| 300 | Uniform and transparent | 0.8 μm | Uniform and transparent | 1.0 μm |
| 701 | Uniform and transparent | 0.9 μm | Uniform and transparent | 1.0 μm |

TABLE 16

| | Evaluation of solution stability | | | |
|---|---|---|---|---|
| | Immediately after preparation | | Leaving for 2 weeks and stirring | |
| Comparative Example | Visual observation | Average particle diameter | Visual observation | Average particle diameter |
| Comparative Example 1 | Sedimented, coalesced | 17.7 μm | Sedimented, coalesced | 76.2 μm |
| Comparative Example 2 | Sedimented, coalesced | 16.9 μm | Sedimented, coalesced | 78.3 μm |
| Comparative Example 3 | Sedimented, coalesced | 19.2 μm | Sedimented, coalesced | 76.7 μm |
| Comparative Example 4 | Sedimented, coalesced | 16.8 μm | Sedimented, coalesced | 82.4 μm |
| Comparative Example 5 | Sedimented, coalesced | 15.7 μm | Sedimented, coalesced | 75.7 μm |
| Comparative Example 6 | Sedimented, coalesced | 16.5 μm | Sedimented, coalesced | 76.4 μm |

In Tables 7 to 13, each of the contents of the fluorine-atom-containing polyacrylate, the fluorine-atom-containing polymethacrylate, the polycarbonate having a siloxane bond, the polyester having a siloxane bond, the polystyrene having a siloxane bond, the compound represented by the formula (5), the compound represented by the formula (6), and the compound represented by the formula (7) is a content thereof based on the charge transporting substance and binder resin (% by mass).

By comparison of Examples with Comparative Examples, in the production method in which the solution containing the charge transporting substance and at least one compound selected from the group consisting of the fluorine-atom-containing polyacrylate, the fluorine-atom-containing polymethacrylate, the polycarbonate having a siloxane bond, the polyester having a siloxane bond, the polystyrene having a siloxane bond, the silicone oil, the polyolefin, the aliphatic acid, the aliphatic acid amide, and the aliphatic acid ester is prepared, and the emulsion is prepared using the solution and water, the state of the emulsion is stably kept during preservation for a long time, and the same state of that of the emulsion immediately after preparation is kept. In the conventional emulsion described in Japanese Patent Application Laid-Open No. 2011-128213, however, by addition of the surfactant, the oil droplets containing the charge transporting substance and the binder resin are relatively stable immediately after the emulsion is prepared, but the oil droplets may coalesce after long-term preservation, leading to aggregation. A method for increasing the content of the surfactant to suppress coalescence is thought, but usually, the surfactant easily results in reduction in the electrophotographic properties. Accordingly, the method is not considered desirable.

In the method according to the present invention in which the solution containing the charge transporting substance and the compound that reduces the surface energy is prepared, and the emulsion is prepared, the compound that reduces the surface energy exists on the surfaces of the oil droplets. For this reason, the surface energy can be reduced, and occurrence of aggregation of the oil droplets can be significantly suppressed compared to the case where the compound that reduces the surface energy is not used. This method provides long-term solution stability of the emulsion, and the emulsion is useful as the coating solution for the electrophotographic photosensitive member.

An aluminum cylinder having a diameter of 30 mm and a length of 260.5 mm was used as the support (electrically conductive support). Next, 10 parts of $SnO_2$ coated barium sulfate (conductive particle), 2 parts of titanium oxide (pigment for adjusting resistance), 6 parts of a phenol resin, and 0.001 parts of a silicone oil (leveling agent) were dissolved using a mixed solvent of 4 parts of methanol and 16 parts of methoxypropanol to prepare a coating solution for an electrically conductive layer. The coating solution for an electrically conductive layer was applied onto the aluminum cylinder by dip coating. The obtained coat was cured (thermally cured) at 140° C. for 30 minutes to form an electrically conductive layer having a film thickness of 15 μm.

Next, 3 parts of N-methoxymethylated nylon and 3 parts of a copolymerized nylon were dissolved in a mixed solvent of 65 parts of methanol and 30 parts of n-butanol to prepare a coating solution for an undercoat layer. The coating solution for an undercoat layer was applied onto the electrically conductive layer by dip coating. The obtained coat was dried at 100° C. for 10 minutes to form an undercoat layer having a film thickness of 0.7 μm.

Next, 10 parts of a crystalline hydroxy gallium phthalocyanine (charge generating substance) having strong peaks at Bragg angles (2θ±0.2°) of 7.5°, 9.9°, 16.3°, 18.6°, 25.1°, and 28.3° in CuKα properties X ray diffraction was prepared. 250 parts of cyclohexanone and 5 parts of a polyvinyl butyral (trade name: S-LEC BX-1, made by Sekisui Chemical Co., Ltd.) were mixed with the hydroxy gallium phthalocyanine, and dispersed for 1 hour under an atmosphere of 23±3° C. using a sand mill apparatus having glass beads whose diameter was 1 mm. After dispersion, 250 parts of ethyl acetate was added to prepare a coating solution for a charge generating layer. The coating solution for a charge generating layer was applied onto the undercoat layer by dip coating. The obtained coat was dried at 100° C. for 10 minutes to form a charge generating layer having a film thickness of 0.26 μm.

Next, as the coating solution for a charge transporting layer, the emulsion prepared in Example 1 was applied onto the charge generating layer by dip coating to form a coat of the emulsion. The obtained coat was heated at 130° C. for 1 hour to form a charge transporting layer having a film thickness of 20 μm. Thus, an electrophotographic photosensitive member was produced. The used emulsion and the heating condition for the coat formed by applying the emulsion are shown in Table 17. The emulsion used for dip coating was left as it was for 2 weeks (under an environment of the temperature of 23° C. and humidity of 50% RH), and stirred at 1,000 turns/min for 3 minutes by a homogenizer.

Next, evaluations will be described.

<Evaluation of Uniformity of Coat (Coat Uniformity)>

A place 130 mm from the upper end of the surface of the electrophotographic photosensitive member was measured using a surface roughness measuring apparatus (SURFCORDER SE-3400, made by Kosaka Laboratory Ltd.), and evaluation was made according to evaluation of the ten-point height of irregularities (Rzjis) according to JIS B 0601:2001 (evaluation length of 10 mm). The results are shown in Table 17.

<Evaluation of Image>

In a laser beam printer LBP-2510 made by Canon Inc., the charge potential (dark potential) of the electrophotographic photosensitive member and the exposure amount (image exposure amount) of a laser light source at 780 nm were modified such that the light amount on the surface of the electrophotographic photosensitive member was 0.3 μJ/cm$^2$. The thus-modified laser beam printer LBP-2510 was used. Evaluation was made under an environment of the temperature of 23° C. and relative humidity of 15% RH. In evaluation of an image, an A4 size normal paper was used, and a halftone image of a single color was output. The output image was visually evaluated on the criterion below. The results are shown in Table 17.

Rank A: a totally uniform image is found
Rank B: very slight unevenness is found in an image
Rank C: unevenness is found in an image
Rank D: remarkable unevenness is found in an image

Examples 302 to 600

An electrophotographic photosensitive member was produced by the same method as that in Example 301 except that the emulsion used in formation of the charge transporting layer was changed to the emulsion shown in Tables 17 and 18. The electrophotographic photosensitive member was evaluated by the same method as that in Example 301. The results are shown in Tables 17 and 18.

Example 801

An electrophotographic photosensitive member was produced by the same method as that in Example 301 except that the emulsion used in formation of the charge transporting layer was changed to the emulsion described in Example 701. The electrophotographic photosensitive member was evaluated by the same method as that in Example 301. The results are shown in Table 18.

Comparative Examples 7 to 12

An electrophotographic photosensitive member was produced by the same method as that in Example 301 except that the emulsion used in formation of the charge transporting layer was changed to the emulsion shown in Table 19. The electrophotographic photosensitive member was evaluated by the same method as that in Example 301. The results are shown in Table 19. Gentle depressions and projections were formed on the obtained electrophotographic photosensitive member, and unevenness of the image corresponding to the depressions and projections was detected as the image.

Comparative Examples 13 and 14

An electrophotographic photosensitive member was produced by the same method as that in Example 301 except that the prepared emulsion was not left for 2 weeks in Example 301, and was immediately applied by dip coating, the emulsion was used in formation shown in Table 19, and the heating condition for the coat formed by applying the emulsion was changed as shown in Table 19. The electrophotographic photosensitive member was evaluated by the same method as that in Example 301. The results are shown in Table 19. Gentle depressions and projections were formed on the obtained electrophotographic photosensitive member, and unevenness of the image corresponding to the depressions and projections was detected as the image.

TABLE 17

| Example | Emulsion | Heating condition: Temperature | Heating condition: Time | Evaluation of uniformity of coat | Evaluation of image |
|---|---|---|---|---|---|
| 301 | Example 1 | 130° C. | 60 Minutes | 0.49 | A |
| 302 | Example 2 | 130° C. | 60 Minutes | 0.57 | A |
| 303 | Example 3 | 130° C. | 60 Minutes | 0.60 | A |
| 304 | Example 4 | 130° C. | 60 Minutes | 0.45 | A |
| 305 | Example 5 | 130° C. | 60 Minutes | 0.55 | A |
| 306 | Example 6 | 130° C. | 60 Minutes | 0.50 | A |
| 307 | Example 7 | 130° C. | 60 Minutes | 0.47 | A |
| 308 | Example 8 | 130° C. | 60 Minutes | 0.49 | A |
| 309 | Example 9 | 130° C. | 60 Minutes | 0.49 | A |
| 310 | Example 10 | 130° C. | 60 Minutes | 0.54 | A |
| 311 | Example 11 | 130° C. | 60 Minutes | 0.50 | A |
| 312 | Example 12 | 130° C. | 60 Minutes | 0.46 | A |
| 313 | Example 13 | 130° C. | 60 Minutes | 0.48 | A |
| 314 | Example 14 | 130° C. | 60 Minutes | 0.58 | A |
| 315 | Example 15 | 130° C. | 60 Minutes | 0.59 | A |
| 316 | Example 16 | 130° C. | 60 Minutes | 0.55 | A |
| 317 | Example 17 | 130° C. | 60 Minutes | 0.56 | A |
| 318 | Example 18 | 130° C. | 60 Minutes | 0.52 | A |
| 319 | Example 19 | 130° C. | 60 Minutes | 0.49 | A |
| 320 | Example 20 | 130° C. | 60 Minutes | 0.58 | A |
| 321 | Example 21 | 130° C. | 60 Minutes | 0.60 | A |
| 322 | Example 22 | 130° C. | 60 Minutes | 0.51 | A |
| 323 | Example 23 | 130° C. | 60 Minutes | 0.57 | A |
| 324 | Example 24 | 130° C. | 60 Minutes | 0.66 | B |
| 325 | Example 25 | 130° C. | 60 Minutes | 0.68 | A |
| 326 | Example 26 | 130° C. | 60 Minutes | 0.68 | A |
| 327 | Example 27 | 130° C. | 60 Minutes | 0.66 | B |
| 328 | Example 28 | 130° C. | 60 Minutes | 0.62 | A |
| 329 | Example 29 | 130° C. | 60 Minutes | 0.68 | A |
| 330 | Example 30 | 130° C. | 60 Minutes | 0.68 | A |
| 331 | Example 31 | 130° C. | 60 Minutes | 0.68 | A |
| 332 | Example 32 | 130° C. | 60 Minutes | 0.67 | A |
| 333 | Example 33 | 130° C. | 60 Minutes | 0.69 | A |
| 334 | Example 34 | 130° C. | 60 Minutes | 0.69 | A |
| 335 | Example 35 | 130° C. | 60 Minutes | 0.51 | A |
| 336 | Example 36 | 130° C. | 60 Minutes | 0.59 | A |
| 337 | Example 37 | 130° C. | 60 Minutes | 0.50 | A |
| 338 | Example 38 | 130° C. | 60 Minutes | 0.57 | A |
| 339 | Example 39 | 130° C. | 60 Minutes | 0.46 | A |
| 340 | Example 40 | 130° C. | 60 Minutes | 0.58 | A |
| 341 | Example 41 | 130° C. | 60 Minutes | 0.50 | A |
| 342 | Example 42 | 130° C. | 60 Minutes | 0.60 | A |
| 343 | Example 43 | 130° C. | 60 Minutes | 0.48 | A |

TABLE 17-continued

| Example | Emulsion | Heating condition: Temperature | Heating condition: Time | Evaluation of uniformity of coat | Evaluation of image |
|---|---|---|---|---|---|
| 344 | Example 44 | 130° C. | 60 Minutes | 0.49 | A |
| 345 | Example 45 | 130° C. | 60 Minutes | 0.55 | A |
| 346 | Example 46 | 130° C. | 60 Minutes | 0.47 | A |
| 347 | Example 47 | 130° C. | 60 Minutes | 0.46 | A |
| 348 | Example 48 | 130° C. | 60 Minutes | 0.57 | A |
| 349 | Example 49 | 130° C. | 60 Minutes | 0.56 | A |
| 350 | Example 50 | 130° C. | 60 Minutes | 0.55 | A |
| 351 | Example 51 | 130° C. | 60 Minutes | 0.52 | A |
| 352 | Example 52 | 130° C. | 60 Minutes | 0.55 | A |
| 353 | Example 53 | 130° C. | 60 Minutes | 0.49 | A |
| 354 | Example 54 | 130° C. | 60 Minutes | 0.54 | A |
| 355 | Example 55 | 130° C. | 60 Minutes | 0.49 | A |
| 356 | Example 56 | 130° C. | 60 Minutes | 0.48 | A |
| 357 | Example 57 | 130° C. | 60 Minutes | 0.47 | A |
| 358 | Example 58 | 130° C. | 60 Minutes | 0.51 | A |
| 359 | Example 59 | 130° C. | 60 Minutes | 0.56 | A |
| 360 | Example 60 | 130° C. | 60 Minutes | 0.52 | A |
| 361 | Example 61 | 130° C. | 60 Minutes | 0.59 | A |
| 362 | Example 62 | 130° C. | 60 Minutes | 0.58 | A |
| 363 | Example 63 | 130° C. | 60 Minutes | 0.58 | A |
| 364 | Example 64 | 130° C. | 60 Minutes | 0.54 | A |
| 365 | Example 65 | 130° C. | 60 Minutes | 0.57 | A |
| 366 | Example 66 | 130° C. | 60 Minutes | 0.60 | A |
| 367 | Example 67 | 130° C. | 60 Minutes | 0.48 | A |
| 368 | Example 68 | 130° C. | 60 Minutes | 0.46 | A |
| 369 | Example 69 | 130° C. | 60 Minutes | 0.54 | A |
| 370 | Example 70 | 130° C. | 60 Minutes | 0.54 | A |
| 371 | Example 71 | 130° C. | 60 Minutes | 0.52 | A |
| 372 | Example 72 | 130° C. | 60 Minutes | 0.47 | A |
| 373 | Example 73 | 130° C. | 60 Minutes | 0.54 | A |
| 374 | Example 74 | 130° C. | 60 Minutes | 0.46 | A |
| 375 | Example 75 | 130° C. | 60 Minutes | 0.52 | A |
| 376 | Example 76 | 130° C. | 60 Minutes | 0.54 | A |
| 377 | Example 77 | 130° C. | 60 Minutes | 0.50 | A |
| 378 | Example 78 | 130° C. | 60 Minutes | 0.58 | A |
| 379 | Example 79 | 130° C. | 60 Minutes | 0.66 | B |
| 380 | Example 80 | 130° C. | 60 Minutes | 0.48 | A |
| 381 | Example 81 | 130° C. | 60 Minutes | 0.57 | A |
| 382 | Example 82 | 130° C. | 60 Minutes | 0.57 | A |
| 383 | Example 83 | 130° C. | 60 Minutes | 0.59 | A |
| 384 | Example 84 | 130° C. | 60 Minutes | 0.52 | A |
| 385 | Example 85 | 130° C. | 60 Minutes | 0.46 | A |
| 386 | Example 86 | 130° C. | 60 Minutes | 0.51 | A |
| 387 | Example 87 | 130° C. | 60 Minutes | 0.58 | A |
| 388 | Example 88 | 130° C. | 60 Minutes | 0.59 | A |
| 389 | Example 89 | 130° C. | 60 Minutes | 0.56 | A |
| 390 | Example 90 | 130° C. | 60 Minutes | 0.54 | A |
| 391 | Example 91 | 130° C. | 60 Minutes | 0.48 | A |
| 392 | Example 92 | 130° C. | 60 Minutes | 0.60 | A |
| 393 | Example 93 | 130° C. | 60 Minutes | 0.62 | A |
| 394 | Example 94 | 130° C. | 60 Minutes | 0.66 | B |
| 395 | Example 95 | 130° C. | 60 Minutes | 0.63 | A |
| 396 | Example 96 | 130° C. | 60 Minutes | 0.69 | A |
| 397 | Example 97 | 130° C. | 60 Minutes | 0.51 | A |
| 398 | Example 98 | 130° C. | 60 Minutes | 0.55 | A |
| 399 | Example 99 | 130° C. | 60 Minutes | 0.58 | A |
| 400 | Example 100 | 130° C. | 60 Minutes | 0.51 | A |
| 401 | Example 101 | 130° C. | 60 Minutes | 0.50 | A |
| 402 | Example 102 | 130° C. | 60 Minutes | 0.58 | A |
| 403 | Example 103 | 130° C. | 60 Minutes | 0.56 | A |
| 404 | Example 104 | 130° C. | 60 Minutes | 0.46 | A |
| 405 | Example 105 | 130° C. | 60 Minutes | 0.45 | A |
| 406 | Example 106 | 130° C. | 60 Minutes | 0.59 | A |
| 407 | Example 107 | 130° C. | 60 Minutes | 0.50 | A |
| 408 | Example 108 | 130° C. | 60 Minutes | 0.53 | A |
| 409 | Example 109 | 130° C. | 60 Minutes | 0.51 | A |
| 410 | Example 110 | 130° C. | 60 Minutes | 0.55 | A |
| 411 | Example 111 | 130° C. | 60 Minutes | 0.52 | A |
| 412 | Example 112 | 130° C. | 60 Minutes | 0.56 | A |
| 413 | Example 113 | 130° C. | 60 Minutes | 0.60 | A |
| 414 | Example 114 | 130° C. | 60 Minutes | 0.60 | A |
| 415 | Example 115 | 130° C. | 60 Minutes | 0.59 | A |
| 416 | Example 116 | 130° C. | 60 Minutes | 0.48 | A |
| 417 | Example 117 | 130° C. | 60 Minutes | 0.55 | A |

TABLE 17-continued

| Example | Emulsion | Heating condition: Temperature | Heating condition: Time | Evaluation of uniformity of coat | Evaluation of image |
|---|---|---|---|---|---|
| 418 | Example 118 | 130° C. | 60 Minutes | 0.60 | A |
| 419 | Example 119 | 130° C. | 60 Minutes | 0.48 | A |
| 420 | Example 120 | 130° C. | 60 Minutes | 0.55 | A |
| 421 | Example 121 | 130° C. | 60 Minutes | 0.47 | A |
| 422 | Example 122 | 130° C. | 60 Minutes | 0.48 | A |
| 423 | Example 123 | 130° C. | 60 Minutes | 0.59 | A |
| 424 | Example 124 | 130° C. | 60 Minutes | 0.56 | A |
| 425 | Example 125 | 130° C. | 60 Minutes | 0.57 | A |
| 426 | Example 126 | 130° C. | 60 Minutes | 0.49 | A |
| 427 | Example 127 | 130° C. | 60 Minutes | 0.48 | A |
| 428 | Example 128 | 130° C. | 60 Minutes | 0.47 | A |
| 429 | Example 129 | 130° C. | 60 Minutes | 0.52 | A |
| 430 | Example 130 | 130° C. | 60 Minutes | 0.54 | A |
| 431 | Example 131 | 130° C. | 60 Minutes | 0.68 | B |
| 432 | Example 132 | 130° C. | 60 Minutes | 0.61 | A |
| 433 | Example 133 | 130° C. | 60 Minutes | 0.63 | A |
| 434 | Example 134 | 130° C. | 60 Minutes | 0.66 | B |
| 435 | Example 135 | 130° C. | 60 Minutes | 0.68 | A |
| 436 | Example 136 | 130° C. | 60 Minutes | 0.58 | A |
| 437 | Example 137 | 130° C. | 60 Minutes | 0.51 | A |
| 438 | Example 138 | 130° C. | 60 Minutes | 0.49 | A |
| 439 | Example 139 | 130° C. | 60 Minutes | 0.58 | A |
| 440 | Example 140 | 130° C. | 60 Minutes | 0.60 | A |
| 441 | Example 141 | 130° C. | 60 Minutes | 0.57 | A |
| 442 | Example 142 | 130° C. | 60 Minutes | 0.59 | A |
| 443 | Example 143 | 130° C. | 60 Minutes | 0.59 | A |
| 444 | Example 144 | 130° C. | 60 Minutes | 0.47 | A |
| 445 | Example 145 | 130° C. | 60 Minutes | 0.57 | A |
| 446 | Example 146 | 130° C. | 60 Minutes | 0.51 | A |
| 447 | Example 147 | 130° C. | 60 Minutes | 0.50 | A |
| 448 | Example 148 | 130° C. | 60 Minutes | 0.46 | A |
| 449 | Example 149 | 130° C. | 60 Minutes | 0.52 | A |
| 450 | Example 150 | 130° C. | 60 Minutes | 0.52 | A |

TABLE 18

| Example | Emulsion | Heating condition: Temperature | Heating condition: Time | Evaluation of uniformity of coat | Evaluation of image |
|---|---|---|---|---|---|
| 451 | Example 151 | 130° C. | 60 Minutes | 0.57 | A |
| 452 | Example 152 | 130° C. | 60 Minutes | 0.53 | A |
| 453 | Example 153 | 130° C. | 60 Minutes | 0.53 | A |
| 454 | Example 154 | 130° C. | 60 Minutes | 0.46 | A |
| 455 | Example 155 | 130° C. | 60 Minutes | 0.52 | A |
| 456 | Example 156 | 130° C. | 60 Minutes | 0.57 | A |
| 457 | Example 157 | 130° C. | 60 Minutes | 0.54 | A |
| 458 | Example 158 | 130° C. | 60 Minutes | 0.56 | A |
| 459 | Example 159 | 130° C. | 60 Minutes | 0.46 | A |
| 460 | Example 160 | 130° C. | 60 Minutes | 0.64 | B |
| 461 | Example 161 | 130° C. | 60 Minutes | 0.64 | A |
| 462 | Example 162 | 130° C. | 60 Minutes | 0.62 | A |
| 463 | Example 163 | 130° C. | 60 Minutes | 0.69 | B |
| 464 | Example 164 | 130° C. | 60 Minutes | 0.66 | A |

TABLE 18-continued

| Example | Emulsion | Heating condition: Temperature | Heating condition: Time | Evaluation of uniformity of coat | Evaluation of image |
|---|---|---|---|---|---|
| 465 | Example 165 | 130° C. | 60 Minutes | 0.68 | A |
| 466 | Example 166 | 130° C. | 60 Minutes | 0.58 | A |
| 467 | Example 167 | 130° C. | 60 Minutes | 0.50 | B |
| 468 | Example 168 | 130° C. | 60 Minutes | 0.60 | A |
| 469 | Example 169 | 130° C. | 60 Minutes | 0.55 | B |
| 470 | Example 170 | 130° C. | 60 Minutes | 0.48 | A |
| 471 | Example 171 | 130° C. | 60 Minutes | 0.58 | A |
| 472 | Example 172 | 130° C. | 60 Minutes | 0.48 | A |
| 473 | Example 173 | 130° C. | 60 Minutes | 0.52 | A |
| 474 | Example 174 | 130° C. | 60 Minutes | 0.48 | A |
| 475 | Example 175 | 130° C. | 60 Minutes | 0.52 | A |
| 476 | Example 176 | 130° C. | 60 Minutes | 0.49 | A |
| 477 | Example 177 | 130° C. | 60 Minutes | 0.60 | A |
| 478 | Example 178 | 130° C. | 60 Minutes | 0.45 | A |
| 479 | Example 179 | 130° C. | 60 Minutes | 0.49 | A |
| 480 | Example 180 | 130° C. | 60 Minutes | 0.56 | A |
| 481 | Example 181 | 130° C. | 60 Minutes | 0.52 | A |
| 482 | Example 182 | 130° C. | 60 Minutes | 0.52 | A |
| 483 | Example 183 | 130° C. | 60 Minutes | 0.49 | A |
| 484 | Example 184 | 130° C. | 60 Minutes | 0.52 | A |
| 485 | Example 185 | 130° C. | 60 Minutes | 0.54 | A |
| 486 | Example 186 | 130° C. | 60 Minutes | 0.57 | A |
| 487 | Example 187 | 130° C. | 60 Minutes | 0.51 | A |
| 488 | Example 188 | 130° C. | 60 Minutes | 0.53 | A |
| 489 | Example 189 | 130° C. | 60 Minutes | 0.66 | B |
| 490 | Example 190 | 130° C. | 60 Minutes | 0.69 | A |
| 491 | Example 191 | 130° C. | 60 Minutes | 0.62 | A |
| 492 | Example 192 | 130° C. | 60 Minutes | 0.67 | B |
| 493 | Example 193 | 130° C. | 60 Minutes | 0.69 | B |
| 494 | Example 194 | 130° C. | 60 Minutes | 0.60 | A |
| 495 | Example 195 | 130° C. | 60 Minutes | 0.66 | B |
| 496 | Example 196 | 130° C. | 60 Minutes | 0.54 | A |
| 497 | Example 197 | 130° C. | 60 Minutes | 0.49 | B |
| 498 | Example 198 | 130° C. | 60 Minutes | 0.48 | A |
| 499 | Example 199 | 130° C. | 60 Minutes | 0.48 | B |
| 500 | Example 200 | 130° C. | 60 Minutes | 0.50 | A |
| 501 | Example 201 | 130° C. | 60 Minutes | 0.53 | A |

TABLE 18-continued

| Example | Emulsion | Heating condition: Temperature | Heating condition: Time | Evaluation of uniformity of coat | Evaluation of image |
|---|---|---|---|---|---|
| 502 | Example 202 | 130° C. | 60 Minutes | 0.49 | A |
| 503 | Example 203 | 130° C. | 60 Minutes | 0.54 | A |
| 504 | Example 204 | 130° C. | 60 Minutes | 0.49 | A |
| 505 | Example 205 | 130° C. | 60 Minutes | 0.55 | A |
| 506 | Example 206 | 130° C. | 60 Minutes | 0.58 | A |
| 507 | Example 207 | 130° C. | 60 Minutes | 0.58 | A |
| 508 | Example 208 | 130° C. | 60 Minutes | 0.60 | A |
| 509 | Example 209 | 130° C. | 60 Minutes | 0.54 | A |
| 510 | Example 210 | 130° C. | 60 Minutes | 0.53 | A |
| 511 | Example 211 | 130° C. | 60 Minutes | 0.49 | A |
| 512 | Example 212 | 130° C. | 60 Minutes | 0.60 | A |
| 513 | Example 213 | 130° C. | 60 Minutes | 0.58 | A |
| 514 | Example 214 | 130° C. | 60 Minutes | 0.57 | A |
| 515 | Example 215 | 130° C. | 60 Minutes | 0.52 | A |
| 516 | Example 216 | 130° C. | 60 Minutes | 0.51 | A |
| 517 | Example 217 | 130° C. | 60 Minutes | 0.47 | A |
| 518 | Example 218 | 130° C. | 60 Minutes | 0.55 | A |
| 519 | Example 219 | 130° C. | 60 Minutes | 0.67 | B |
| 520 | Example 220 | 130° C. | 60 Minutes | 0.65 | A |
| 521 | Example 221 | 130° C. | 60 Minutes | 0.60 | A |
| 522 | Example 222 | 130° C. | 60 Minutes | 0.66 | B |
| 523 | Example 223 | 130° C. | 60 Minutes | 0.64 | B |
| 524 | Example 224 | 130° C. | 60 Minutes | 0.45 | B |
| 525 | Example 225 | 130° C. | 60 Minutes | 0.47 | A |
| 526 | Example 226 | 130° C. | 60 Minutes | 0.60 | B |
| 527 | Example 227 | 130° C. | 60 Minutes | 0.46 | A |
| 528 | Example 228 | 130° C. | 60 Minutes | 0.49 | B |
| 529 | Example 229 | 130° C. | 60 Minutes | 0.54 | A |
| 530 | Example 230 | 130° C. | 60 Minutes | 0.54 | A |
| 531 | Example 231 | 130° C. | 60 Minutes | 0.51 | A |
| 532 | Example 232 | 130° C. | 60 Minutes | 0.51 | A |
| 533 | Example 233 | 130° C. | 60 Minutes | 0.47 | A |
| 534 | Example 234 | 130° C. | 60 Minutes | 0.59 | A |
| 535 | Example 235 | 130° C. | 60 Minutes | 0.51 | A |
| 536 | Example 236 | 130° C. | 60 Minutes | 0.53 | A |
| 537 | Example 237 | 130° C. | 60 Minutes | 0.51 | A |
| 538 | Example 238 | 130° C. | 60 Minutes | 0.48 | A |
| 539 | Example 239 | 130° C. | 60 Minutes | 0.57 | A |
| 540 | Example 240 | 130° C. | 60 Minutes | 0.47 | A |
| 541 | Example 241 | 130° C. | 60 Minutes | 0.55 | A |
| 542 | Example 242 | 130° C. | 60 Minutes | 0.54 | A |
| 543 | Example 243 | 130° C. | 60 Minutes | 0.54 | A |
| 544 | Example 244 | 130° C. | 60 Minutes | 0.54 | A |
| 545 | Example 245 | 130° C. | 60 Minutes | 0.47 | A |
| 546 | Example 246 | 130° C. | 60 Minutes | 0.53 | A |
| 547 | Example 247 | 130° C. | 60 Minutes | 0.55 | A |
| 548 | Example 248 | 130° C. | 60 Minutes | 0.68 | B |
| 549 | Example 249 | 130° C. | 60 Minutes | 0.57 | A |
| 550 | Example 250 | 130° C. | 60 Minutes | 0.47 | B |
| 551 | Example 251 | 130° C. | 60 Minutes | 0.57 | A |

TABLE 18-continued

| Example | Emulsion | Heating condition Temperature | Heating condition Time | Evaluation of uniformity of coat | Evaluation of image |
|---|---|---|---|---|---|
| 552 | Example 252 | 130° C. | 60 Minutes | 0.51 | B |
| 553 | Example 253 | 130° C. | 60 Minutes | 0.58 | A |
| 554 | Example 254 | 130° C. | 60 Minutes | 0.54 | A |
| 555 | Example 255 | 130° C. | 60 Minutes | 0.47 | A |
| 556 | Example 256 | 130° C. | 60 Minutes | 0.48 | A |
| 557 | Example 257 | 130° C. | 60 Minutes | 0.56 | A |
| 558 | Example 258 | 130° C. | 60 Minutes | 0.48 | A |
| 559 | Example 259 | 130° C. | 60 Minutes | 0.47 | A |
| 560 | Example 260 | 130° C. | 60 Minutes | 0.57 | A |
| 561 | Example 261 | 130° C. | 60 Minutes | 0.59 | A |
| 562 | Example 262 | 130° C. | 60 Minutes | 0.53 | A |
| 563 | Example 263 | 130° C. | 60 Minutes | 0.59 | A |
| 564 | Example 264 | 130° C. | 60 Minutes | 0.53 | A |
| 565 | Example 265 | 130° C. | 60 Minutes | 0.58 | A |
| 566 | Example 266 | 130° C. | 60 Minutes | 0.56 | A |
| 567 | Example 267 | 130° C. | 60 Minutes | 0.47 | A |
| 568 | Example 268 | 130° C. | 60 Minutes | 0.54 | A |
| 569 | Example 269 | 130° C. | 60 Minutes | 0.57 | A |
| 570 | Example 270 | 130° C. | 60 Minutes | 0.57 | A |
| 571 | Example 271 | 130° C. | 60 Minutes | 0.66 | B |
| 572 | Example 272 | 130° C. | 60 Minutes | 0.45 | A |
| 573 | Example 273 | 130° C. | 60 Minutes | 0.60 | B |
| 574 | Example 274 | 130° C. | 60 Minutes | 0.55 | A |
| 575 | Example 275 | 130° C. | 60 Minutes | 0.54 | B |
| 576 | Example 276 | 130° C. | 60 Minutes | 0.46 | A |
| 577 | Example 277 | 130° C. | 60 Minutes | 0.57 | A |
| 578 | Example 278 | 130° C. | 60 Minutes | 0.56 | A |
| 579 | Example 279 | 130° C. | 60 Minutes | 0.59 | A |
| 580 | Example 280 | 130° C. | 60 Minutes | 0.58 | A |
| 581 | Example 281 | 130° C. | 60 Minutes | 0.59 | A |
| 582 | Example 282 | 130° C. | 60 Minutes | 0.59 | A |
| 583 | Example 283 | 130° C. | 60 Minutes | 0.56 | A |
| 584 | Example 284 | 130° C. | 60 Minutes | 0.49 | A |
| 585 | Example 285 | 130° C. | 60 Minutes | 0.53 | A |
| 586 | Example 286 | 130° C. | 60 Minutes | 0.58 | A |
| 587 | Example 287 | 130° C. | 60 Minutes | 0.49 | A |
| 588 | Example 288 | 130° C. | 60 Minutes | 0.57 | A |
| 589 | Example 289 | 130° C. | 60 Minutes | 0.51 | A |
| 590 | Example 290 | 130° C. | 60 Minutes | 0.56 | A |
| 591 | Example 291 | 130° C. | 60 Minutes | 0.54 | A |
| 592 | Example 292 | 130° C. | 60 Minutes | 0.50 | A |
| 593 | Example 293 | 130° C. | 60 Minutes | 0.59 | A |
| 594 | Example 294 | 130° C. | 60 Minutes | 0.56 | A |
| 595 | Example 295 | 130° C. | 60 Minutes | 0.59 | A |
| 596 | Example 296 | 130° C. | 60 Minutes | 0.67 | B |
| 597 | Example 297 | 130° C. | 60 Minutes | 0.45 | A |
| 598 | Example 298 | 130° C. | 60 Minutes | 0.46 | A |
| 599 | Example 299 | 130° C. | 60 Minutes | 0.46 | A |
| 600 | Example 300 | 130° C. | 60 Minutes | 0.45 | A |
| 801 | Example 701 | 130° C. | 60 Minutes | 0.58 | A |

TABLE 19

| Comparative Example | Emulsion | Heating condition Temperature | Heating condition Time | Evaluation of uniformity of coat | Evaluation of image |
|---|---|---|---|---|---|
| 7 | Comparative Example 1 | 130° C. | 60 Minutes | 0.78 μm | D |
| 8 | Comparative Example 2 | 130° C. | 60 Minutes | 0.72 μm | C |
| 9 | Comparative Example 3 | 130° C. | 60 Minutes | 0.71 μm | D |
| 10 | Comparative Example 4 | 130° C. | 60 Minutes | 0.75 μm | D |
| 11 | Comparative Example 5 | 130° C. | 60 Minutes | 0.78 μm | C |

TABLE 19-continued

| Comparative Example | Emulsion | Heating condition Temperature | Heating condition Time | Evaluation of uniformity of coat | Evaluation of image |
|---|---|---|---|---|---|
| 12 | Comparative Example 6 | 130° C. | 60 Minutes | 0.81 μm | D |
| 13 | Comparative Example 1 | 130° C. | 60 Minutes | 0.74 μm | C |
| 14 | Comparative Example 2 | 130° C. | 60 Minutes | 0.76 μm | C |

By comparison of Examples 301 to 600 with Comparative Examples 7 to 12, in the emulsion having the configuration described in Japanese Patent Application Laid-Open No. 2011-128213, the charge transporting layer formed using the emulsion after leaving for a long time has inferior uniformity of the coat to that of the emulsion according to the present invention prepared using the solution containing the charge transporting substance and the compound that reduces the surface energy, and water. It is thought that coalescence of the oil droplets in the emulsion after long-term preservation causes aggregation of the oil droplets to reduce the uniformity of the oil droplets in the emulsion; thereby, the uniformity of the coat surface after formation of the charge transporting layer is reduced.

Moreover, by comparison of Comparative Examples with Examples 13 and 14, it turns out that compared to the emulsion according to the present invention prepared using the solution containing the charge transporting substance and the compound that reduces the surface energy, and water, the emulsion having the configuration described in Japanese Patent Application Laid-Open No. 2011-128213 may not obtain sufficient uniformity of the coat even if the emulsion is not preserved for a long time. This shows that in the case where the compound that reduces the surface energy is not used, the particle diameter of the emulsion particle is not sufficiently reduced depending on the condition, and it is difficult to obtain sufficient uniformity of the coat after formation of the charge transporting layer.

The image was evaluated as Rank A or B if the surface roughness was less than 0.7 μm in evaluation of uniformity of the coat surface, and the image was evaluated as Rank C or D if the surface roughness was 0.7 μm or more in evaluation of uniformity of the coat surface. Namely, the uniformity of the coat surface corresponds to unevenness of the image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-058904, filed Mar. 15, 2012, and 2013-039646, filed Feb. 28, 2013, which are hereby incorporated by reference herein in their entirety.

The invention claimed is:

1. A method of producing an electrophotographic photosensitive member which comprises a support and a charge transporting layer formed thereon, comprising the steps of:

preparing a solution comprising a charge transporting material; and at least one compound selected from the group consisting of a fluorine-atom-containing polyacrylate, a fluorine-atom-containing polymethacrylate, a polycarbonate having siloxane bond, a polyester having siloxane bond, a polystyrene having siloxane bond, a silicone oil, a polyolefin, an aliphatic acid, an aliphatic acid amide, and an aliphatic acid ester;

dispersing the solution in water to prepare an emulsion;

forming a coat for the charge transporting layer by using the emulsion; and heating the coat to form the charge transporting layer.

2. A method of producing the electrophotographic photosensitive member according to claim 1, wherein the fluorine-atom-containing polyacrylate and the fluorine-atom-containing polymethacrylate are represented by the following formula (1), (1)

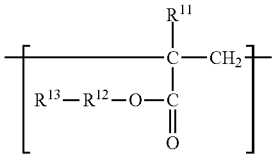

in which $R^{11}$ represents a hydrogen or a methyl group, $R^{12}$ represents an alkylene group, $R^{13}$ represents a perfluoroalkyl group having carbon atoms 4 to 6.

3. A method of producing the electrophotographic photosensitive member according to claim 1, wherein the polycarbonate having siloxane bond is a polycarbonate A comprising a repeating structural unit represented by the following formula (2-1) and a repeating structural unit represented by the following formula (2-3), or a polycarbonate B comprising a repeating structural unit represented by the following formula (2-2) and a repeating structural unit represented by the following formula (2-3), (2-1)

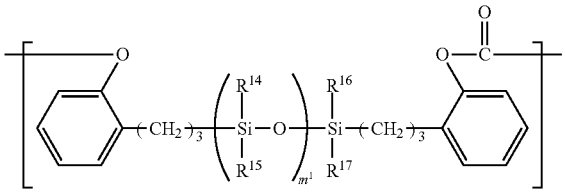

(2-2)

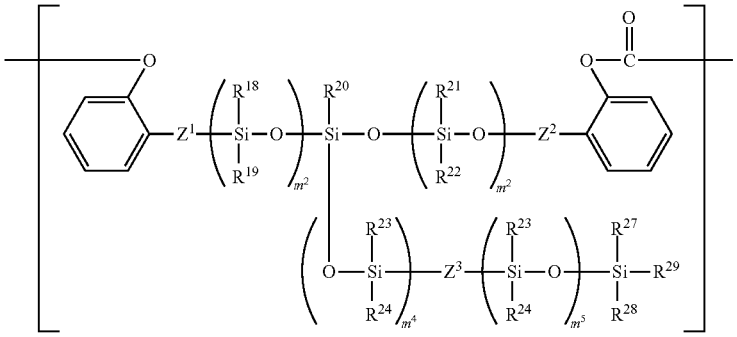

(2-3)

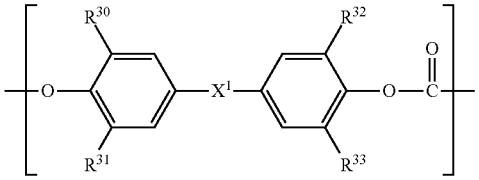

in which $R^{14}$ to $R^{17}$ each independently represents a methyl group or a phenyl group, $m^1$ represents number of repetitions of a structure enclosed in brackets, and an average of $m^1$ in the polycarbonate A ranges from 20 to 100;

$R^{18}$ to $R^{29}$ each independently represents a methyl group or a phenyl group, $m^2$, $m^3$, $m^4$ and $m^5$ each independently represents number of repetitions of a structure enclosed in brackets, an average of $m^2+m^3+m^4+m^5$ in the polycarbonate B ranges from 0 to 450, $Z^1$ and $Z^2$ each independently represents an ethylene group or a propylene group, and $Z^3$ represents an oxygen atom, an ethylene group or a propylene group; and $X^1$ represents a single bond, a methylene group, an ethylidene group, a propylidene group, a phenylethylidene group, a cyclohexylidene group, or an oxygen atom, and $R^{30}$ to $R^{33}$ each independently represents a hydrogen atom or a methyl group.

4. A method of producing the electrophotographic photosensitive member according to claim 1, wherein the polyester having siloxane bond is a polyester C comprising a repeating structural unit represented by the following formula (3-1) and a repeating structural unit represented by the following formula (3-2), (3-1)

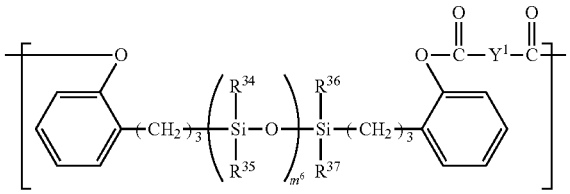

(3-2)

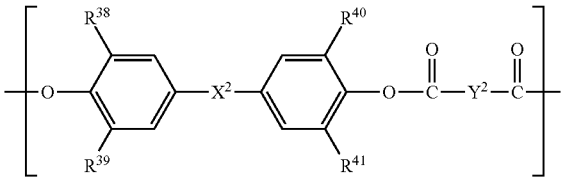

in which $R^{34}$ to $R^{37}$ each independently represents a methyl group or a phenyl group, $Y^1$ represents a meta-phenylene group, a para-phenylene group, or a bivalent group having two para-phenylene groups bonded with an oxygen atom, $m^6$ represents number of repetitions of a structure enclosed in brackets, and an average of $m^6$ in the polyester C ranges from 20 to 100; and $R^{38}$ to $R^{41}$ each independently represents a hydrogen atom or a methyl group, $X^2$ represents a single bond, a methylene group, an ethylidene group, a propylidene group, a cyclohexylidene group, or an oxygen atom, and $Y^2$ represents a meta-phenylene group, para-phenylene group, or a bivalent group having two paraphenylene groups bonded with an oxygen atom.

5. A method of producing the electrophotographic photosensitive member according to claim 1, wherein the polystyrene having siloxane bond is a polystyrene D comprising a repeating structural unit represented by the following formula (4-1) and a repeating structural unit represented by the following formula (4-2), (4-1)

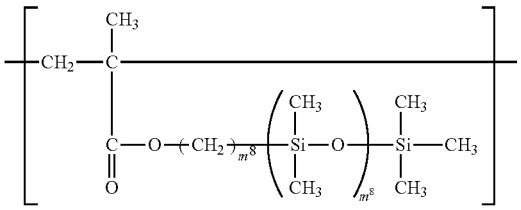

(4-2)

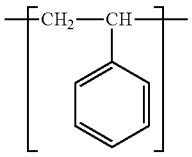

in which $m^7$ represents an integer selected from 1 to 10, and $m^8$ represents an integer selected from 20 to 100.

6. A method of producing the electrophotographic photosensitive member according to claim 1, wherein the silicone oil is represented by the following formula (5), (5)

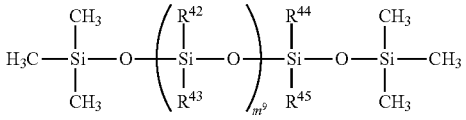

in which $R^{42}$ to $R^{45}$ each independently represents a methyl group or a phenyl group, and $m^9$ is an integer selected from 20 to 100.

7. A method of producing the electrophotographic photosensitive member according to claim 1, wherein the polyolefin is an aliphatic hydrocarbon having carbon atoms 10 to 40.

8. A method of producing the electrophotographic photosensitive member according to claim 1, wherein the aliphatic acid, the aliphatic acid amide and the aliphatic acid ester are represented by the following formula (7-1), (7-1)

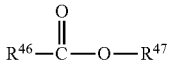

in which $R^{46}$ represents an alkyl group having carbon atoms 10 to 40, and $R^{47}$ represents a hydrogen atom, an amino group, or an alkyl group having carbon atoms 10 to 40.

9. A method of producing the electrophotographic photosensitive member according to claim 1, wherein, in the emulsion, the ratio of a mass of water to a mass of the solution is 5/5 to 7/3.

10. A method of producing the electrophotographic photosensitive member according claim 1, wherein the solution further comprises a binder resin, the binder resin being a polycarbonate resin free from a siloxane bond or a polyester resin free from a siloxane bond.

11. A method of producing the electrophotographic photosensitive member according to claim 1, wherein the solution further comprises a liquid whose solubility in water under 25° C. and 1 atmosphere is 1.0 mass % or less.

12. An emulsion for a charge transporting layer in which a solution is dispersed in water, wherein the solution comprises:

a charge transporting material; and at least one compound selected from the group consisting of a fluorine-atom-containing polyacrylate, a fluorine-atom-containing polymethacrylate, a polycarbonate having siloxane bond, a polyester having siloxane bond, a polystyrene having siloxane bond, a silicone oil, a polyolefin, an aliphatic acid, an aliphatic acid amide and an aliphatic acid ester.

13. The emulsion for a charge transporting layer according to claim 12, wherein the solution further comprises a liquid whose solubility in water under 25° C. and 1 atmosphere is 1.0 mass % or less.

* * * * *